US008087837B2

(12) United States Patent
Fukumasu

(10) Patent No.: US 8,087,837 B2
(45) Date of Patent: Jan. 3, 2012

(54) CASSETTE UNIT AND PRINTING APPARATUS

(75) Inventor: Keiichiro Fukumasu, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 950 days.

(21) Appl. No.: 12/057,645

(22) Filed: Mar. 28, 2008

(65) Prior Publication Data

US 2008/0310905 A1 Dec. 18, 2008

(30) Foreign Application Priority Data

Mar. 29, 2007 (JP) ..... 2007-088811
Mar. 29, 2007 (JP) ..... 2007-088869
Jul. 3, 2007 (JP) ..... 2007-174818

(51) Int. Cl.
*B41J 13/10* (2006.01)
*B65H 1/00* (2006.01)
*B65H 1/08* (2006.01)
*B65H 1/12* (2006.01)

(52) U.S. Cl. ..... 400/624; 271/160

(58) Field of Classification Search ..... 400/624; 271/162–164, 160; 399/393
See application file for complete search history.

(56) References Cited

U.S. PATENT DOCUMENTS 4,922,291 A * 5/1990 Adachi ..... 355/72
5,201,507 A * 4/1993 Tokuda ..... 271/9.01

FOREIGN PATENT DOCUMENTS

| | | | |
|---|---|---|---|
| JP | 55-101535 A | | 8/1980 |
| JP | 60144245 A | * | 7/1985 |
| JP | 63-242830 | | 10/1988 |
| JP | 02209326 A | * | 8/1990 |
| JP | 05-043076 | | 2/1993 |
| JP | 07-232833 | | 9/1995 |
| JP | 2504162 | | 4/1996 |
| JP | 10-109764 | | 4/1998 |
| JP | 2005-200159 | | 7/2005 |
| JP | 2006-103859 | | 4/2006 |
| JP | 2006103859 A | * | 4/2006 |
| JP | 2006-232552 | | 9/2006 |

* cited by examiner

*Primary Examiner* — Daniel J Colilla
(74) *Attorney, Agent, or Firm* — Workman Nydegger

(57) ABSTRACT

A cassette unit includes: a cassette case which covers a printing medium and has a feeding opening for passing the printing medium when the printing medium is fed by a feeding roller of a printing apparatus body; a cassette hopper which receives the printing medium and comes in contact with or separates from the feeding roller in a state in which the cassette hopper is mounted in the printing apparatus body; and s shutter which is switched so as to allow the printing medium to pass through the feeding opening or to prevent the printing medium from passing through the feeding opening, the cassette case, the cassette hopper, and the shutter being formed integrally. The cassette hopper is bent in a direction in which the cassette hopper approaches the feeding roller in a first joint portion jointing with the cassette case to engage with a first engagement portion.

12 Claims, 51 Drawing Sheets

CASSETTE UNIT AND PRINTING APPARATUS

BACKGROUND

1. Technical Field

The present invention relates to a cassette unit which includes a cassette case with a feeding opening through which a paper sheet passes when the printing medium is fed by a feeding roller of a printing apparatus body, a cassette hopper coming in contact with or separating from the feeding roller when the cassette case is mounted in the printing apparatus body, and a shutter switched so as to allow the printing medium to pass through the feeding opening or to prevent the printing medium from passing through the feeding opening. Moreover, the present invention relates to a printing apparatus including the cassette unit.

As the printing apparatus, an ink jet printer, a wire dot printer, a laser printer, a line printer, a copier, and a facsimile can be exemplified.

Moreover, a liquid ejecting apparatus is not limited to the printing apparatus such as a copier, a facsimile, or an ink jet printing apparatus capable of ejecting ink on a printing medium such as a printing sheet through a printing head as a liquid ejecting head. The liquid ejecting apparatus refers to an apparatus capable of ejecting a liquid corresponding to ink, which is used for a specific use, on an ejecting medium corresponding to the printing medium through a liquid ejecting head corresponding to the printing head to adhere the liquid on the ejecting medium.

In addition to the printing apparatus, as the liquid ejecting head, a color-material ejecting head used to manufacture a color-filter for a liquid crystal display or the like, an electrode material (conductive paste) ejecting head used to form an electrode for an organic electroluminescent (EL) display, a field emission display (FED), or the like, a bio-organism ejecting head used to manufacture a bio chip, and a sample ejecting head as a precision pipette for ejecting a sample can be exemplified.

2. Related Art

In a known example, as disclosed in JP-A-2006-103859, a cassette unit detachably mounted in a printing apparatus body includes a plurality of elements such as a case, a hopper of the cassette unit, a cover member, and a shutter. The case is a member which covers a paper sheet as an example of a printing medium received in the cassette unit. The hopper of the cassette unit is configured so as to be pivotal and to bring a received paper sheet in contact with or separate the paper sheet from a feeding roller of a printing apparatus body.

The cover member is disposed on the front surface of the case. Paper sheets can be supplemented in the cassette unit by opening the cover member. The shutter is a member which prevents the paper sheets received in the cassette unit from moving in a feeding direction. The shutter is configured so as to be opened when the cassette unit is mounted in the printing apparatus body. Moreover, the shutter is configured so as to be closed when the cassette unit is detached from the printing apparatus body.

However, the cassette unit includes the plurality of elements. Accordingly, when the plurality of elements are assembled, many number of assembling processes minus one from the number of the elements is necessary. Moreover, as the number of the elements is numerous, cost may increase. If the number of the assembling processes is numerous, the number of disassembling processes may increase when the elements are disassembled.

When a user mounts the cassette unit to the printing apparatus body, it is necessary for the user in open the shutter beforehand. Specifically, the user has to detach the shutter from the cassette unit to open the shutter. That is, after the user opens the shutter, the user has to mount the cassette unit in the printing apparatus body. Accordingly, with such a configuration, the user has to experience inconvenience due to many operating processes when the user mounts the cassette unit. That is, the user could not easily mount the cassette unit in the printing apparatus body.

SUMMARY

An advantage of some aspects of the invention is that it provides a cassette unit which is easily assembled and a printing apparatus which includes the cassette unit.

Another advantage of some aspect of the invention is that is provides a printing apparatus which includes a feeding unit capable of easily opening a shutter of the cassette unit when the cassette unit detachably mounted in a feeding unit body is mounted in the feeding apparatus body.

According to an aspect of the invention, there is provided a cassette unit including: a cassette case which covers a printing medium and has a feeding opening for passing the printing medium when the printing medium is fed by a feeding roller of a printing apparatus body; a cassette hopper which receives the printing medium and comes in contact with or separates from the feeding roller in a state in which the cassette hopper is mounted in the printing apparatus body; and s shutter which is switched so as to allow the printing medium to pass through the feeding opening or to prevent the printing medium from passing through the feeding opening, the cassette case, the cassette hopper, and the shutter being formed integrally. The cassette hopper is bent in a direction in which the cassette hopper approaches the feeding roller in a first joint portion jointing with the cassette case to engage with a first engagement portion provided in the cassette case.

According to the cassette unit having the above-described configuration, the cassette unit is assembled by bending the cassette hopper in a direction in which the cassette hopper approaches the feeding roller in the first joint portion jointing with the cassette case to engage with the first joint portion jointing with the cassette case. Accordingly, the cassette unit can be easily assembled. That is, since the elements are integrally formed, the cassette unit can be assembled just by bending the cassette hopper in the first joint portion. Therefore, work efficiency is excellent.

The cassette hopper is bent in the direction the cassette hopper approaches the feeding roller. For example, the cassette unit made by a flexible material can be integrally formed. In this case, a restoration force against the bending is generated in the first joint portion.

As a result, the cassette hopper is urged in a direction in which the cassette hopper gets away from the feeding roller. That is, in a state in which any force is not applied from the printing apparatus body, the cassette hopper can become a so-called hopper down state in which the cassette hopper is completely separated from the feeding roller.

In this case, "the flexible material" refers to a material which can be bent from the plate shape. For example, a resin such as polypropylene (PP) is preferable. Of course, a material with an elastic property may be also used.

In the cassette unit having the above-described configuration, the cassette case may be provided with a hopper opening through which the printing medium is inserted into the cassette case so as to be close to the cassette hopper.

According to the cassette unit having the above-described configuration, the cassette case includes the hopper opening through which the printing medium can be inserted into the cassette case so as to be close to the cassette hopper. Accordingly, upon assembling the cassette unit, the printing medium can be received in the cassette case through the hopper opening before the cassette hopper is bent in the first joint portion. That is, the cassette hopper can also serve as a so-called cassette cover.

When the cassette unit is assembled, the printing medium can be received before the cassette hopper is bent in the first joint portion, that is, when the hopper opening is opened. Accordingly, since the printing medium is easily received, the work efficiency is excellent. That is, it is not necessary to release the engagement with the first engagement portion and open the cassette hopper as the cassette cover to receive the printing medium when the cassette unit is assembled.

According to the cassette unit having the above-described configuration, the shutter may be bent toward the inside of the cassette case in a second joint portion jointing with the cassette case to engage with a second engagement portion provided in the cassette case.

According to the cassette unit having the above-described configuration, the shutter is bent toward the inside of the cassette case in the second joint portion jointing with the cassette case to engage with the second engagement provided in the cassette case. Accordingly, the cassette unit can be easily assembled. That is, the shutter is just bent in the second joint portion to engage with the second engagement.

The shutter is bent toward the inside of the cassette case. For example, the cassette unit can be integrally formed by the above-mentioned flexible material. In this case, like the first joint portion, a restoration force against the bending is generated in the second joint portion.

As a result, the shutter is urged toward the outside of the cassette case. For this reason, in a state in which any force is exerted from the printing apparatus body, the shutter can be stabilized in a shutter closing state in which the printing medium is prevented from passing through the feeding opening. That is, the shutter can be stabilized in the shutter closing state in which the cassette case engages with the second engagement portion.

According to the cassette unit having the above-described configuration, the shutter may become a close state where the printing medium is prevented from passing therethrough when the shutter engages with the second engagement portion, and the shutter becomes an open state where the printing medium is not prevented from passing therethrough when the shutter is rotatably moved toward the inside of the cassette case using the second joint portion as a pivot point from the close state. The shutter may engage with a third engagement portion provided in the cassette case when the shutter is closed, and the engagement with the third engagement is released when the shutter is opened. The third engagement portion may be separated from the second engagement portion with reference to the second joint portion.

According to the cassette unit having the above-described configuration, the shutter engages with the third engagement portion provided in the cassette case when the shutter is closed. At this time, the engagement with the third engagement becomes released when the shutter is opened. Accordingly, even though a small external force which is not intended is applied in the shutter, the shutter closing state can be reliably maintained. That is, it is possible to stabilize the shutter in the shutter closing state.

The third engagement portion is configured so as to be separated from the second engagement portion with reference to the second joint portion. For example, the cassette unit made of a flexible material is integrally formed as described above. In this case, the bending deformation at the position more separated from the reference position is easier than that at the position at the vicinity of the reference position. Accordingly, in the state in which the shutter engages with the second engagement portion, it is possible to engage the shutter with the third engagement portion and to release the shutter from the third engagement portion.

According to the cassette unit having the above-described configuration, the shutter may be formed in an L shape.

According to the cassette unit having the above-described configuration, the shutter is formed in the L shape. Accordingly, in the configuration in which the shutter is rotatably moved using the second joint portion as a pivot point, the shutter can be easily switched to allow the printing medium to pass through the feeding opening or to prevent the printing medium from passing through the feeding opening.

Moreover, it is possible to easily configure the positional relation of the second engagement portion and the second engagement portion by forming the shutter in the L shape.

For example, by forming the shutter made of the flexible material in the L shape, it is possible to easily curve the vicinity of the L-shaped bending portion of the shutter in a direction perpendicular to two axes directions forming the L shape.

For example, when a user detaches the cassette unit from the printing apparatus body, a shutter closing mechanism (which is indicated by Reference Numeral 40) provided in the printing apparatus body can be moved backward from the shutter by bending the shutter. That is, the shutter made of the flexible material and formed in the L shape can easily move the shutter closing mechanism backward from the shutter after the shutter is closed.

As a result, when the user detaches the cassette unit from the printing apparatus body, the shutter can engage with the third engagement portion more reliably in the state in which the shutter engages with the second engagement portion.

According to the cassette unit having the above-described configuration, the cassette hopper may include a notch portion formed at a position opposed to the feeding roller.

According to the cassette unit having the above-described configuration, the cassette hopper may include a notch portion formed at a position opposed to the feeding roller. Accordingly, a known high-friction member such as cork included in the cassette hopper of the printing apparatus body can be touched with the printing medium through the notch portion. That is, it is not necessary to provide the high-friction member such as cork in the cassette hopper. As a result, it is possible to decrease cost of the cassette unit since it is not necessary to provide the high-friction member such as cork.

The cassette unit may further include a printing medium.

According to the cassette unit having the above-described configuration, the cassette unit further includes the printing medium. That is, the printing medium is one of the elements of the cassette unit.

The cassette unit having the above-described configuration further includes an engagement portion which engages with an elastic engagement portion provided in the printing apparatus body.

According to the cassette unit having the above-described configuration, the cassette unit includes the engagement portion capable of engaging with the elastic engagement portion provided in the printing apparatus body. Accordingly, when the cassette unit is mounted in the printing apparatus body, the position at which the cassette unit is mounted in the printing apparatus body can be determined with precision. That is, it is possible to decrease rattling of the mounted cassette unit.

As a result, in the printing apparatus body, it is possible to improve feeding efficiency of the printing medium. For example, the piled printing medium can be prevented from be fed since an incoming angle of the printing medium with respect to a separating member provided in the feeding unit becomes stable.

The elastic engagement portion is configured so as to be provided in the printing apparatus body which is touched by the user with difficulty. That is, the elastic engagement portion is not provided in the cassette unit which can be touched by the user. Accordingly, there is less possibility that the user can damage the elastic engagement portion by mistake.

When the cassette unit is made of the flexible material, there is a possibility that the cassette unit is not efficiently operated in a case in which the elastic engagement portion is provided in the cassette unit.

For this reason, the cassette unit according to the embodiment includes the engagement portion capable of engaging with the elastic engagement portion of the printing apparatus body. In the cassette unit, accordingly, the elastic engagement portion can effectively engage with the engagement portion. In terms of cost, such a configuration is particularly effective when the cassette unit made of the flexible material is integrally formed.

According to the cassette unit having the above-described configuration, the elastic engagement portion may have a slope portion inclined in a direction in which the cassette unit is mounted, and the slope portion may come in contact with the engagement portion when the cassette unit is mounted in the printing apparatus body.

According to the cassette unit having the above-described configuration, the elastic engagement portion may have a slope portion inclined in a direction in which the cassette unit is mounted, and the slope portion may come in contact with the engagement portion when the cassette unit is mounted in the printing apparatus body. Accordingly, with such a configuration, it is possible to decrease rattling of the mounted cassette unit.

According to another aspect of the invention, there is provided a printing apparatus including: a receiving unit which receives a printing medium; a feeding unit which feeds the received printing medium; and a printing unit which allows a printing head to perform printing on the printing medium fed by the feeding unit. The receiving unit includes the cassette unit having the above-described configuration.

According to the printing apparatus having the above-described configuration, the receiving unit includes the cassette unit having the above-described configuration. Accordingly, the printing apparatus can include the elements of the cassette unit having the above-described configuration.

According to the printing apparatus having the above-described configuration, the feeding unit may include a feeding mechanism with a shutter opening portion which comes in contact with a shutter to open the shutter when the cassette unit is mounted in a feeding mechanism body.

According to the printing apparatus having the above-described configuration, the feeding unit includes the shutter opening portion. Accordingly, the feeding unit can come in contact with the shutter to open the shutter when the cassette unit is mounted in the feeding unit body. That is, the feeding unit can open the shutter using a force generated when the user mounts the cassette unit. As a result, it is not necessary for the user to open the shutter, thereby facilitating the use of the printing apparatus.

Moreover, it is not necessary for the user to detach the shutter from the cassette unit beforehand when the user mounts the cassette unit in the feeding apparatus body. Accordingly, the user may lose the shutter.

Moreover, it is not necessary for the user to touch and operate the shutter in person. Accordingly, the shutter may not be damaged.

According to the printing apparatus having the above-described configuration, the feeding mechanism may have a shutter closing portion which comes in contact with the shutter to close the shutter when the cassette unit is detached from the feeding mechanism body.

According to the printing apparatus having the above-described configuration, the feeding unit includes the shutter closing portion. Accordingly, the feeding unit can come in contact with the shutter to close the shutter when the cassette unit is detached from the feeding apparatus body. That is, the feeding unit can close the shutter using a force generated when the user detaches the cassette unit. As a result, it is not necessary for the user to touch and operate the shutter in person, thereby facilitating the use of the printing apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

Figure 1:
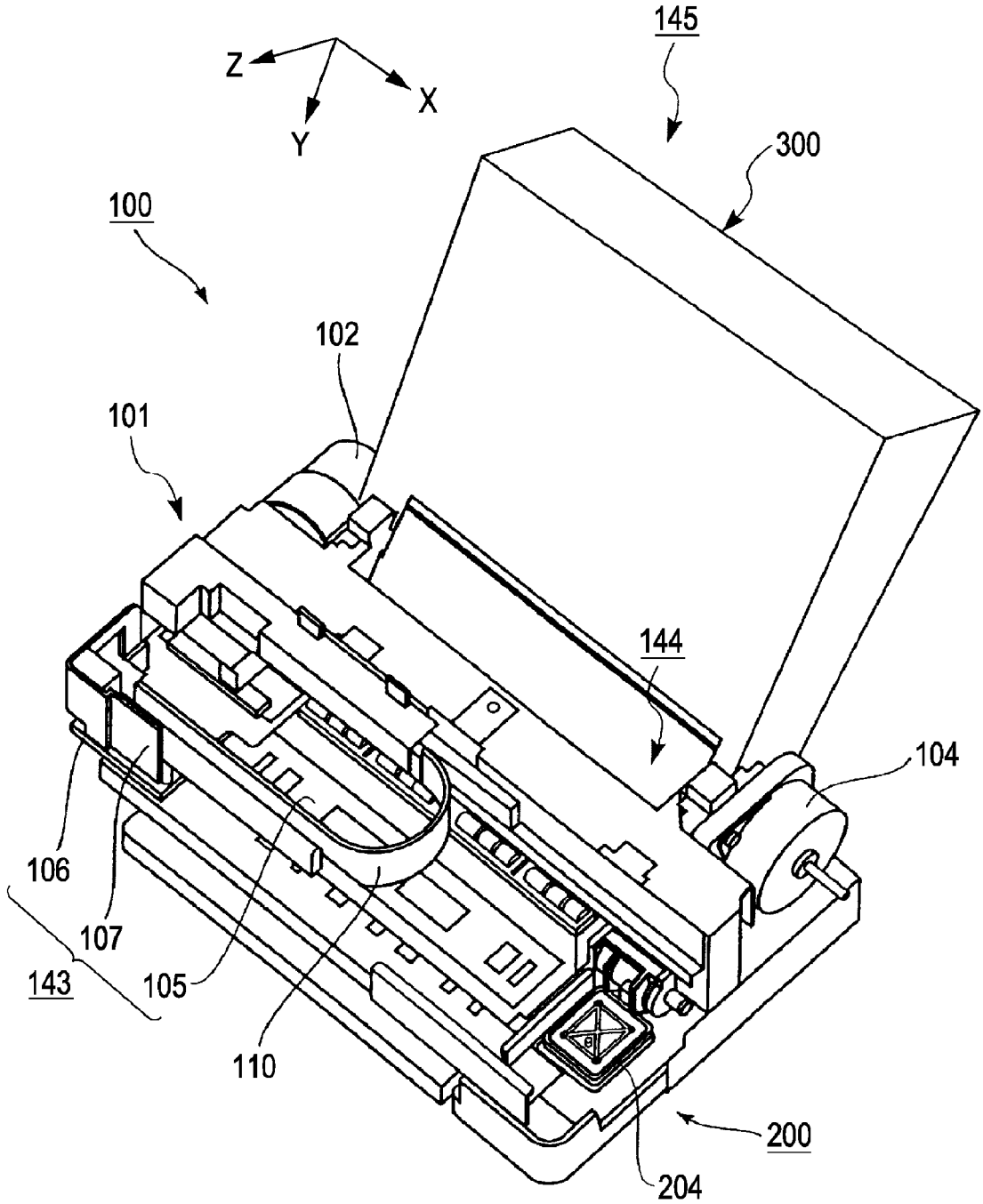
FIG. 1 is a schematic perspective view illustrating a printing apparatus according to the invention.
Figure 2:
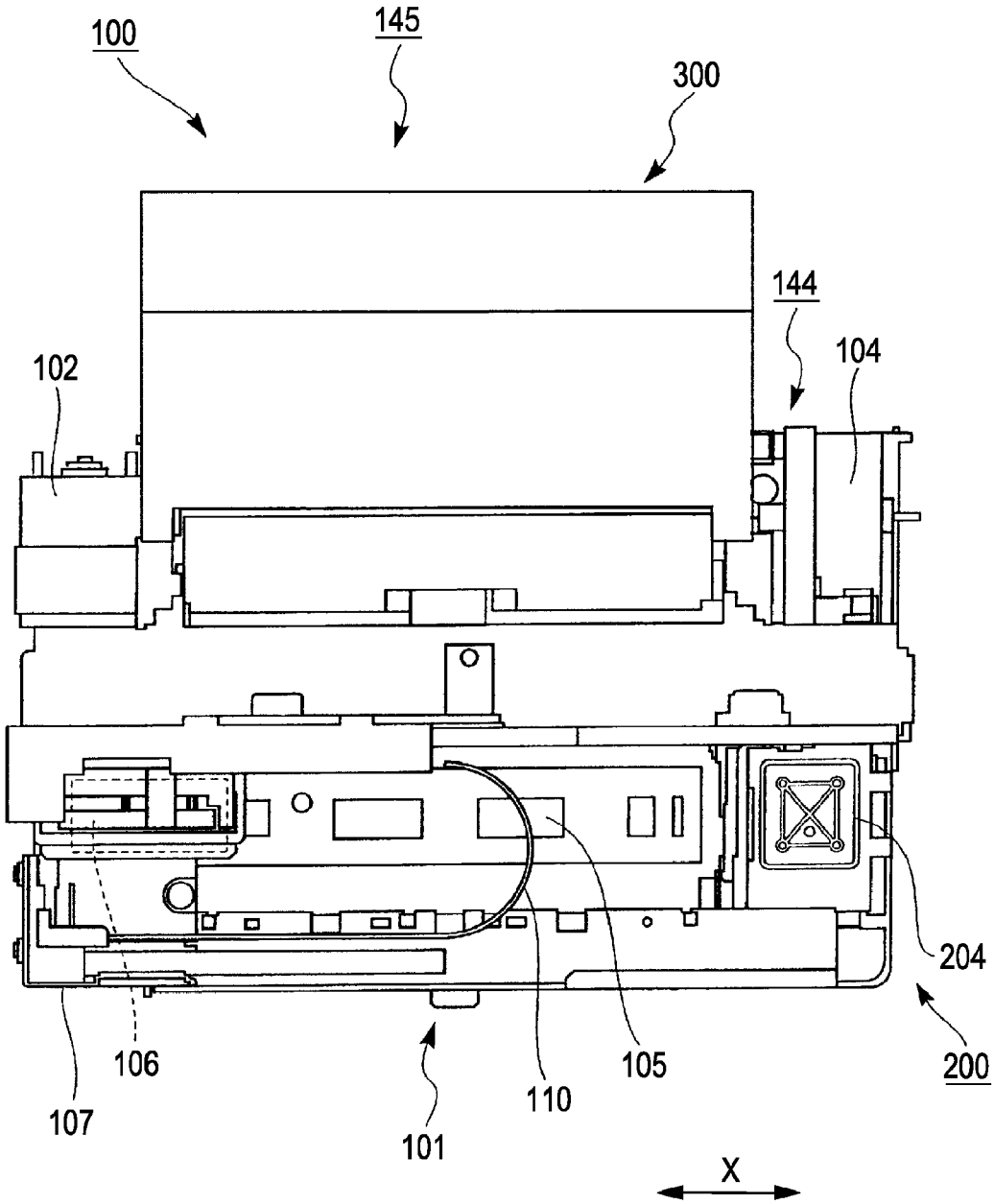
FIG. 2 is a schematic top view illustrating the printing apparatus according to the invention.

FIG. 1 is a schematic perspective view illustrating a printing apparatus as an example of a liquid ejecting apparatus according to the invention. FIG. 2 is a schematic top view illustrating the printing apparatus according to the invention.

On the rear surface of a body of a printing apparatus 100, a cassette unit 300 of a receiving unit 145 for receiving a paper sheet P as a printing medium is mounted in a printing apparatus body 101. Within the cassette unit 300, a cassette hopper 320 (see FIGS. 3 to 8) can come in contact with or separate from a feeding roller 190 (see FIGS. 3 to 8) of a feeding unit 144, which is described below. Specifically, the cassette hopper 320 extends in a transverse direction X of the paper sheet P to be received and can be pivoted at a first joint portion 321 (see FIGS. 3, 10, and 11) disposed in the upper portion of the cassette hopper 320.

The uppermost paper sheet P received in the cassette hopper 320 (see FIGS. 3 to 8) is fed toward a printing unit which is on the downstream side of the transport direction by the feeding unit 144. Specifically, the received paper sheet P is guided to right and left edge guides 318 (see FIG. 10) by the feeding roller 190 (see FIGS. 3 to 8) driven by a feeding motor 104, and is fed to a pair of downstream transport rollers (not shown) toward the downstream side of the transport direction. The paper sheet P fed to the transport rollers (not shown) is again transported to the printing unit 143 toward the downstream side of the transport direction by a pair of the transport rollers (not shown) driven by a transporting motor (not shown).

The printing unit 143 includes a platen 105 for supporting the underside of the paper sheet P and a carriage 107 provided opposite the upper portion of the platen 105. The carriage 107 is guided to a carriage guide shaft (not shown) extending in a main scanning direction which is the transverse direction X of the transported paper sheet P and is driven by a carriage motor 102. In addition, a printing head 106 for ejecting ink on the paper sheet P is disposed on the bottom surface of the carriage 107. The paper sheet P printed by the printing unit 143 is again transported toward to the downstream side to be discharged through the front surface of the printing apparatus 100 by a discharging roller (not shown).

In the lower portion of the printing apparatus 100, an ink cartridge (not shown) is mounted to supply ink to an ink supply passage (not shown) through an ink supply needle (not shown). The ink is supplied to the printing head 106 of the carriage 107 through an ink supply tube 110. In a flushing process or a cleaning process of the printing head 106, an ink sucking unit 200 as an ejection property maintaining mechanism is provided on a 1-digit side. In addition, the ink sucking unit 200 as an ejection property maintaining mechanism for maintaining an ejection property of the printing unit 143 performs an ejection sucking process. The ink suction unit 200 which includes a cap 204 is configured so as to seal the printing head 106 by moving the cap 204 in a vertical direction.

Figure 3:
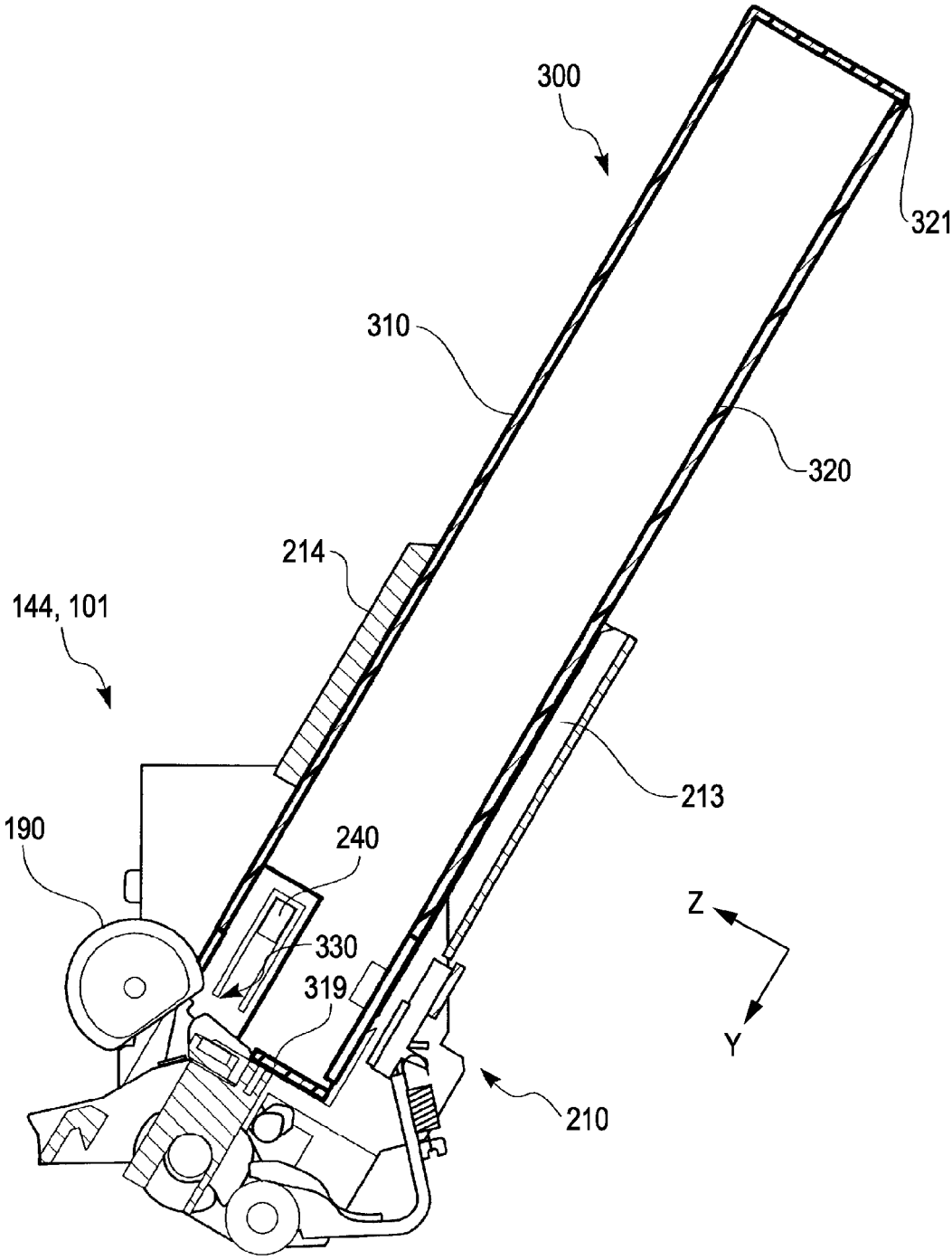
FIG. 3 is a side sectional view illustrating a feeding unit in a hopper down state.
Figure 4:
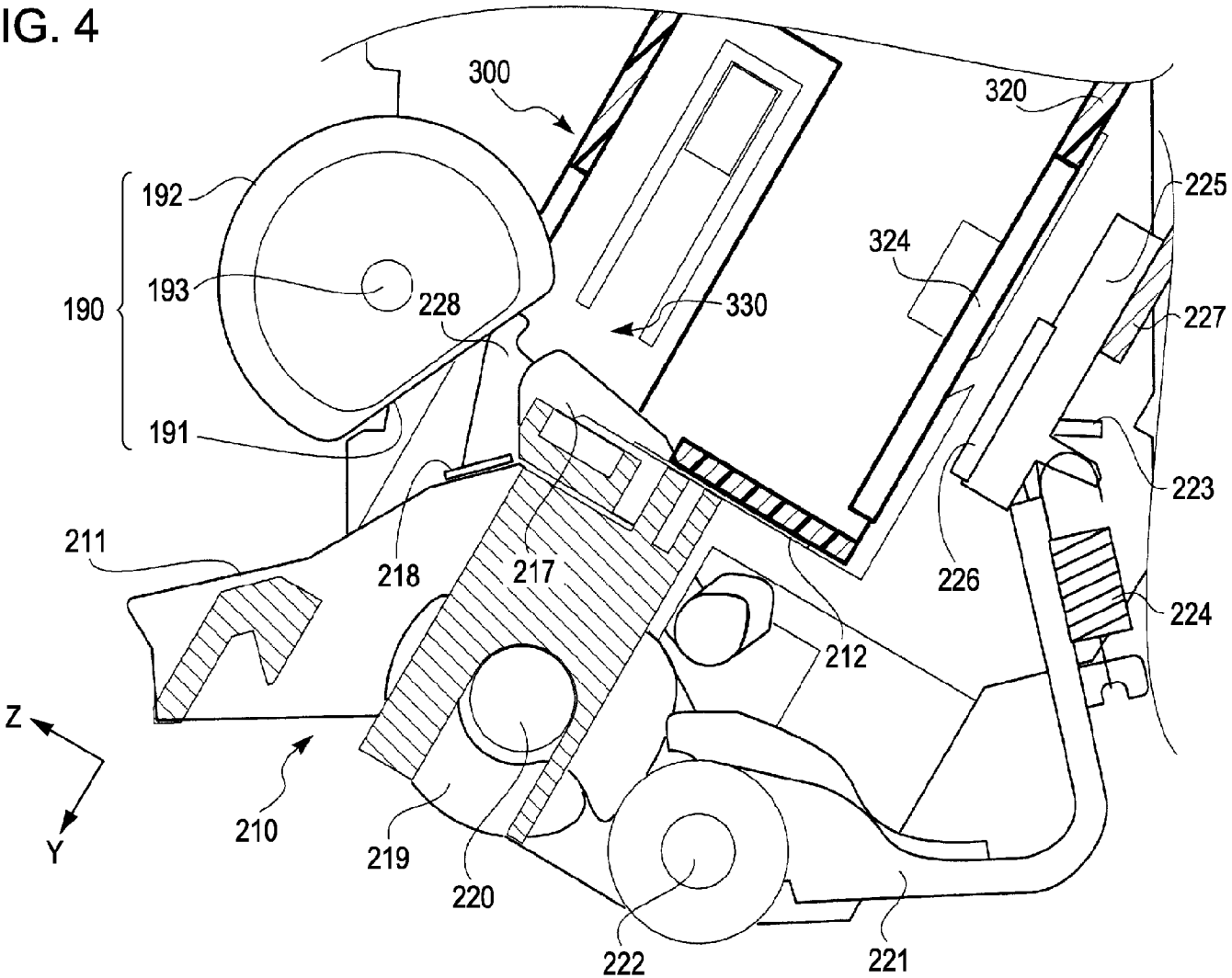
FIG. 4 is an expanded side sectional view illustrating major elements of the feeding unit in the hopper down state.

FIG. 3 is a side sectional view illustrating the feeding unit in a hopper down state, which is described below. FIG. 4 is an expanded side sectional view illustrating major elements shown in FIG. 3.

As shown in FIGS. 3 and 4, the cassette unit 300 includes a cassette case 310, the cassette hopper 320, and a front end controlling portion 319. The cassette case 310 covers the paper sheet P. The cassette hopper 320 is joined with the cassette case 310 in the first joint portion 321. The cassette hopper 320 is configured so as to be pivoted using the first joint portion 321 a pivot point. The front end controlling portion 319 controls the position of the front end of the paper sheet P received in the cassette unit 300 when the cassette unit 300 is mounted in the printing apparatus body 101.

The position and posture of the cassette unit 300 are configured so as to be controlled by a contact portion 212, a cassette guide portion 213, and a cassette control portion 214 of a base body 210 when the cassette unit 300 is mounted in the printing apparatus body 101.

Specifically, the contact portion 212 is provided to control the position of the cassette unit 300 in a feeding direction Y.

The cassette guide portion 213 is provided to control the position of the cassette unit 300 in the transverse direction X and the position of the cassette unit 300 detached from the feeding roller 190 in a detaching direction. The cassette control portion 214 is provided to control the position of the cassette unit 300 in a direction in which the cassette unit 300 approaches the feeding roller 190. The cassette guide portion 213 and the cassette control portion 214 cooperate with each other to control the posture of the cassette unit 300.

The feeding roller 190 includes an arc portion 192, a chord portion 191, and a spindle 193. The power of the feeding motor 104 is delivered to the spindle 193 by a gear wheel 215 (see FIG. 17) and a known clutch mechanism 216 (see FIG. 17). In addition, the feeding roller 190 is disposed so as to be rotatably moved in a clockwise direction in FIGS. 3 and 4 using the spindle 193 a pivot point.

A hopper cam portion 219 is configured so as to be rotatably moved using a cam shaft 220 as a pivot point counterclockwise by the power of the feeding motor 104. A pair of return levers 228 and a lifter portion 221 are configured so as to be rotatably moved with the rotation of the hopper cam portion 219. Specifically, the lifter portion 221 is configured so as to be rotatably moved using the lifter shaft 222 as a pivot point. In addition, the lifter portion 221 is urged in a direction in which the hopper 225 engaging with the front end of the lifter portion 221 by a hopper spring (not shown) approaches the feeding roller 190.

The lifter portion 221 is rotatably moved by the hopper cam portion 219 so that the hopper 225 gets away from the feeding roller 190, which is called a hopper down state. A posture control portion 223 is disposed in the front end of the lifter portion 221. The hopper 225 is urged toward the posture control portion 223 by a lifter spring 224. In the hopper down state, the hopper 225 comes in contact with the hopper control portion 227 disposed in the base body 210 and is slightly separated from the posture control portion 223.

Accordingly, the position and the posture of the hopper 225 in the hopper down state can be determined with precise. As a result, the cassette unit 300 does not come in contact with a cork member 226, which is an example of a known large friction member, disposed in the hopper 225 when the cassette unit 300 is mounted in or detached from the printing apparatus body 101. That is, when the cassette unit 300 is mounted or detached, the cassette 300 does not reach to the hopper 225 and the cork member 226.

An auxiliary separation portion 217 and a separation pad 218 as a main separation portion are disposed in the base body 210. The auxiliary separation portion 217 can come in contact with or separate from the feeding roller 190. In addition, the auxiliary separation portion 217 is urged toward the feeding roller by an urging member (not shown).

A control member (not shown) controls the auxiliary separation portion 217 so as not to move toward the feeding roller 190 from the position at which the auxiliary separation portion 217 is disposed in FIGS. 3 and 4.

The paper sheet P is fed, and then the paper sheet P passing through the auxiliary separation portion 217 is entered to collide with the separation pad 218. In this case, if a plurality of the paper sheets P pass through the auxiliary separation portion 217, the paper sheets P collide with the separation pad 218. At this time, only the uppermost paper sheet P is sent toward the downstream side of the feeding direction. This method is called a bank separation. Subsequently, the uppermost paper sheet P is guided to a sheet guide surface 211 provided in the base body 210 and is sent to the printing unit 143. On the other hand, the remaining paper sheets P which is not set by the separation pad 218 is returned to the cassette unit 300 by the pair of the return levers 228.

The feeding roller 190 is positioned at a reset position when the chord portion 191 is opposite to the auxiliary separation portion 217, the separation pad 218, and the sheet guide surface 211.

Figure 5:
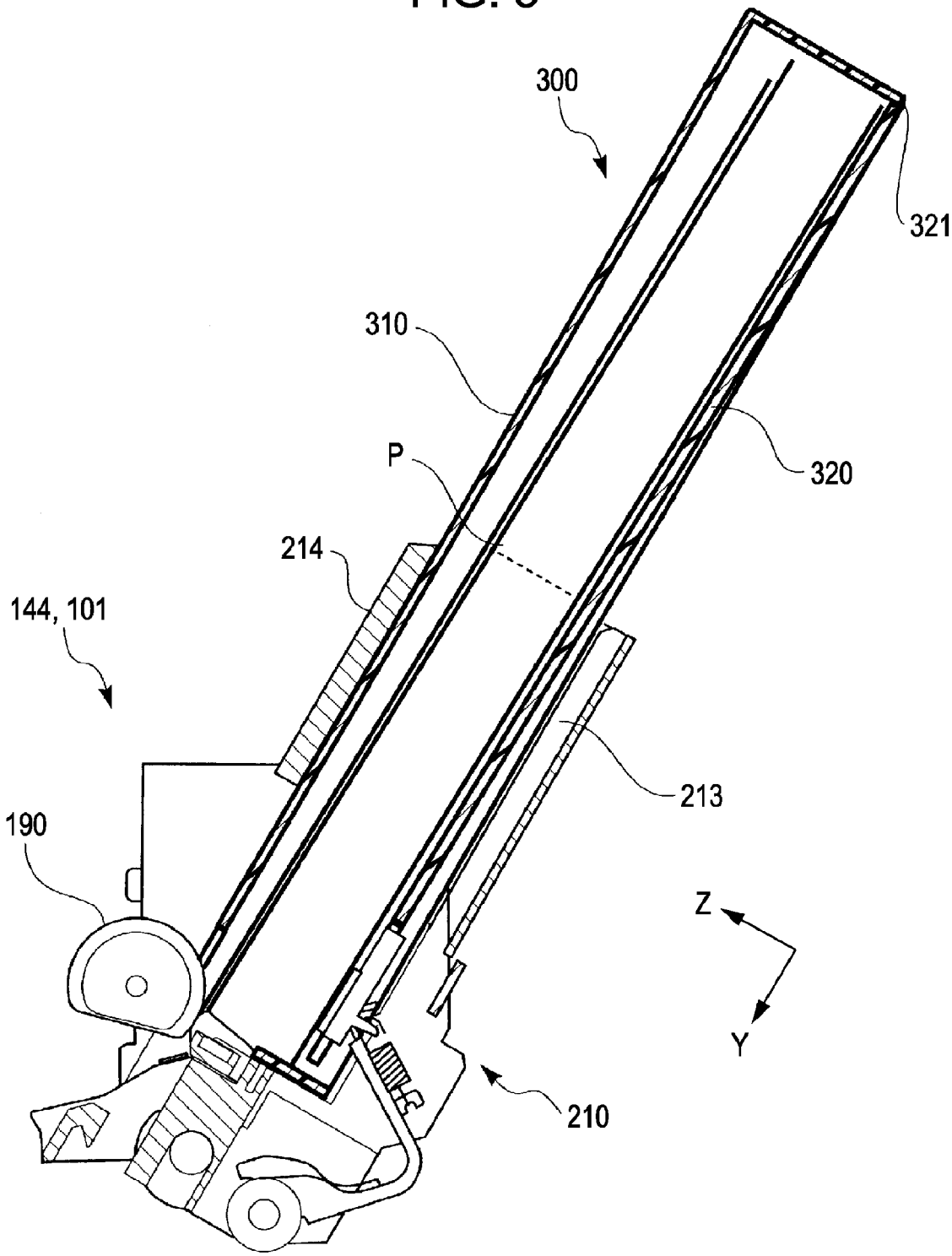
FIG. 5 is a side sectional view illustrating the feeding unit in a hopper up state (maximum sheets).
Figure 6:
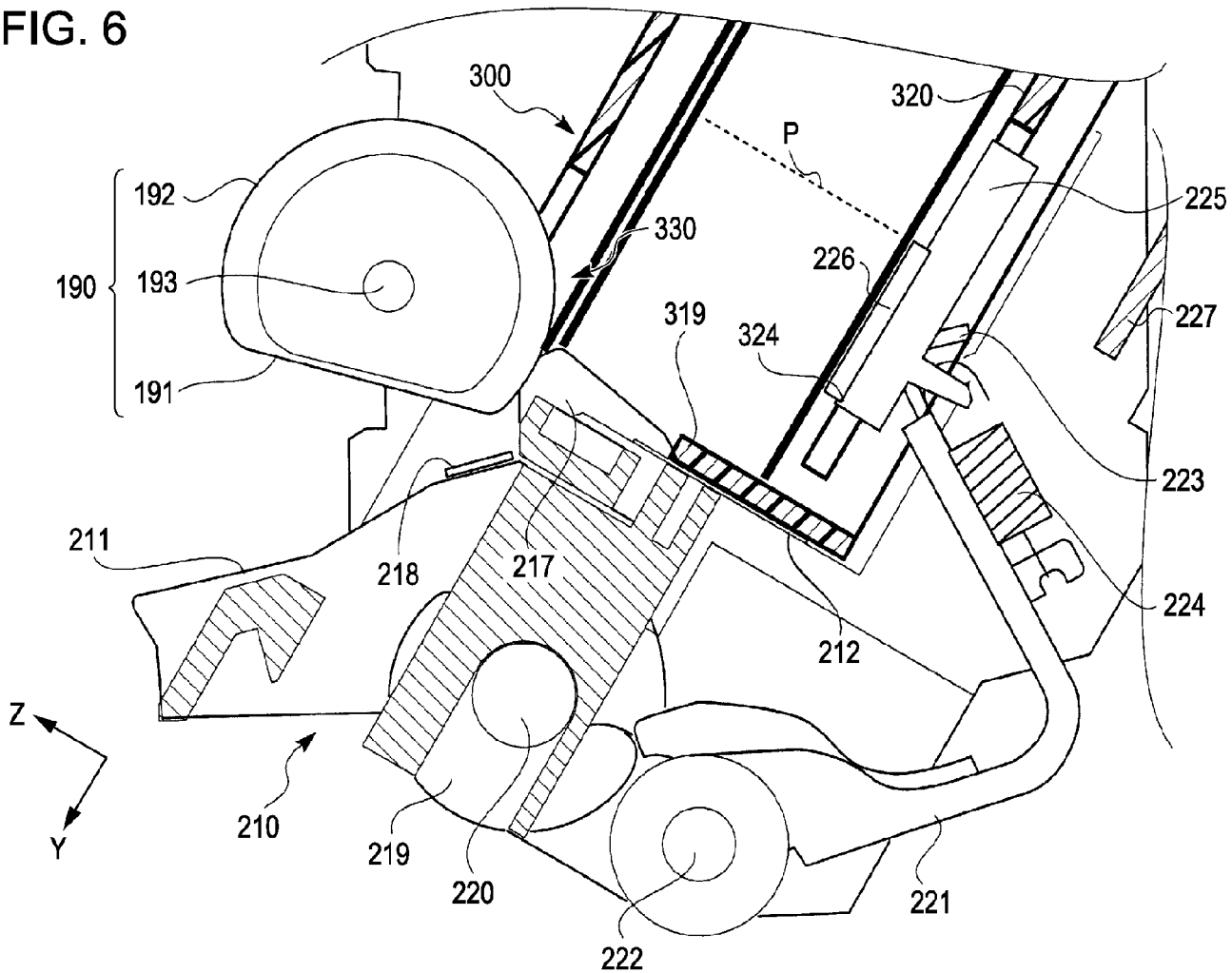
FIG. 6 is an expanded side sectional view illustrating the major elements of the feeding unit in the hopper up state (maximum sheets).

FIG. 5 is a side section view illustrating the feeding unit in a hopper up state when the cassette unit 300 receives the maximum number of paper sheets. FIG. 6 is an expanded side sectional view illustrating major elements of FIG. 5.

In FIGS. 5 and 6, the hopper cam portion 219 is rotatably moved counterclockwise when the feeding roller 190 shown in FIGS. 3 and 4 is rotatably moved clockwise. At this time, the engagement of the lifter portion 221 with the hopper cam portion 219 becomes released, and the lifter portion 221 is rotatably moved counterclockwise by the urging force of a hopper spring (not shown).

Accordingly, the hopper 225 is moved in a direction in which the hopper 225 approaches the feeding roller 190. This state is called a hopper up state. In addition, the hopper 225 engages with a notch portion 324 of the cassette hopper 320 of the cassette unit 300 to move the cassette hopper 320 and the paper sheet P in the direction in which the hopper 225 approaches the feeding roller 190. Accordingly, the uppermost paper sheet P comes in contact with the feeding roller 190. At this time, friction between the feeding roller 190 and the uppermost paper sheet P causes the rotation force of the feeding roller 190 to be delivered to the uppermost paper sheet P. That is, a feeding force induced by the friction of the feeding roller 190 and the uppermost paper sheet P is generated in the uppermost paper sheet P.

When the paper sheet P approaches the feeding roller in the hopper up state, the paper sheet P can pass through a feeding opening 330 disposed in the feeding roller of the front end controlling portion 319 of the cassette unit 300.

The paper sheet P is sent to the outside of the cassette unit 300 through the feeding opening 330 by the feeding roller 190 to be fed to the printing unit 143 through the auxiliary separation portion 217 and the separation pad 218, as described above. When the feeding roller 190 is returned to the reset position, the hopper down state is restored.

In this way, the paper sheet P is sequentially fed.

Figure 7:
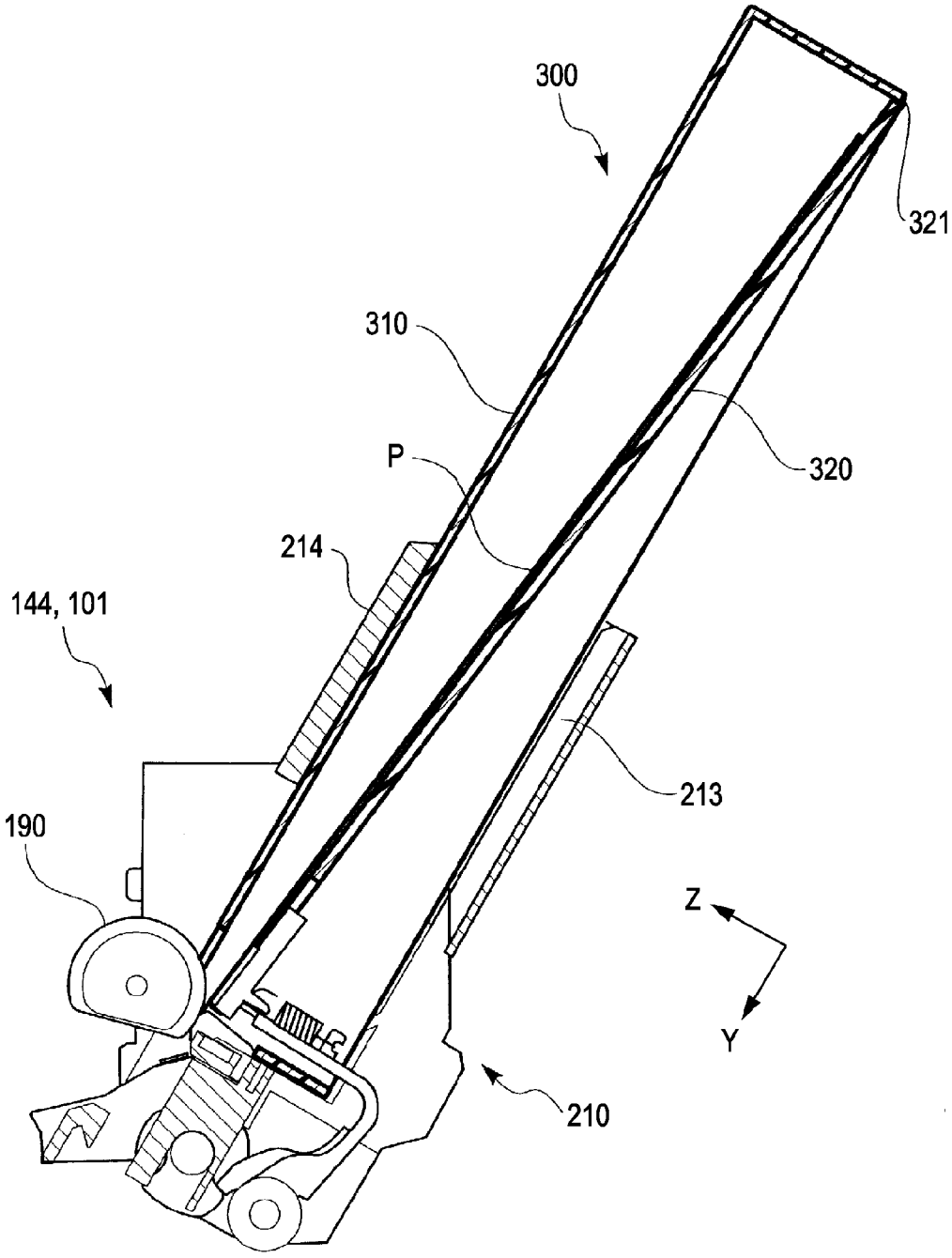
FIG. 7 is a side sectional view illustrating the feeding unit in the hopper up state (minimum sheets).
Figure 8:
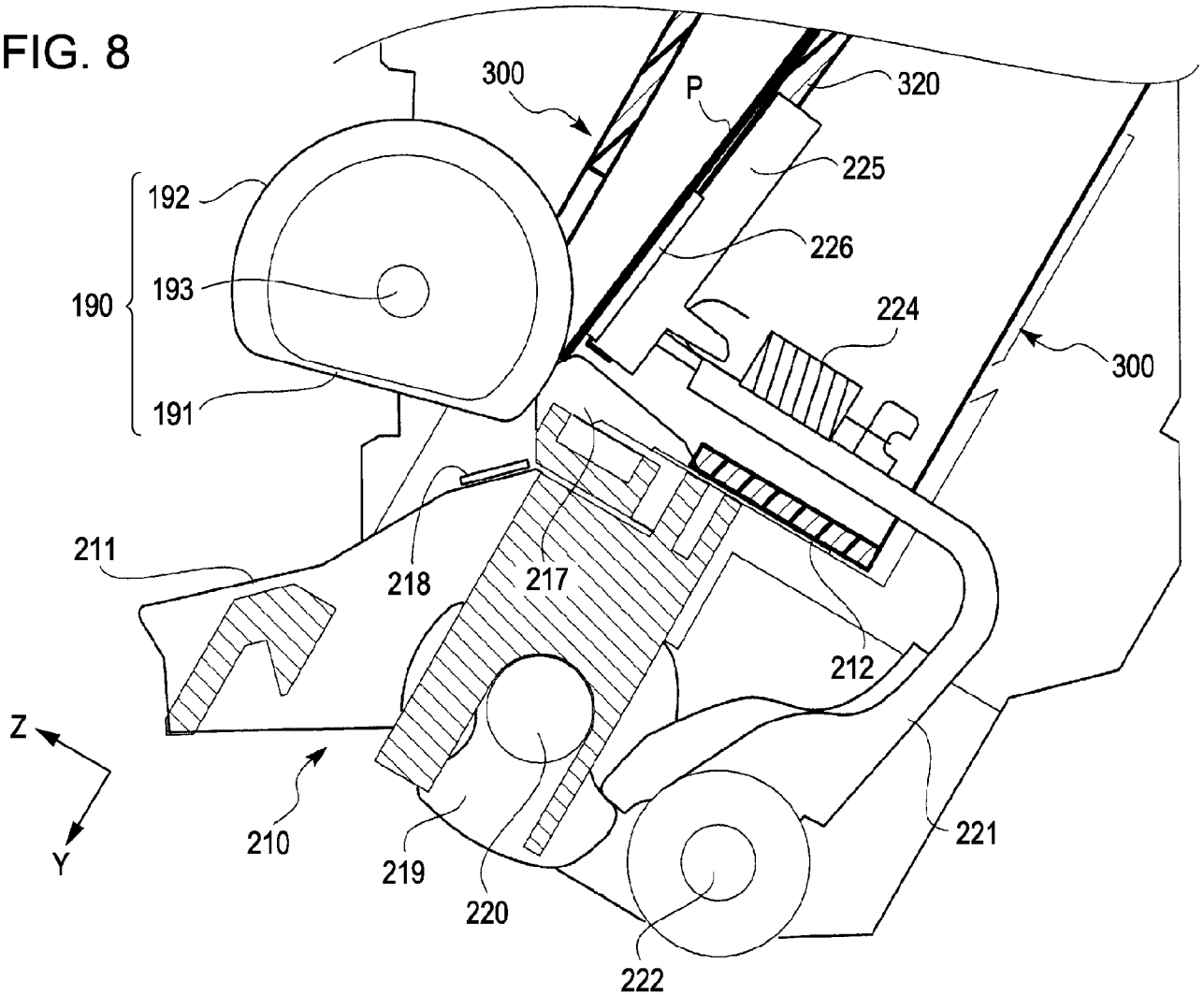
FIG. 8 is an expanded side sectional view illustrating the major elements of the feeding unit in the hopper up state (minimum sheets).

FIG. 7 is a side section view illustrating the feeding unit in the hopper up state when the cassette unit 300 receives the minimum number of paper sheets. FIG. 8 is an expanded side sectional view illustrating major elements of FIG. 7.

In FIGS. 7 and 8, when the paper sheets P shown in FIGS. 5 and 6 are repeatedly fed, the number of paper sheets P gradually decreases. Finally, the last paper sheet P remains. At this time, since the cork member 226 disposed in the hopper 225 is in the contact with the back of the paper sheet P, it is possible to decrease a possibility that the paper sheet P slides toward the downstream side of the feeding direction.

When the last remaining paper sheet P is fed, the feeding roller 190 is returned to the reset position. Accordingly, the hopper 225 becomes the hopper down state.

At this time, since the cassette unit 300 have not any paper sheet P, the cassette unit 300 may be exchanged or it is necessary to receive the paper sheet P in the cassette unit 300.

Hereinafter, a structure of the cassette unit 300 and a method of assembling the cassette unit 300 will be described. In addition, methods of mounting and detaching the cassette unit 300 will be described.

Structure of Cassette Unit and Assembling Method

Figure 9:
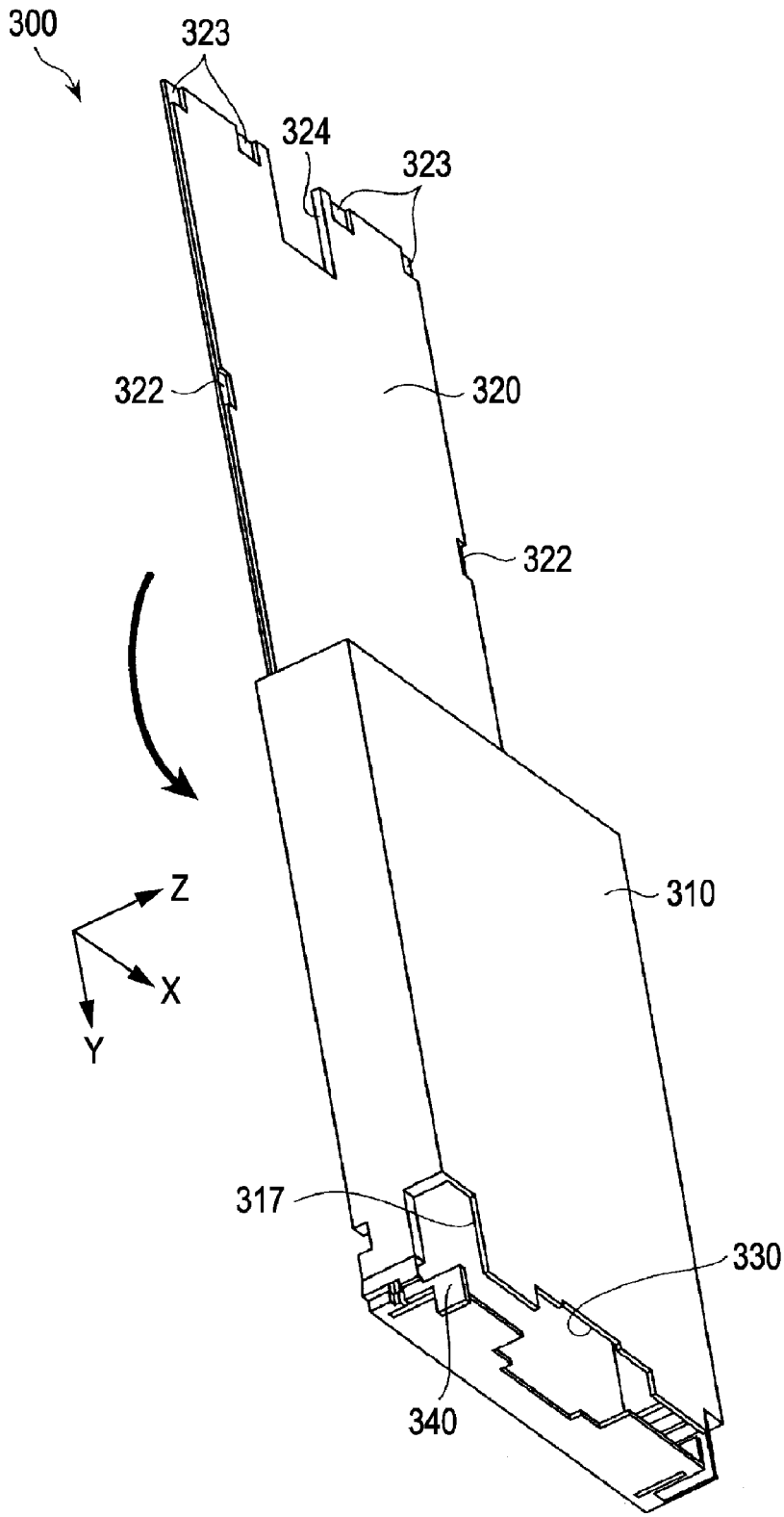
FIG. 9 is a front perspective view illustrating a cassette unit according to the invention (before assembly).
Figure 10:
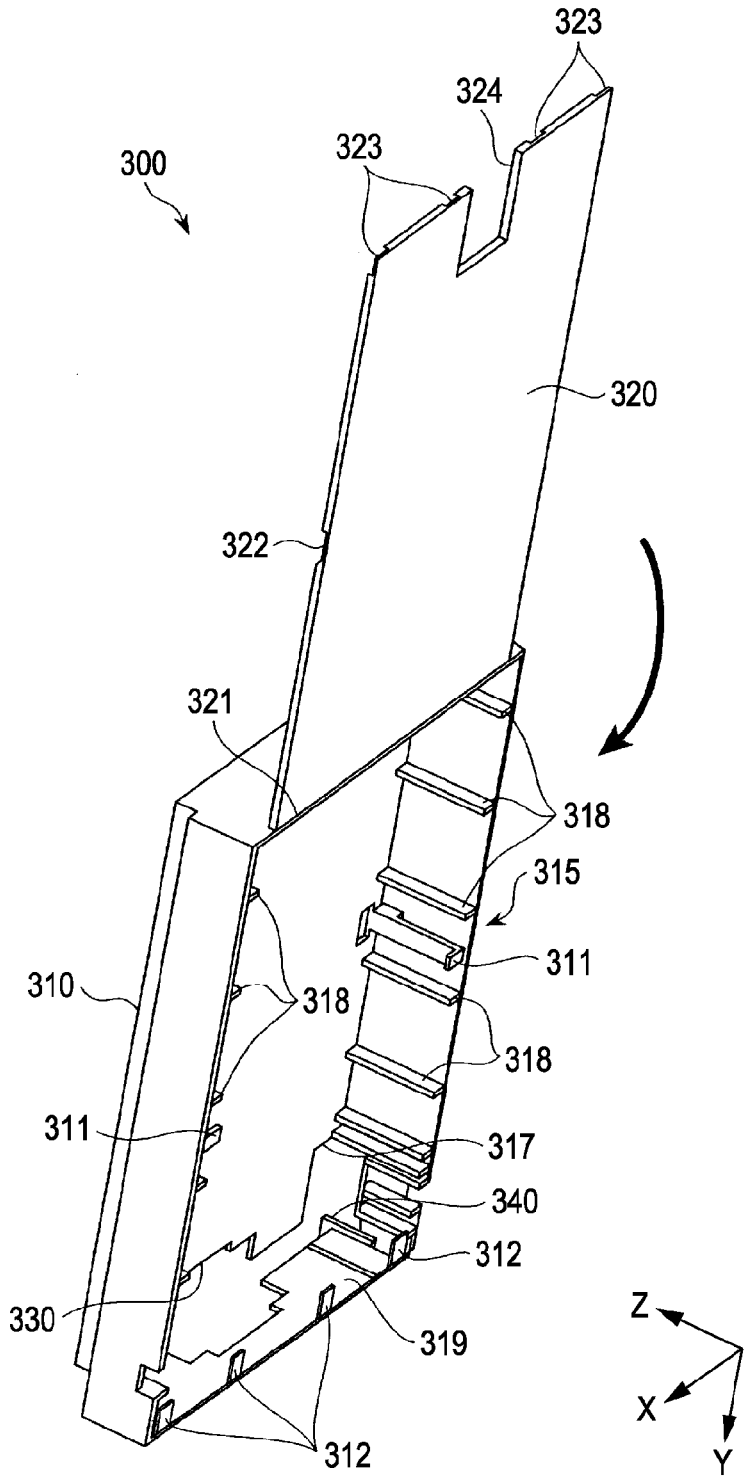
FIG. 10 is a rear perspective view illustrating the cassette unit according to invention (before the assembly).

FIG. 9 is a front perspective view illustrating the cassette unit before assembled according to the invention. FIG. 10 is a rear perspective view illustrating the cassette unit shown in FIG. 9.

Figure 11:
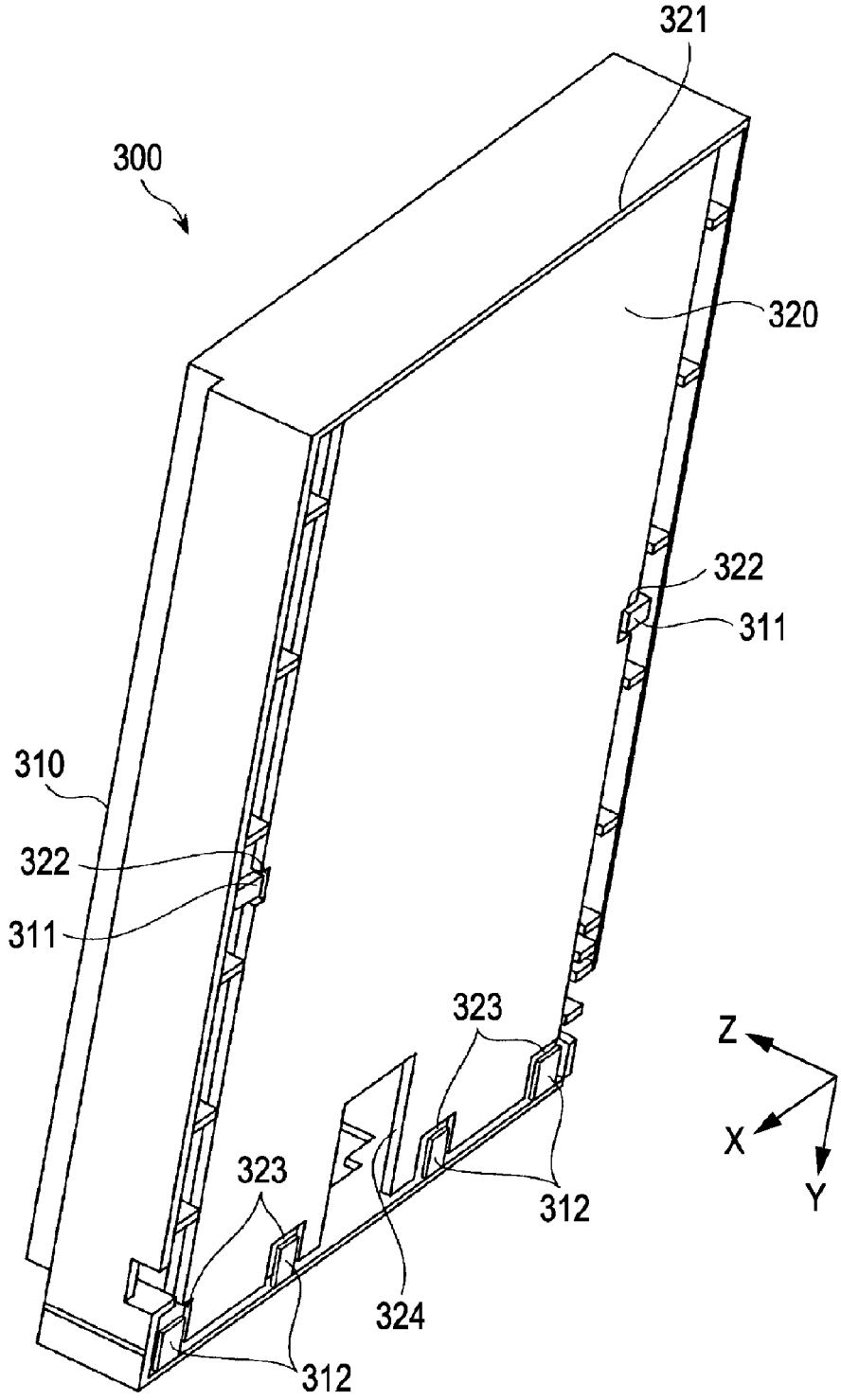
FIG. 11 is a rear perspective view illustrating the cassette unit according to invention (after the assembly).
Figure 12A:
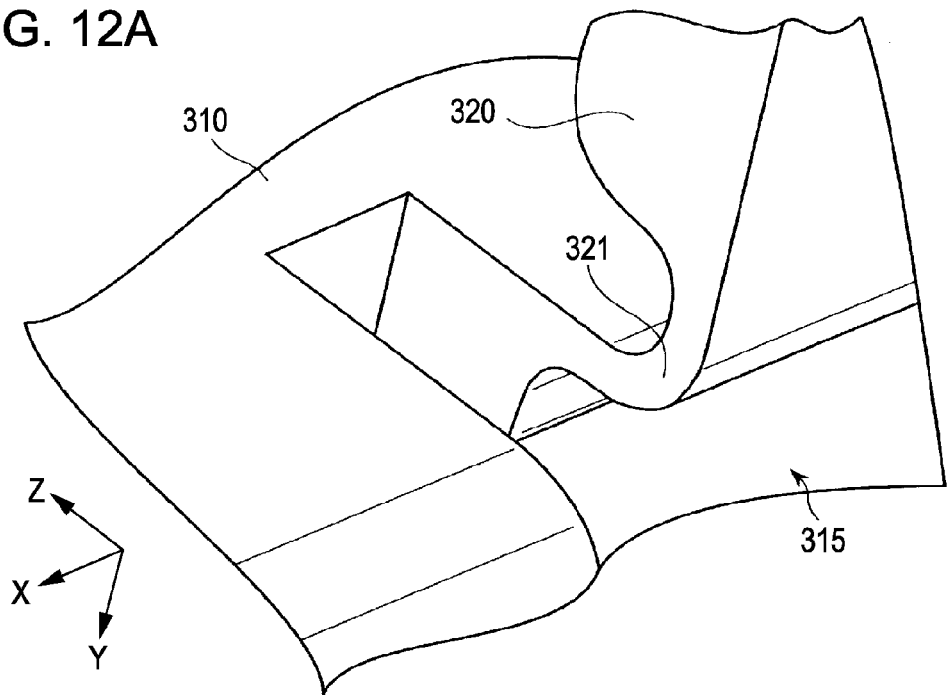
FIGS. 12A and 12B are expanded perspective views illustrating major elements of the cassette unit.
Figure 12B:
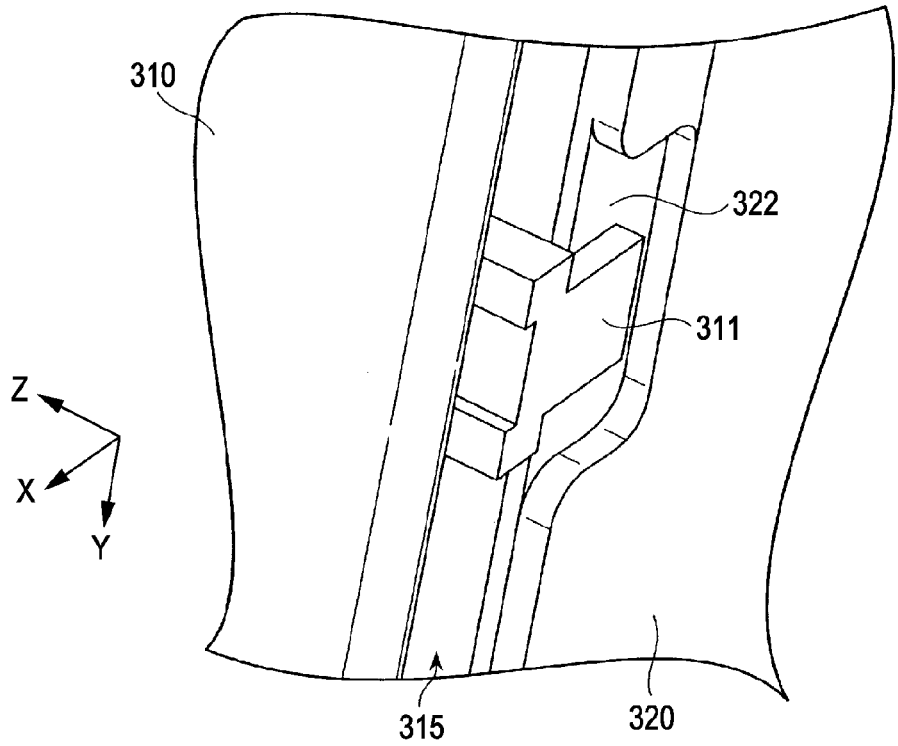

FIG. 11 is a front perspective view illustrating the cassette unit after assembled. FIG. 12A is an expanded perspective view illustrating major elements of the cassette unit shown in FIG. 10. FIG. 12B is an expanded perspective view illustrating major elements of the cassette unit shown in FIG. 11.

As shown in FIGS. 9 and 10, the cassette unit 300 includes the cassette case 310, the cassette hopper 320, and a shutter 340. The cassette case 310, the cassette hopper 320, and the shutter 340 which are made of a flexible material such as polypropylene (PP) are incorporated to each other. The cassette case 310, the cassette hopper 320, and the shutter 340 formed by a molding process are shown FIGS. 9 and 10.

The cassette hopper 320 includes a notch portion 324, a pair of first shallow portions 322, and a plurality of second shallow portions 323. The cassette case 310 includes a pair of first case claws 311, a plurality of second case claws 312, a third case claw 313 (see FIGS. 13, 15, and 16), and a fourth case claw 314 (see FIGS. 13, 15, and 16). In addition, the cassette case 310 includes a hopper opening 315, a shutter operating opening 317, a plurality of edge guides 318, and the front end controlling portion 319.

The pair of the first case claws 311 extends from the front to the rear of the cassette case 310.

The cassette hopper 320 is joined with the cassette case 310 in the first joint portion 321 (see FIG. 12A). In this case, the first joint portion 321 extends in the transverse direction X.

The shutter 340 is joined with the cassette case 310 by a second joint portion 341. In this case, the shutter 340 is a member for controlling the paper sheet P to pass through the feeding opening 330 and to release the control of the paper sheet P.

In the assembling, first, the paper sheet P is received in the cassette case through the hopper opening 315 formed in the rear of the cassette unit 300.

Next, the cassette hopper 320 is bent in the first joint portion 321 so as to be rotatably moved in an arrow direction.

In FIGS. 11 and 12B, the pair of the first shallow portions 322 engage with the pair of the first case claws 311 while the pair of the first case claws 311 get curved outward in the transverse direction thereof. At this time, the plurality of the second shallow portions 323 engage with the plurality of the second case claws 312.

The plurality of the second case claws 312 slightly become curved. However, it is possible to easily perform the engaging by more curving the cassette hopper 320. That is, the first shallow portions 322 and the second shallow portions 323 can engage with the first case claws 311 and the second case claws 312 at a time by pushing the center of the cassette hopper 320 into the cassette case 310 in a Y axis direction.

Figure 13:
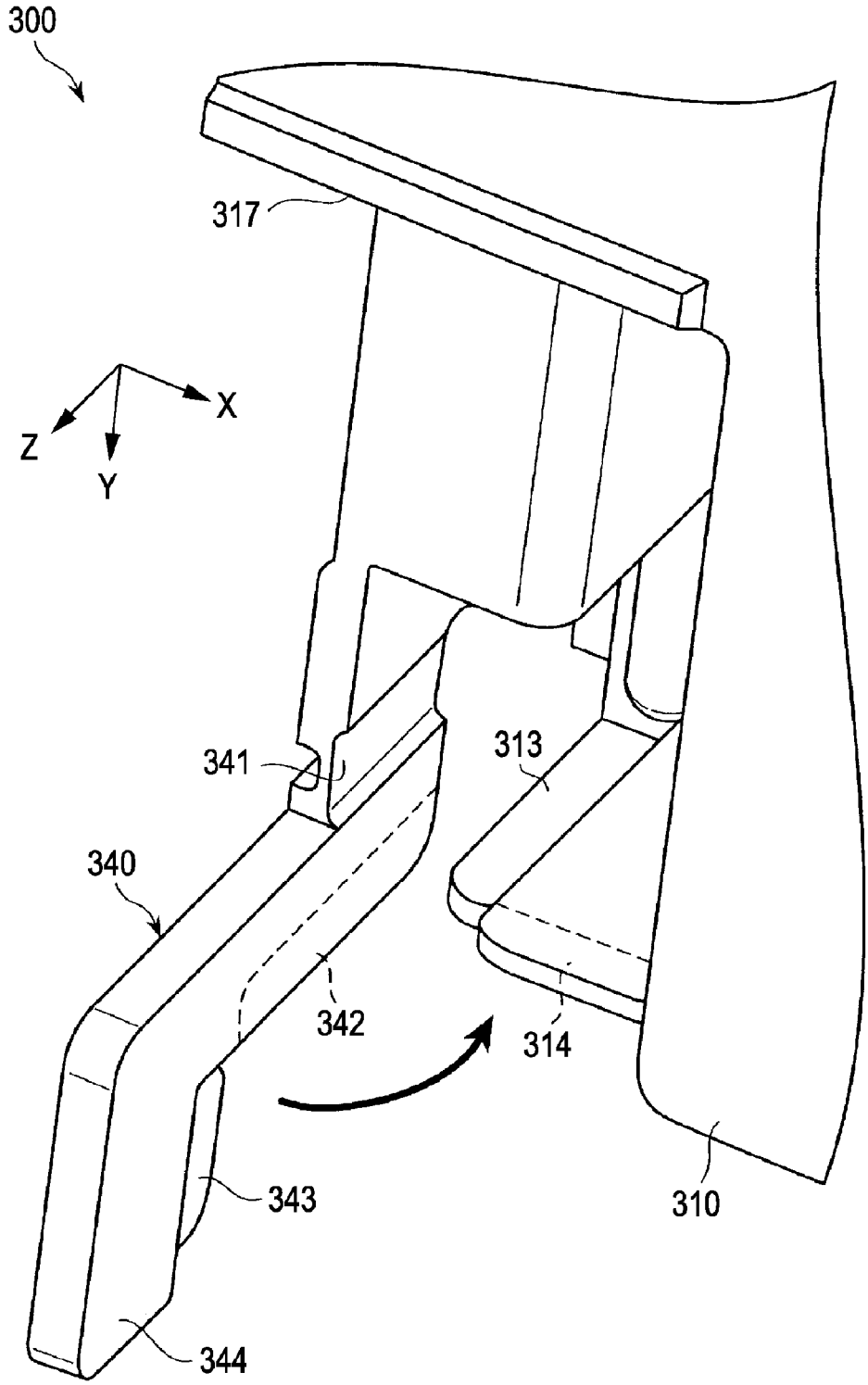
FIG. 13 is an expanded perspective view illustrating the shutter when viewed from the upside according to the invention (before the assembly).
Figure 14:
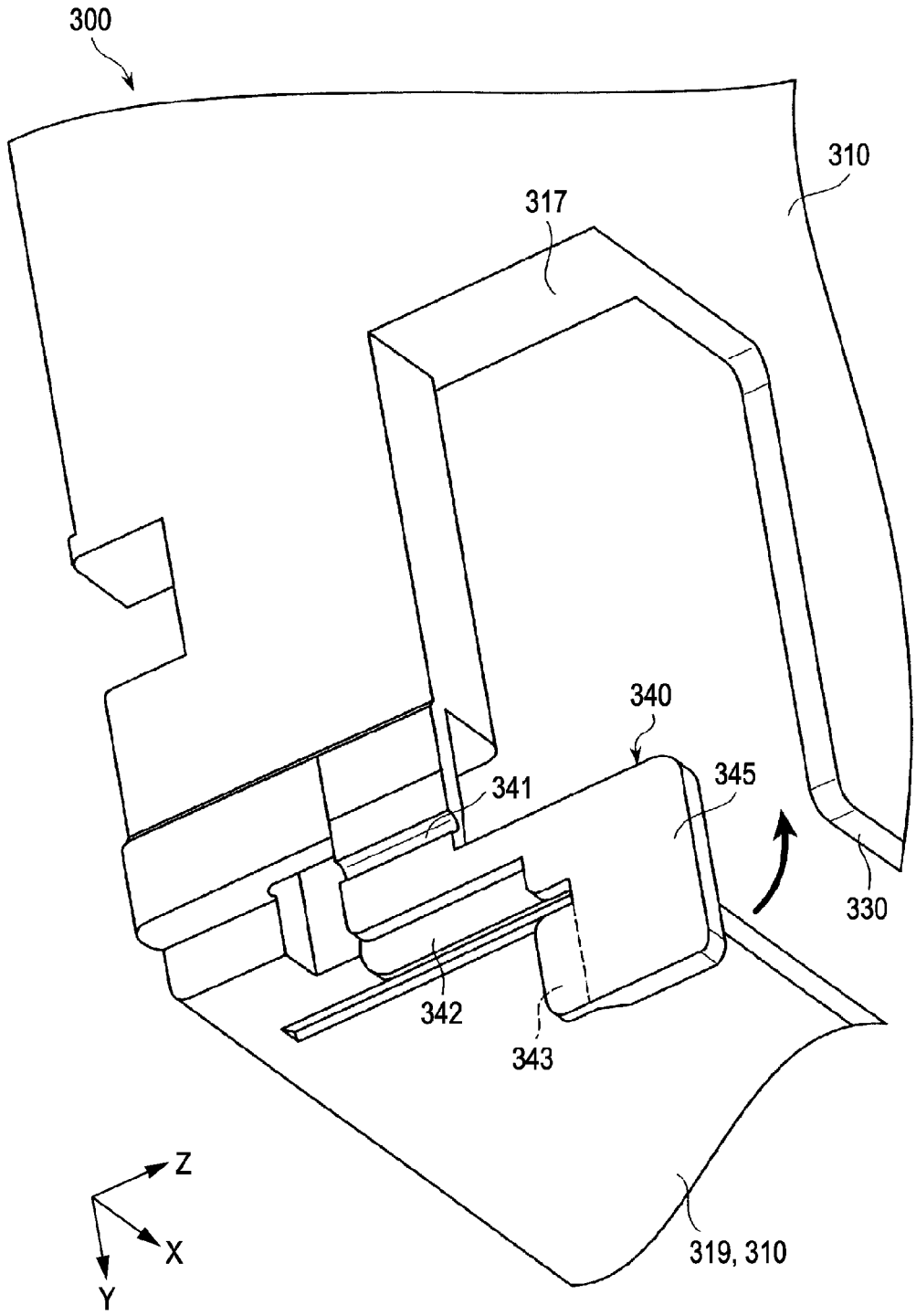
FIG. 14 is an expanded perspective view illustrating the shutter when viewed from the downside according to the invention (before the assembly).

FIG. 13 is an expanded perspective view illustrating the shutter when viewed from the upside before assembly according to the invention. FIG. 14 is an expanded perspective view illustrating the shutter viewed from the downside in FIG. 13.

Figure 15:
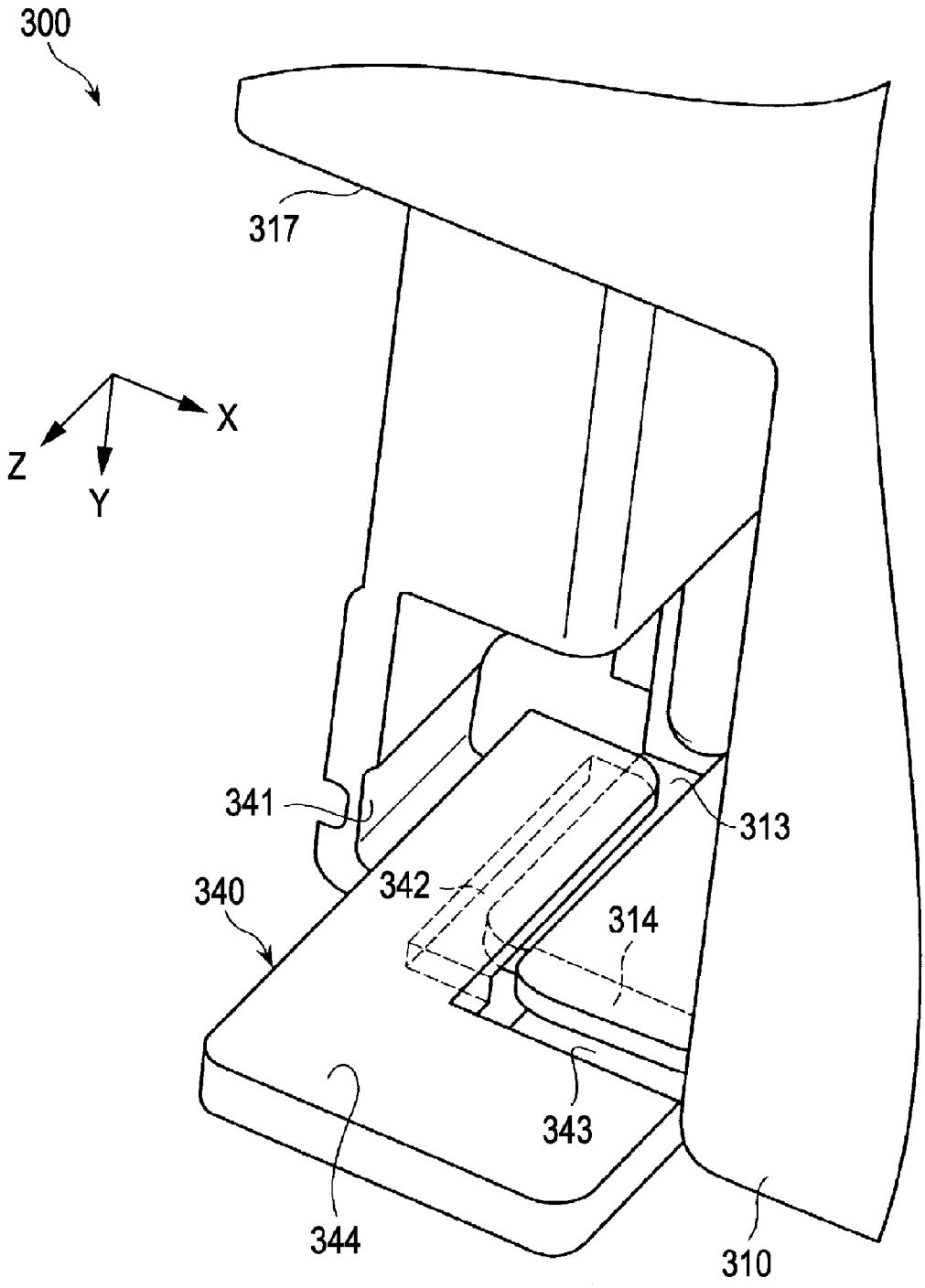
FIG. 15 is an expanded perspective view illustrating the shutter when viewed from the upside according to the invention (after the assembly).
Figure 16:
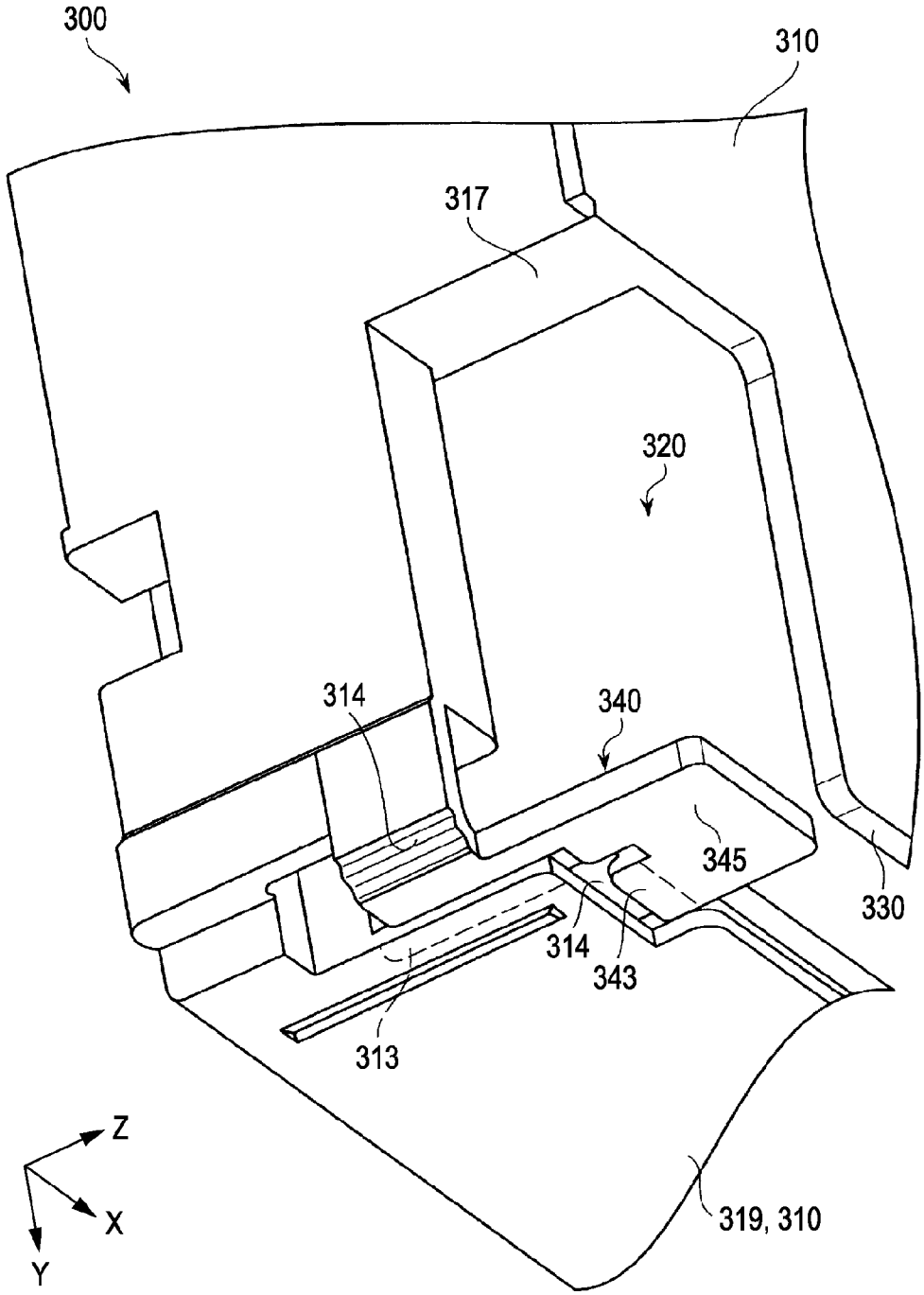
FIG. 16 is an expanded perspective view illustrating the shutter when viewed from the downside according to the invention (after the assembly).

FIG. 15 is an expanded perspective view illustrating the shutter after the assembly when viewed from the upside according to the invention. FIG. 16 is an expanded perspective view illustrating the shutter when viewed from the downside in FIG. 15.

As shown in FIGS. 13 and 14, the shutter 340 is formed in an L shape. In the shutter 340, a third shallow portion 342 is formed close to the second joint portion 341 and a fourth shallow portion 343 is formed away from the second joint portion 341.

On the other hand, in the cassette case 310, the third case claw 313 is formed close to the second joint portion 341 and the fourth case claw 314 is formed away from the second joint case 341.

The second joint portion 341 extends in a Z axis direction which is a thickness (stack) direction of the paper sheet P.

After the cassette hopper 320 is bent and engaged in the above-described manner, the shutter 340 is bent in the second joint portion 341 to be rotatably moved in an arrow direction.

As shown in FIGS. 15 and 16, the shutter 340 goes beyond the third case claw 313 by curving the third shallow portion 342, so that the third shallow portion 342 engages with the third case claw 313.

In this case, the fourth shallow portion 343 is configured so as not to go beyond the fourth case claw 314.

If the fourth shallow portion 343 goes beyond the fourth case claw 314, the shutter 340 may be slightly twisted in a direction reverse to the arrow direction shown in FIG. 14. In this way, it is possible to easily configure the state before the fourth shallow portion 343 goes beyond the fourth case claw 314 when the third shallow portion 342 engages with the third case claw portion 313.

By receiving the paper sheet P, it is possible to assemble the cassette unit 300 by performing three steps. At this time, a tool is not necessary, and it is possible to easily perform the assembly only with the bending and engaging processes. That is, assembly work is easy. Since all the members of the cassette unit are integrally formed with each other, an advantage can be obtained in terms of cost.

Since the first joint portion 321 is bent to be assembled, a restoration force is generated in the first joint portion 321. Accordingly, the cassette hopper 320 is urged in a hopper down direction in which the cassette hopper 320 gets away from the feeding roller 190. That is, when any external force is not exerted, the cassette hopper 320 becomes the hopper down state in which the cassette hopper 320 is controlled by the first case claws 311 and the second case claws 312.

Since the second joint portion 341 is bent to be assembled, a restoration force is generated in the second joint portion 341. Accordingly, the shutter 340 is urged in a direction in which the cassette case 310 is opened outward. That is, when any external force is not exerted, the shutter 340 becomes a shutter closing state in which the shutter 340 is controlled by the third case claw 313 and the fourth case claw 314.

In this case, the shutter closing state refers to a state in which the paper sheet P is prevented from passing through the feeding opening 330.

On the other hand, a shutter opening state refers to a state in which the shutter 340 is rotatably moved toward the inside of the cassette case 310 and the paper sheet P is not prevented from passing through the feeding opening 330.

As described in detail below, the third case claw 313 prevents the shutter 340 in the shutter closing state from being rotatably moved outward. In addition, the fourth case claw 314 engages with the shutter 340 so as to allow the shutter 340 in the shutter closing state to be rotatably moved inward. That is, the fourth case claw 314 stabilizes the shutter 340 in the shutter closing state.

The shutter operating opening 317 is formed so that the cassette case 310 does not hinder the operation of a shutter opening protrusion 230 and a shutter closing hook 240 described below for the shutter 340.

Mounting of Cassette Unit

Figure 17:
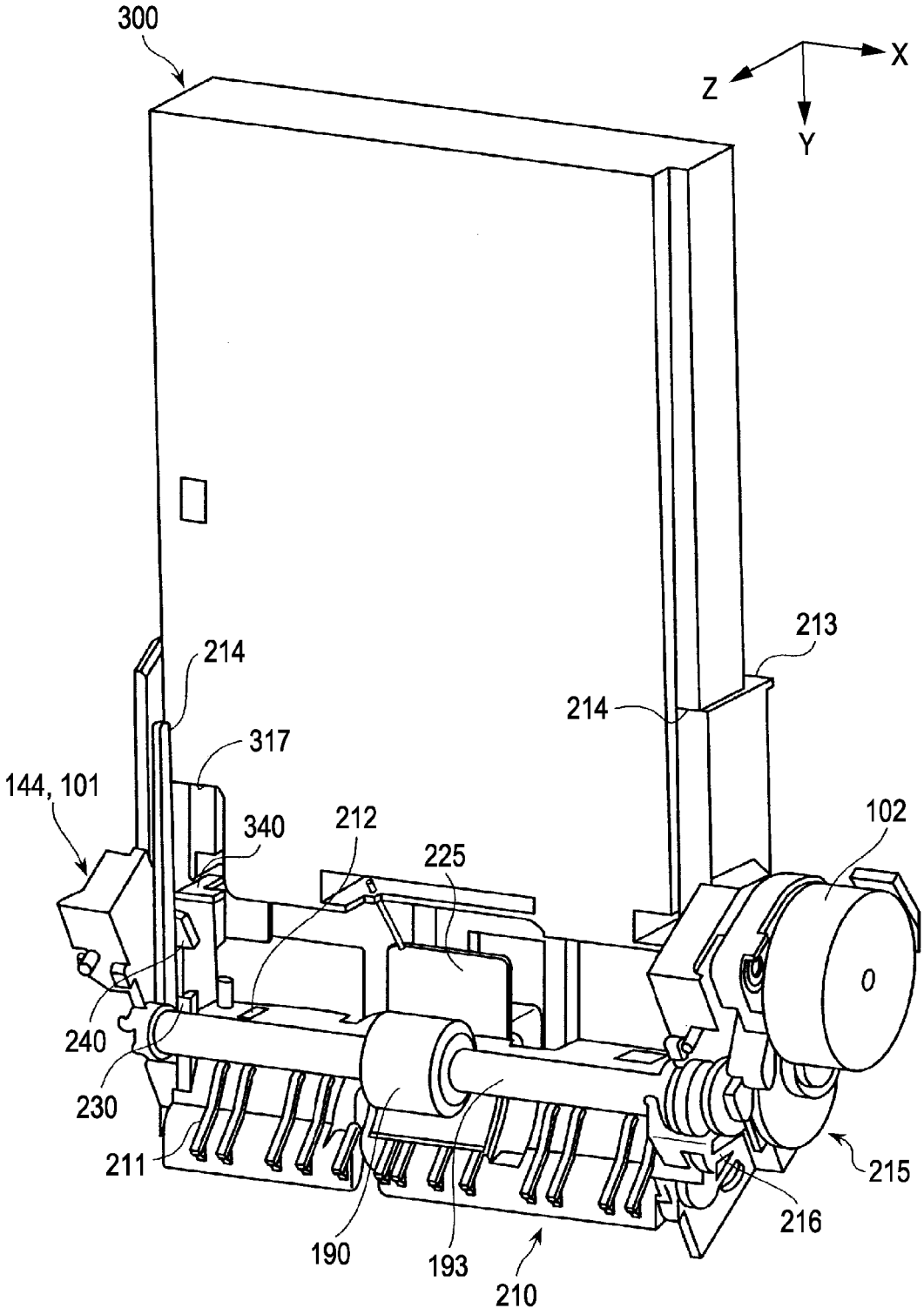
FIG. 17 is a perspective view illustrating the cassette unit which is mounted in a printing apparatus body.
Figure 18:
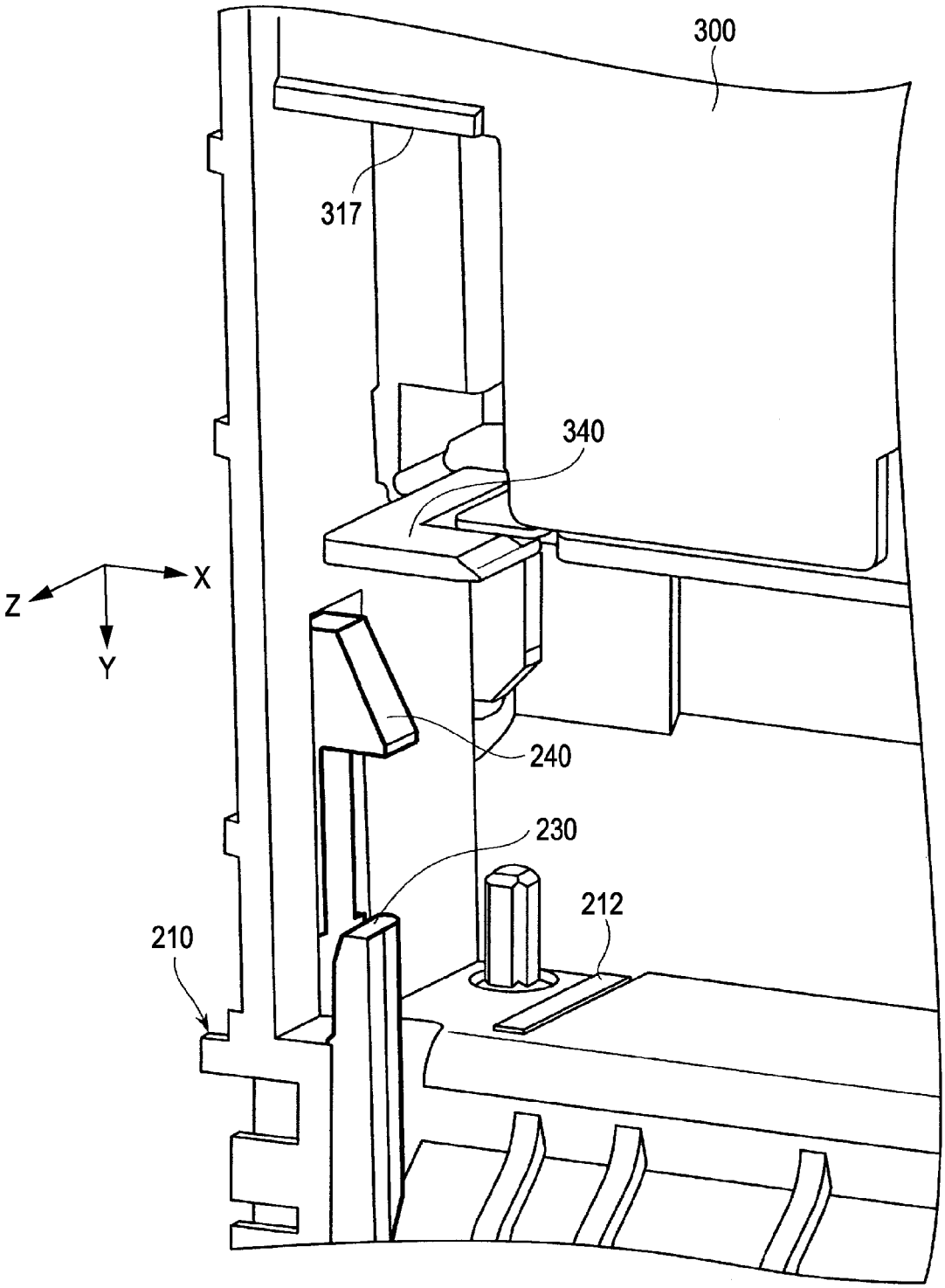
FIG. 18 is an expanded perspective view illustrating a shutter opening protrusion, a shutter closing hook, and the like when viewed from the upside.
Figure 19:
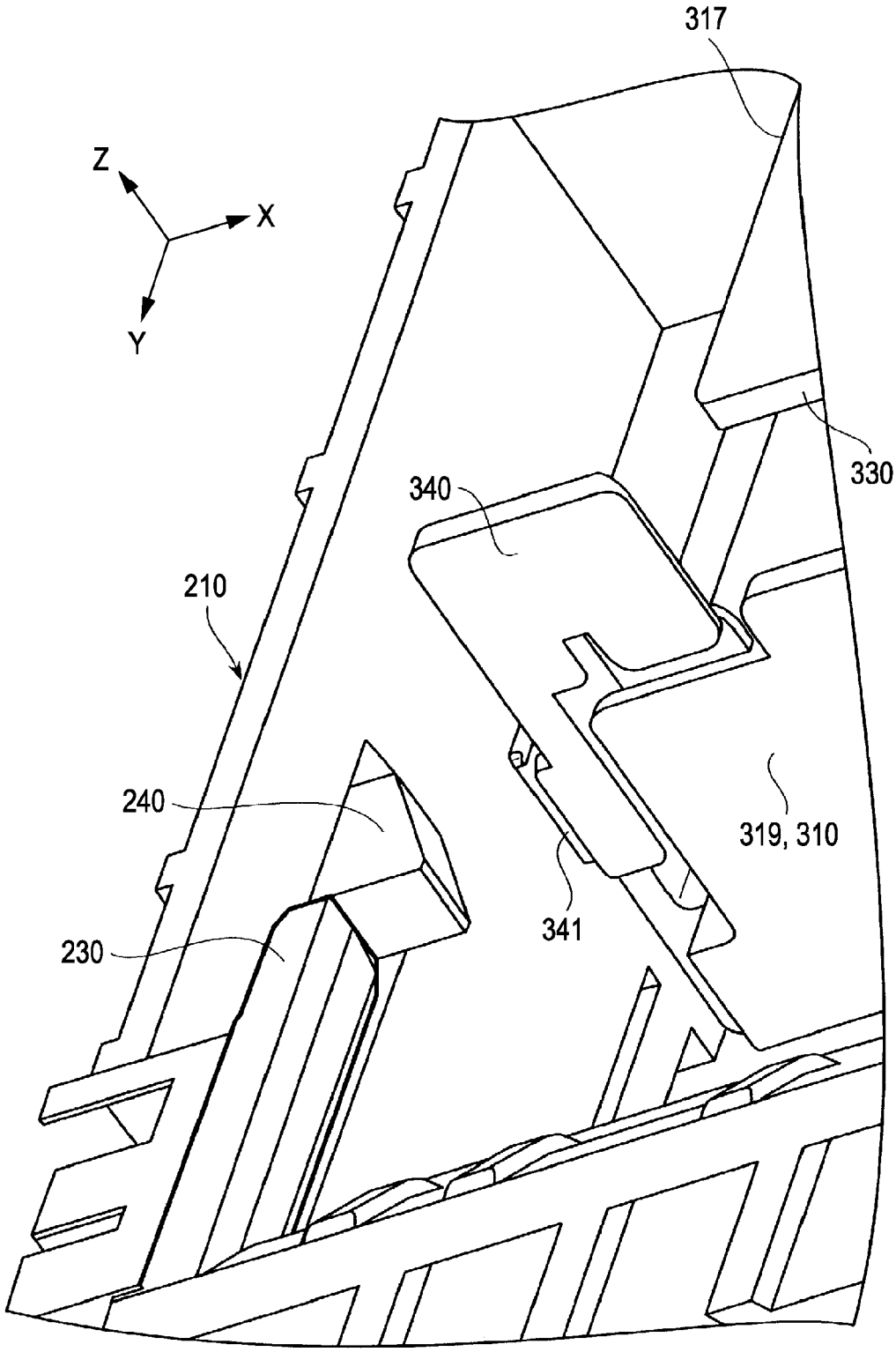
FIG. 19 is an expanded perspective view illustrating the shutter opening protrusion, the shutter closing hook, and the like when viewed from the downside.
Figure 20:
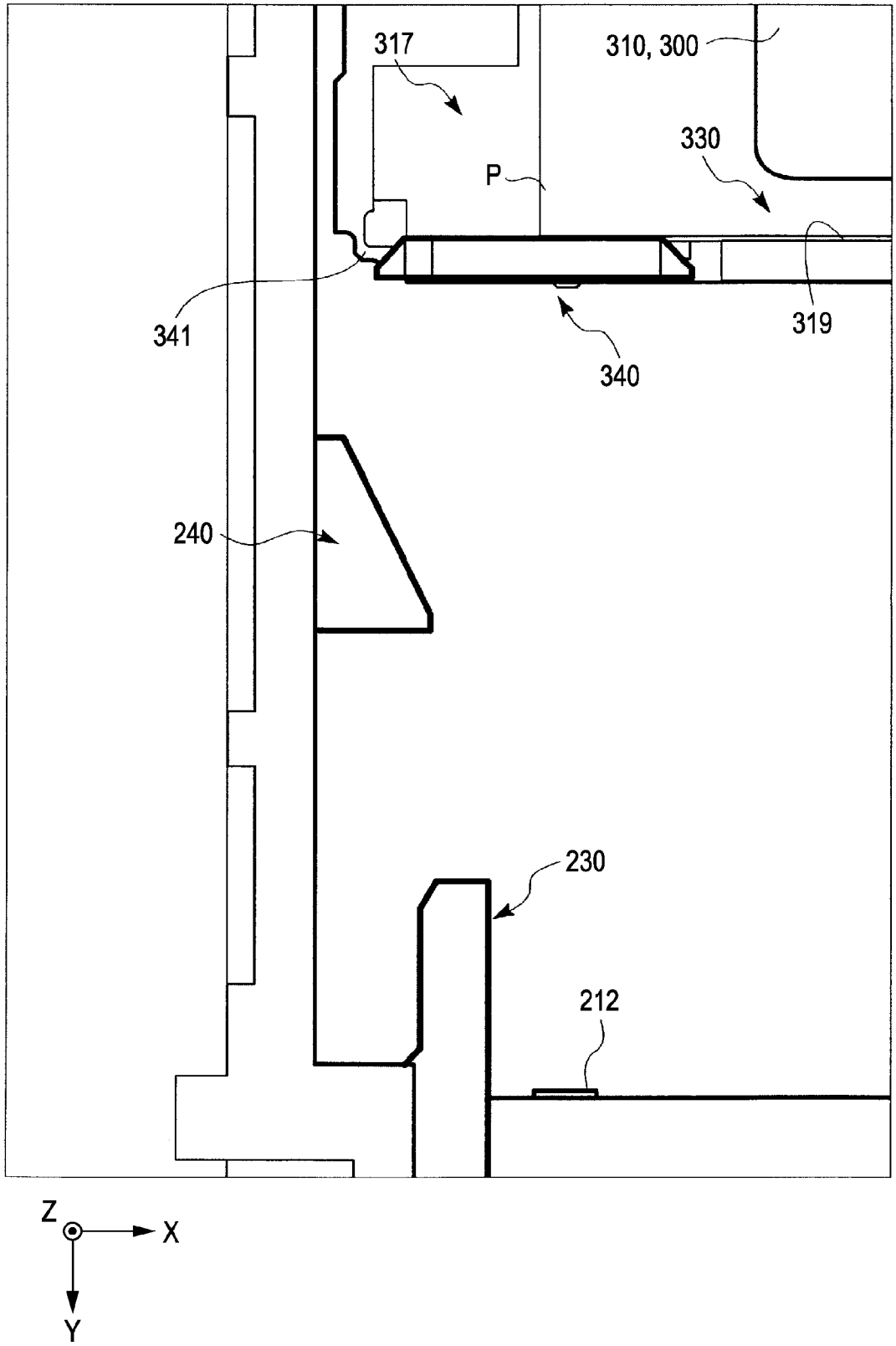
FIG. 20 is an expanded front view illustrating the shutter when the cassette unit is mounted.

FIG. 17 is a perspective view illustrating the cassette unit which is mounted in the printing apparatus body. FIG. 18 is an expanded perspective view illustrating major elements such as the shutter opening protrusion, the shutter closing hook, and the like shown in FIG. 17 when viewed from the upside. FIG. 19 is an expanded perspective view illustrating the major elements in FIG. 18 when viewed from the downside. FIG. 20 is an expanded front view illustrating the major elements in FIGS. 18 and 19.

As shown in FIGS. 17 and 20, the shutter opening protrusion 230 and the shutter closing hook 240 are disposed on a 80-digit side in the transverse direction, which is the left side of the printing apparatus body 101 in FIG. 17.

The shutter opening protrusion 230 protrudes from the contact portion 212 from the downstream side to the upstream of the mounting direction of the cassette unit 300 which is the Y axis direction.

The shutter closing hook 240 extends in the same direction in which the shutter opening protrusion 230 is directed.

A user moves the cassette unit 300 is moved in the Y axis direction along the cassette guide portion 213 and the cassette control portion 214 of the printing apparatus body 101 to mount the cassette unit 300 in the printing apparatus body 101.

At this time, the shutter 340 in the shutter closing state gradually approaches the shutter opening protrusion 230 and the shutter closing hook 240.

Figure 21:
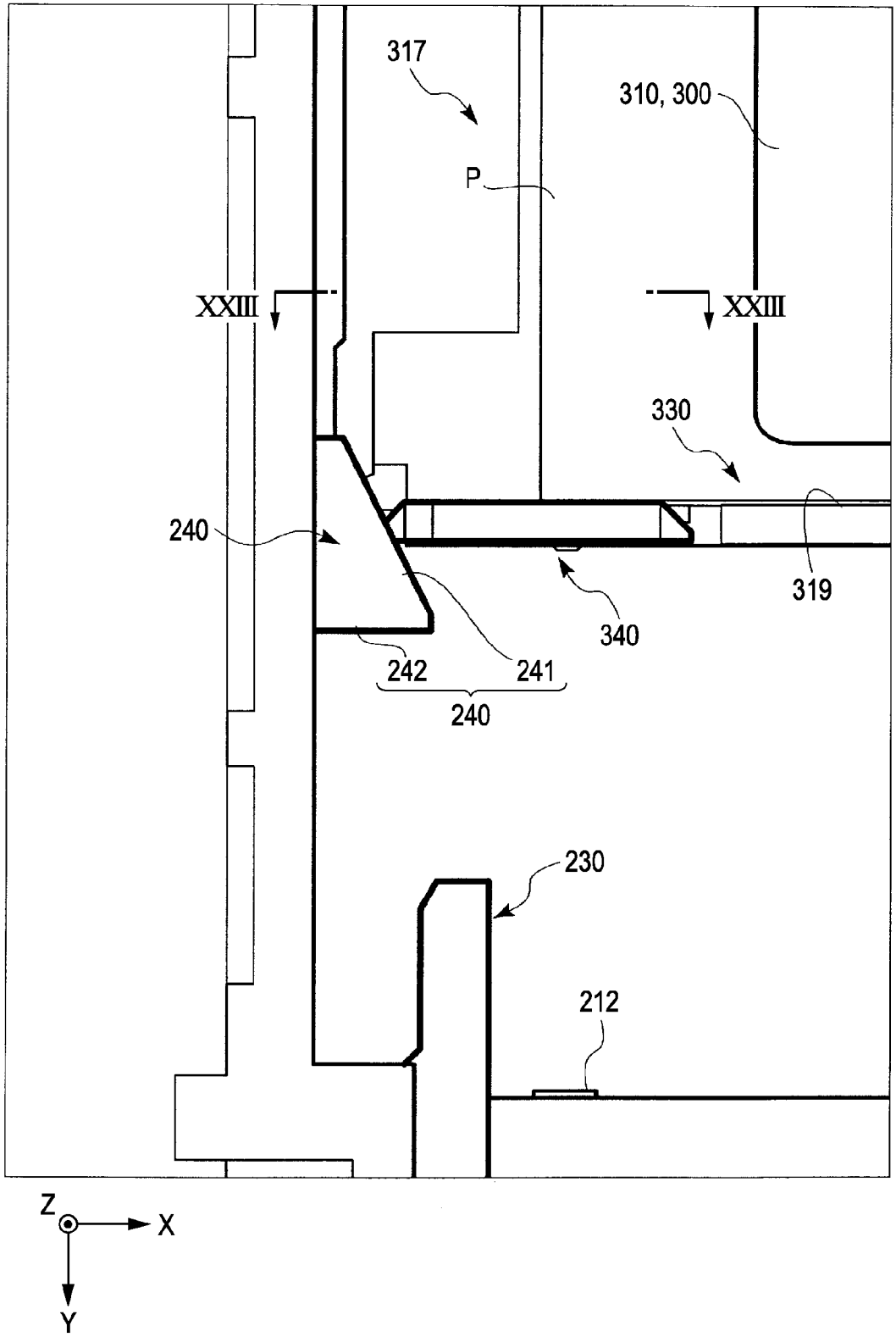
FIG. 21 is an expanded front view illustrating the shutter when the cassette unit is mounted.
Figure 22:
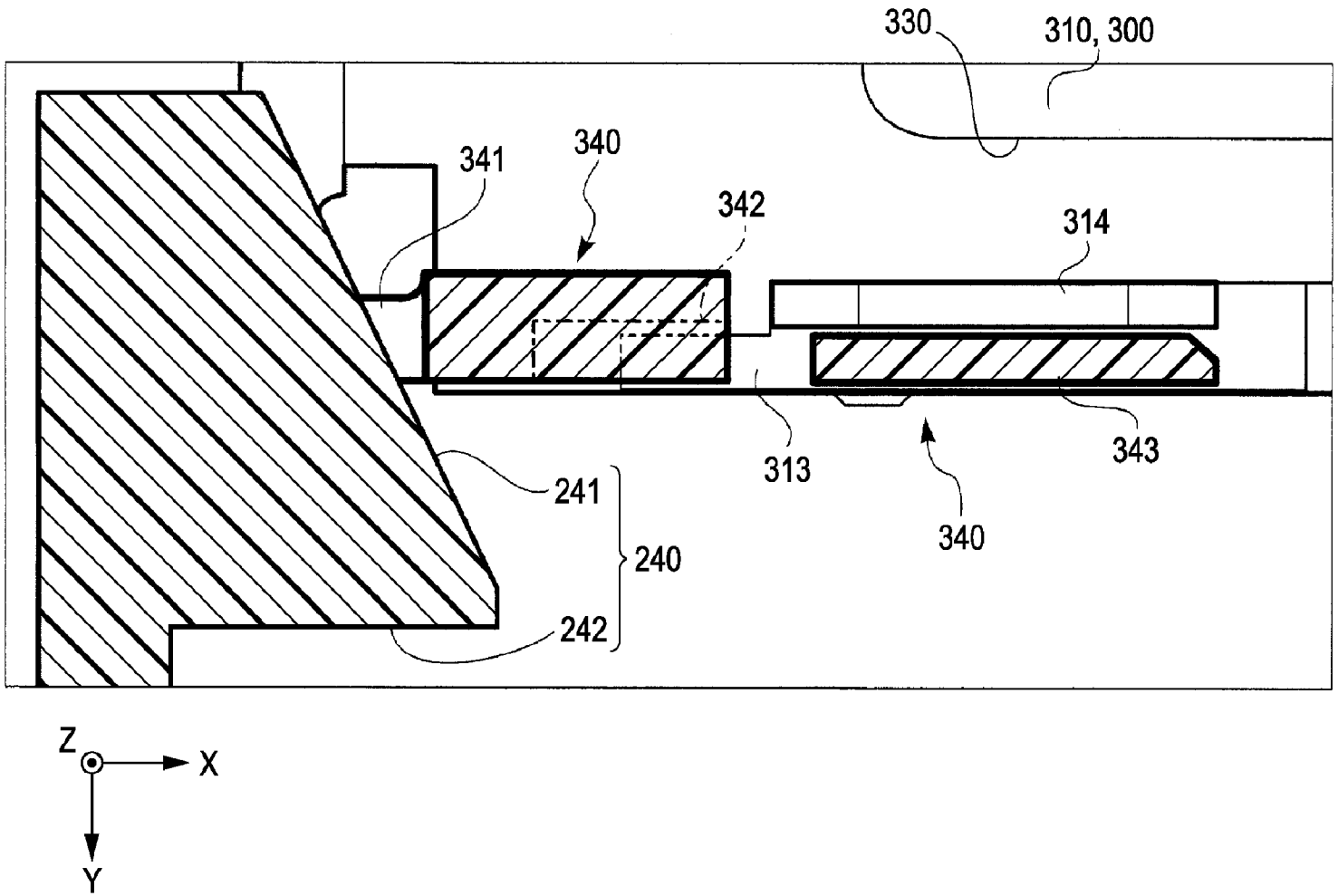
FIG. 22 is a more expanded front view illustrating the shutter and the like when the cassette unit is mounted.
Figure 23:
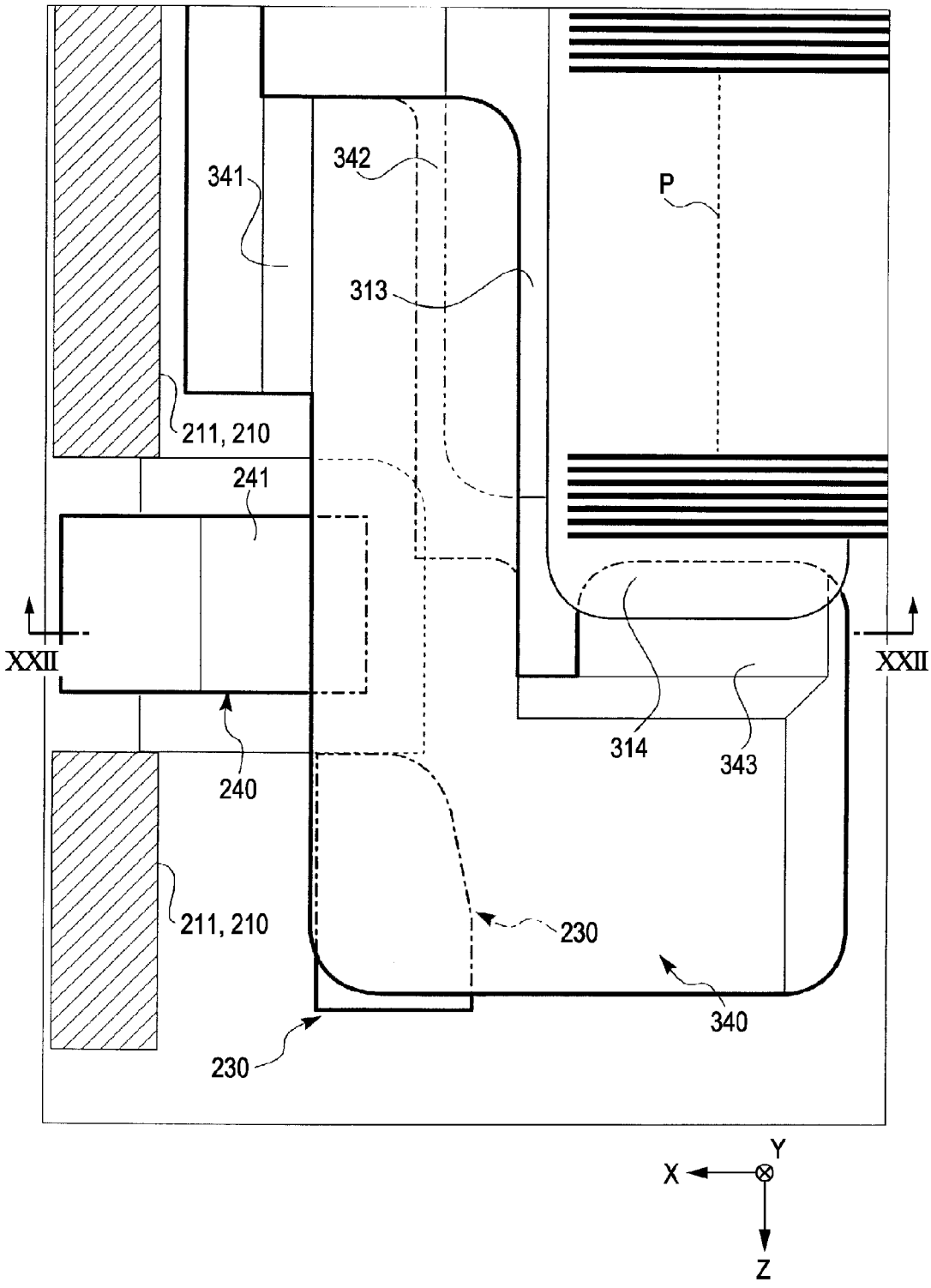
FIG. 23 is an expanded top view illustrating the shutter and the like when the cassette unit is mounted.
Figure 24:
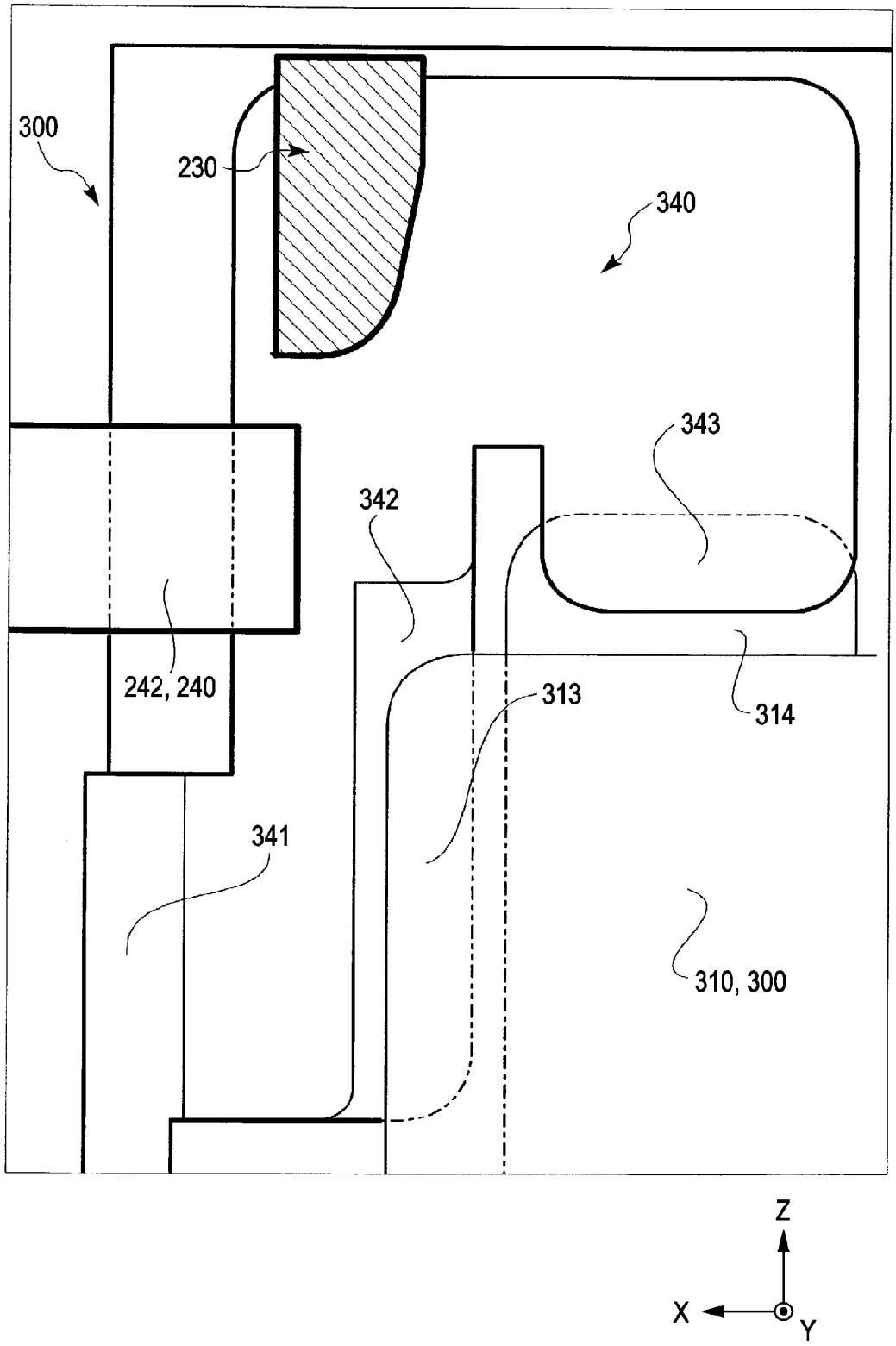
FIG. 24 is an expanded view illustrating the shutter and the like upon mounting the cassette unit when viewed from the downside.

FIG. 21 is an expanded front view illustrating the shutter and the like when the cassette unit is mounted. The cassette unit is moved toward the downstream side of the mounting direction in a state shown in FIGS. 17 to 20. FIG. 22 is a more expanded front sectional view illustrating the shutter and the like shown in FIG. 20. FIG. 23 is a top view illustrating the shutter and the like taken along XXIII-XXIII in FIG. 21. FIG. 24 is a diagram illustrating the shutter and the like shown in FIG. 21 when viewed from the downside.

FIG. 22 is a sectional view illustrating the shutter and the like taken along XXII-XXII in FIG. 23.

As shown in FIGS. 21 to 24, the shutter closing hook 240 includes a slope portion 241 inclined in the Y axis direction and a hook-shaped hook portion 242. Specifically, the slope portion 241 has a gently ascending slope with respect to the downstream side of the mounting direction as the Y axis direction.

When the user moves the cassette unit 300 toward the downstream side of the mounting direction as the Y axis direction in the state shown in FIGS. 17 to 20, the shutter 340 of the cassette unit 300 comes in contact with the slope portion 241 of the shutter closing hook 240 of the printing apparatus body.

Figure 25:
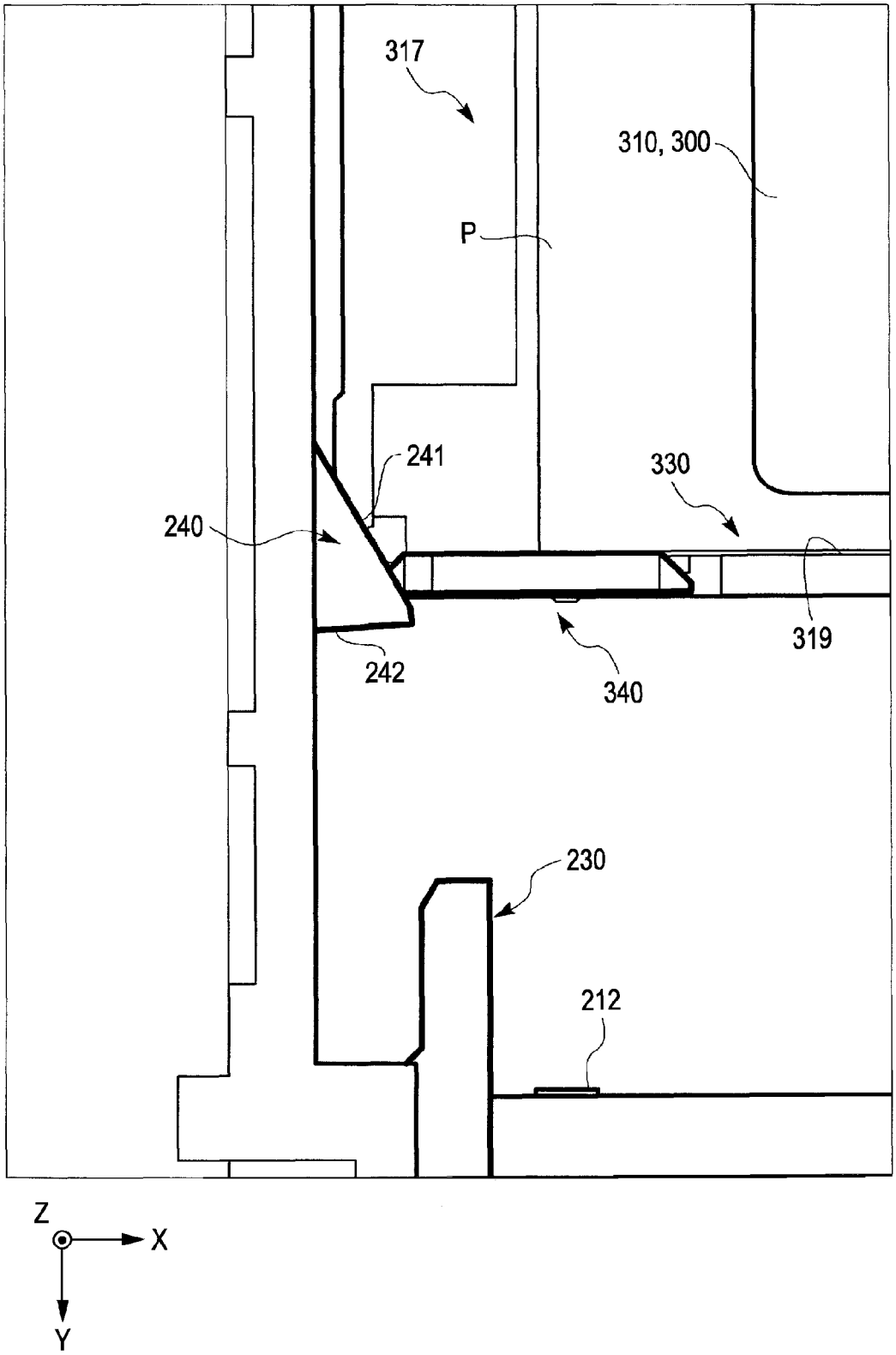
FIG. 25 is an expanded front view illustrating the shutter and the like when the cassette unit is mounted.

FIG. 25 is an expanded front view illustrating the shutter and the like when the cassette unit is mounted and shows a state in which the cassette unit is moved toward the downstream side of the mounting direction in the state shown in FIGS. 21 to 24.

As shown in FIG. 25, when the user moves the cassette unit 300 toward the downstream side of the mounting direction as the Y axis direction in the state shown in FIGS. 21 to 24, the shutter 340 comes in contact with the slope portion 241, and thus the shutter closing hook 240 becomes curved to be moved toward a 80-digit side in the transverse direction, which is the left side of FIG. 25.

In this case, the shutter closing hook 240 is made of a resin. As described above, the shutter closing hook 240 extends from the downstream side to the upstream side of the mounting direction. Accordingly, when a force is applied in a direction intersecting the Y axis direction, the shutter closing hook 240 can become curved.

On the other hand, in the shutter 340, the position for coming in contact with the slope portion 241 of the shutter closing hook 240 is near the second joint portion 341. In addition, the plate-shaped shutter 340 extends in the X axis and Z axis directions. That is, the shutter 340 has a thickness in the X axis and Z axis directions. Accordingly, most portions of shutter 340 do not become curved. Therefore, the position for coming in contact therewith can be moved in a direction in which the shutter closing hook 240 is moved from the shutter 340 just by curving the shutter closing hook 240.

Figure 26:
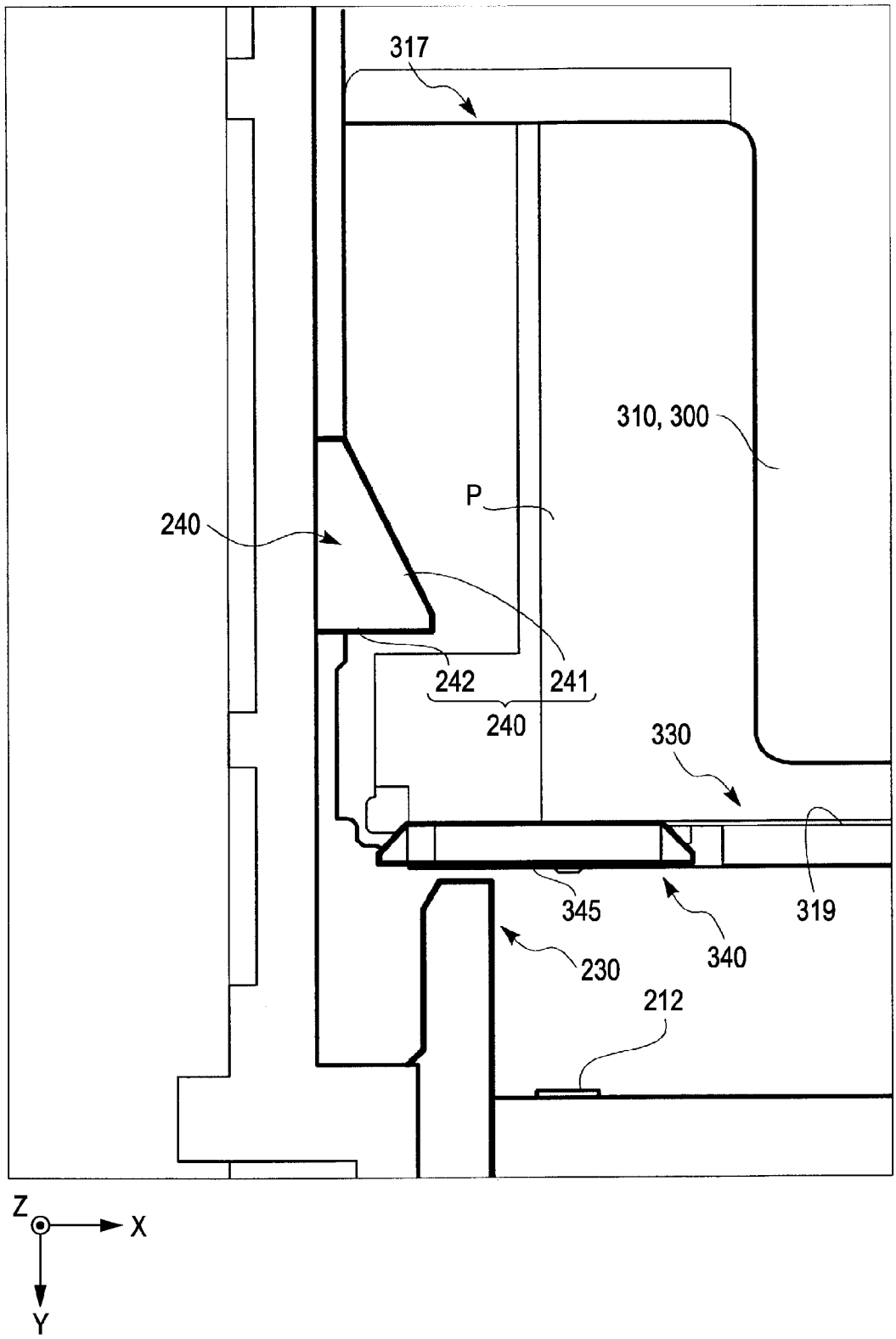
FIG. 26 is an expanded front view illustrating the shutter and the like when the cassette unit is mounted.

FIG. 26 is an expanded front view illustrating the shutter and the like when the cassette unit is mounted and shows a state in which the cassette unit is moved toward the downstream side of the mounting direction in the state shown in FIG. 25.

In FIG. 26, when the user moves the cassette unit 300 toward the downstream side of the mounting direction as the Y axis direction in the state shown in FIG. 25, the shutter 340 passes through the slope portion 241 of the shutter closing hook 240. Accordingly, the shutter closing hook 240 is moved in a protruding direction in the backward moved state to become the state shown in FIG. 20. That is, the shutter closing hook 240 does not become curved. In addition, an outer surface 345 of the shutter 340 gradually approaches the shutter opening protrusion 230.

Figure 27:
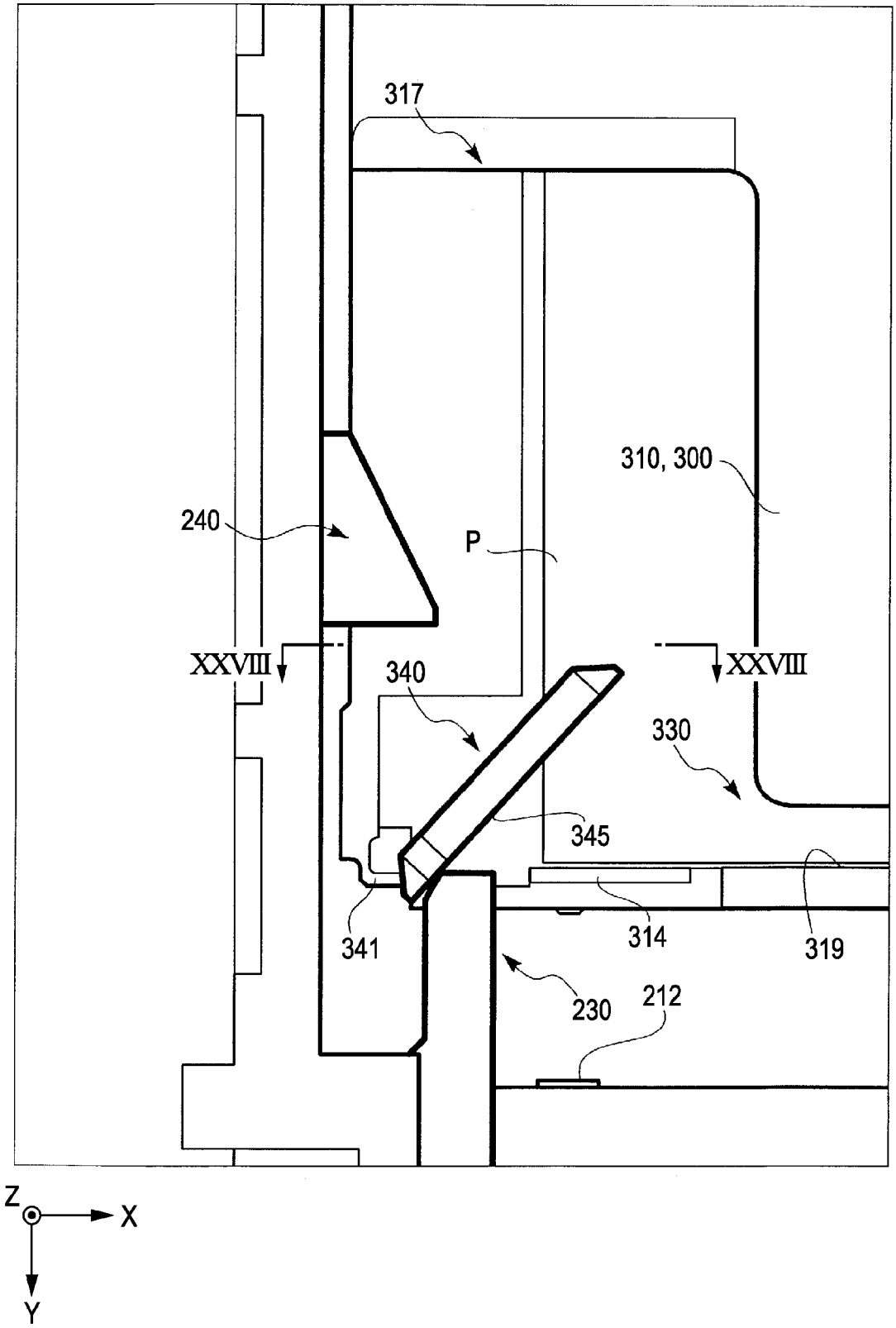
FIG. 27 is an expanded front view illustrating the shutter which is being opened when the cassette unit is mounted.
Figure 28:
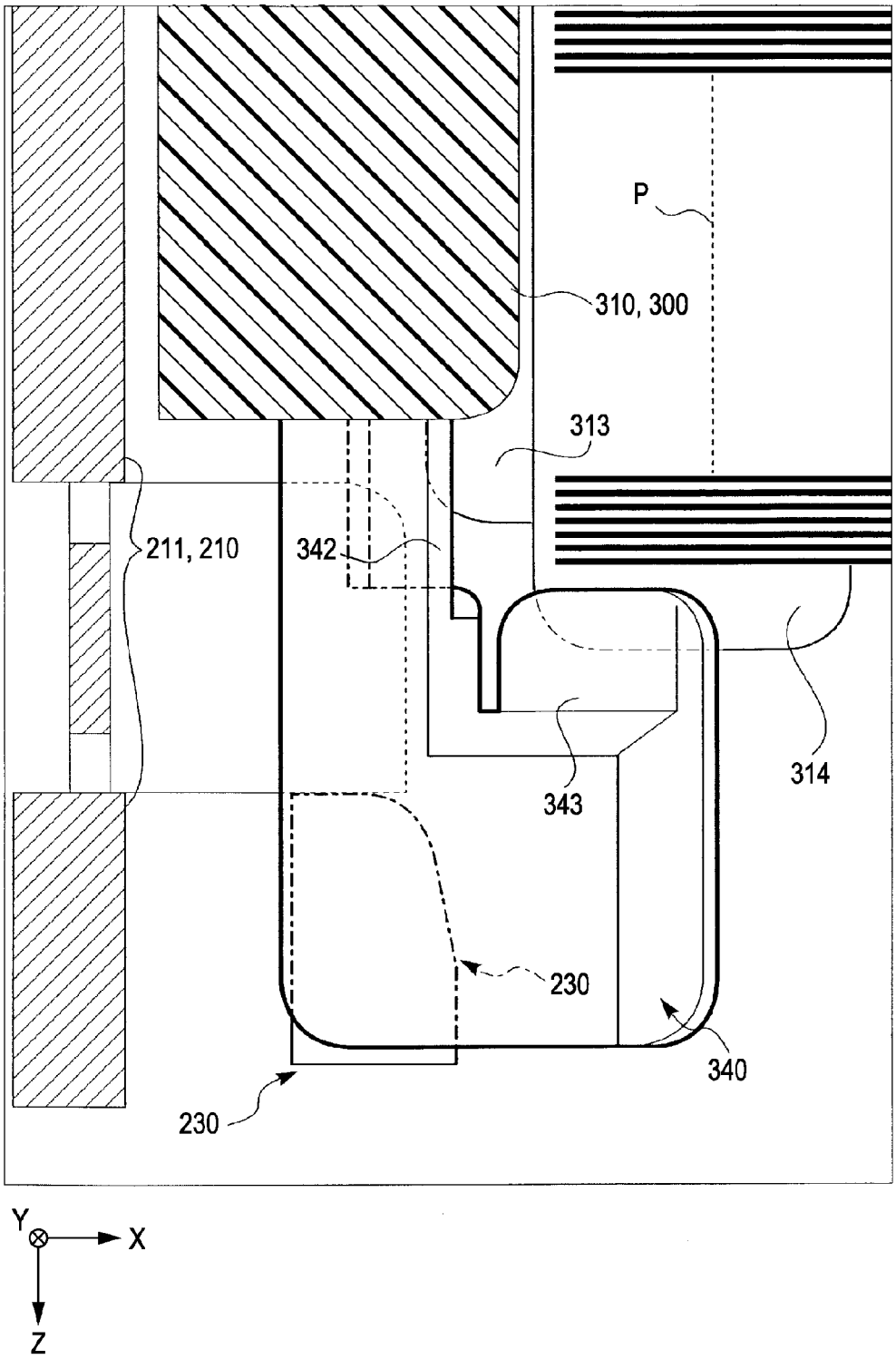
FIG. 28 is an expanded front view illustrating the shutter which is being opened when the cassette unit is mounted.

FIG. 27 is an expanded front view illustrating the shutter and the like when the cassette unit is mounted and shows a state in which the cassette unit is moved toward the downstream side of the mounting direction in the state shown in FIG. 26. FIG. 28 is a top view illustrating the shutter and the like taken along XXVIII-XXVIII shown in FIG. 27.

In FIGS. 27 and 28, when the user moves the cassette unit 300 is moved toward the downstream side of the mounting direction in the state shown in FIG. 26, the outer surface 345 of the shutter 340 comes in contact with the shutter opening protrusion 230.

Subsequently, when the cassette unit 300 is again moved toward the downstream side of the mounting direction as the Y axis direction, the shutter opening protrusion 230 pushes up the shutter 340 relatively with respect to the cassette unit 300. Accordingly, the fourth shallow portion 343 goes beyond the fourth case claw 314 while the fourth shallow portion 343 and the fourth case claw 314 become curved. In addition, the shutter 340 is rotatably moved counterclockwise in FIG. 27 using the second joint portion 341 as a pivot point. That is, the shutter 340 is rotatably moved toward the inside of the cassette case 310 to be opening.

Figure 29:
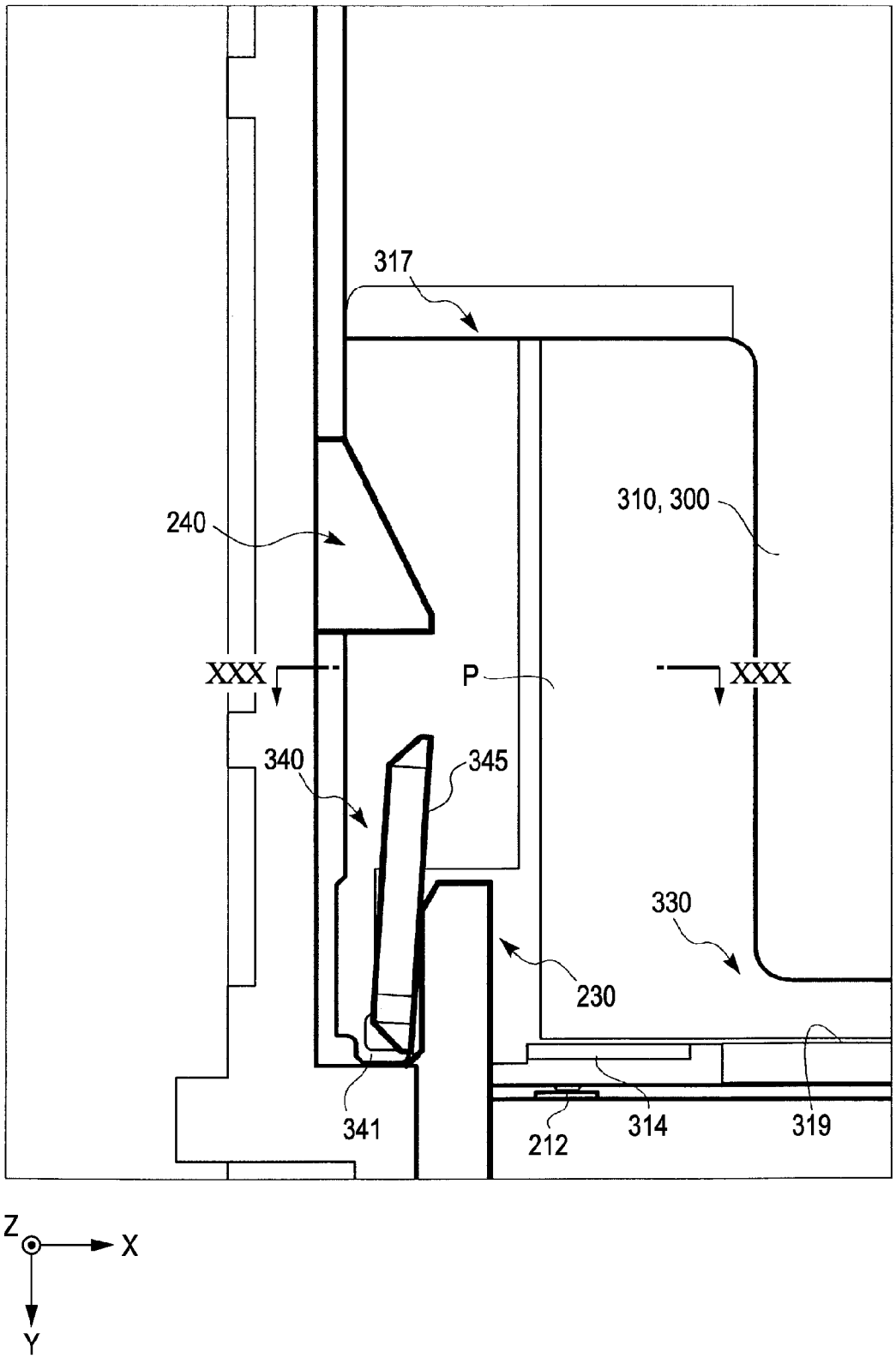
FIG. 29 is an expanded front view illustrating the shutter and the like when the cassette unit is completely mounted.
Figure 30:
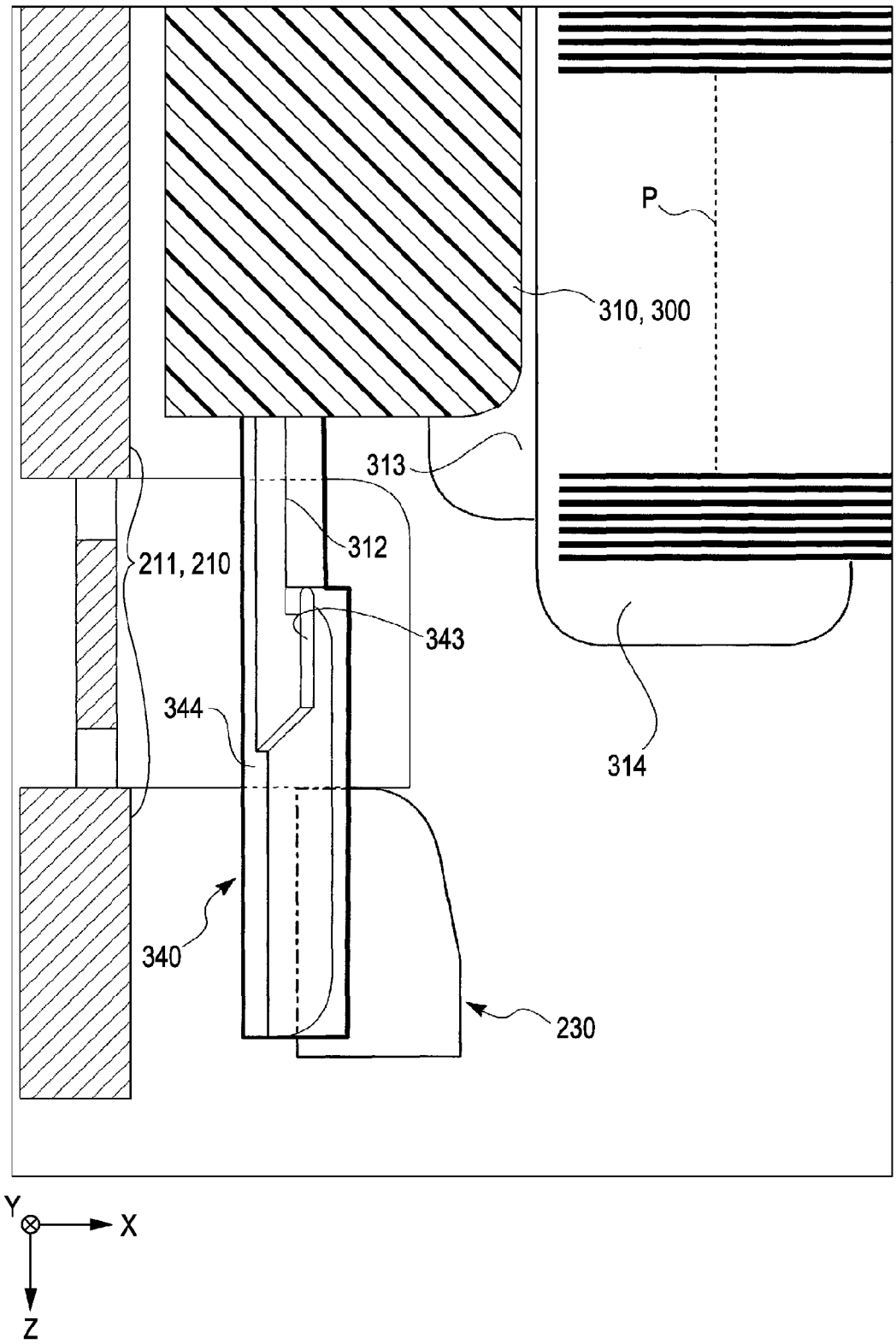
FIG. 30 is an expanded top view illustrating the shutter and the like when the cassette unit is completely mounted.

FIG. 29 is an expanded front view illustrating the shutter and the like when the cassette unit is mounted and shows a state in which the cassette unit is moved toward the downstream side of the mounting direction in the state shown in FIGS. 27 and 28. FIG. 30 is a top view illustrating the shutter and the like taken along XXX-XXX shown in FIG. 29.

In FIGS. 29 and 30, when the user moves the cassette unit 300 toward the downstream side of the mounting direction in the state shown in FIGS. 27 and 28, the underside of the cassette unit 300 comes in contact with the contact portion 212 of the printing apparatus body, thereby stopping the movement of the cassette unit 300 toward the downstream side of the mounting direction as the Y axis direction.

At this time, the shutter opening protrusion 230 further pushes up the shutter 340 relatively with respect to the cassette unit 300. Accordingly, the shutter 340 is rotatably moved counterclockwise again in FIG. 29 to be completely opened. At this time, in the second joint portion 341, a force for pushing the shutter 340 clockwise again in FIG. 29 is generated, but the opened state of the shutter 340 is maintained by the shutter opening protrusion 230.

In this way, the cassette unit 300 is completely mounted in the printing apparatus body 101.

It is desirable that the shutter opening protrusion 230 comes in contact with the vicinity of the fourth shallow portion 343 using the second joint portion 341 as a pivot point. In this case, it is possible to more reliably release the engagement of the fourth shallow portion 343 and the fourth case claw 314 with each other.

Detaching of Cassette Unit

Figure 31:
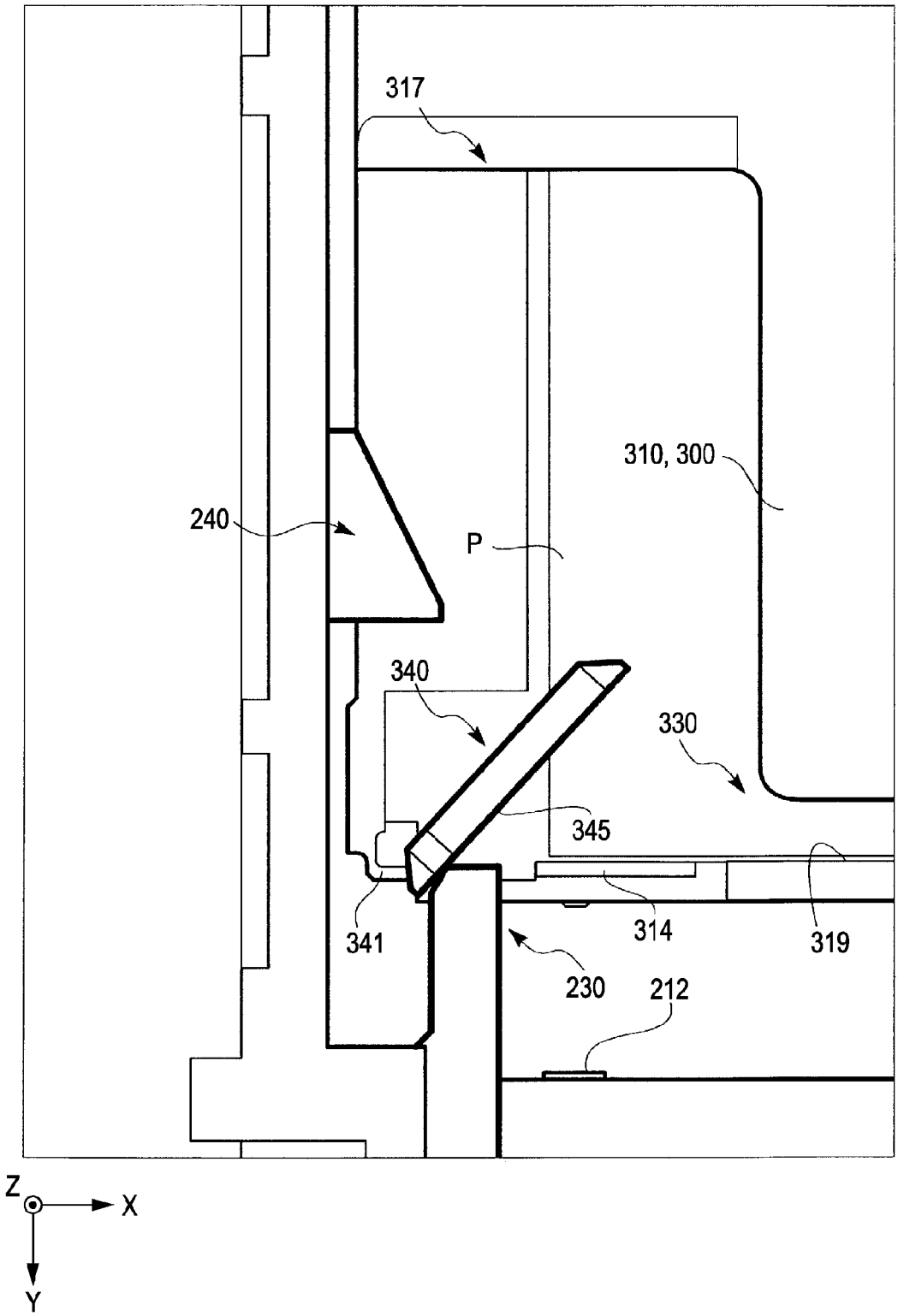
FIG. 31 is an expanded front view illustrating the shutter which is being closed when the cassette unit is detached.

FIG. 31 is an expanded front view illustrating the closing shutter when the cassette unit is detached.

As shown in FIG. 31, the user moves the cassette unit 300 toward the downstream side of a detaching direction which is reverse to the mounting direction in the state shown in FIGS. 29 and 30. Then, the shutter 340 is rotatably moved clockwise using the second joint portion 341 as the pivot point by a returning force of the second joint portion 341 in FIG. 31 while the shutter 340 is controlled by the shutter opening protrusion 230. That is, the shutter 340 is being closed.

Figure 32:
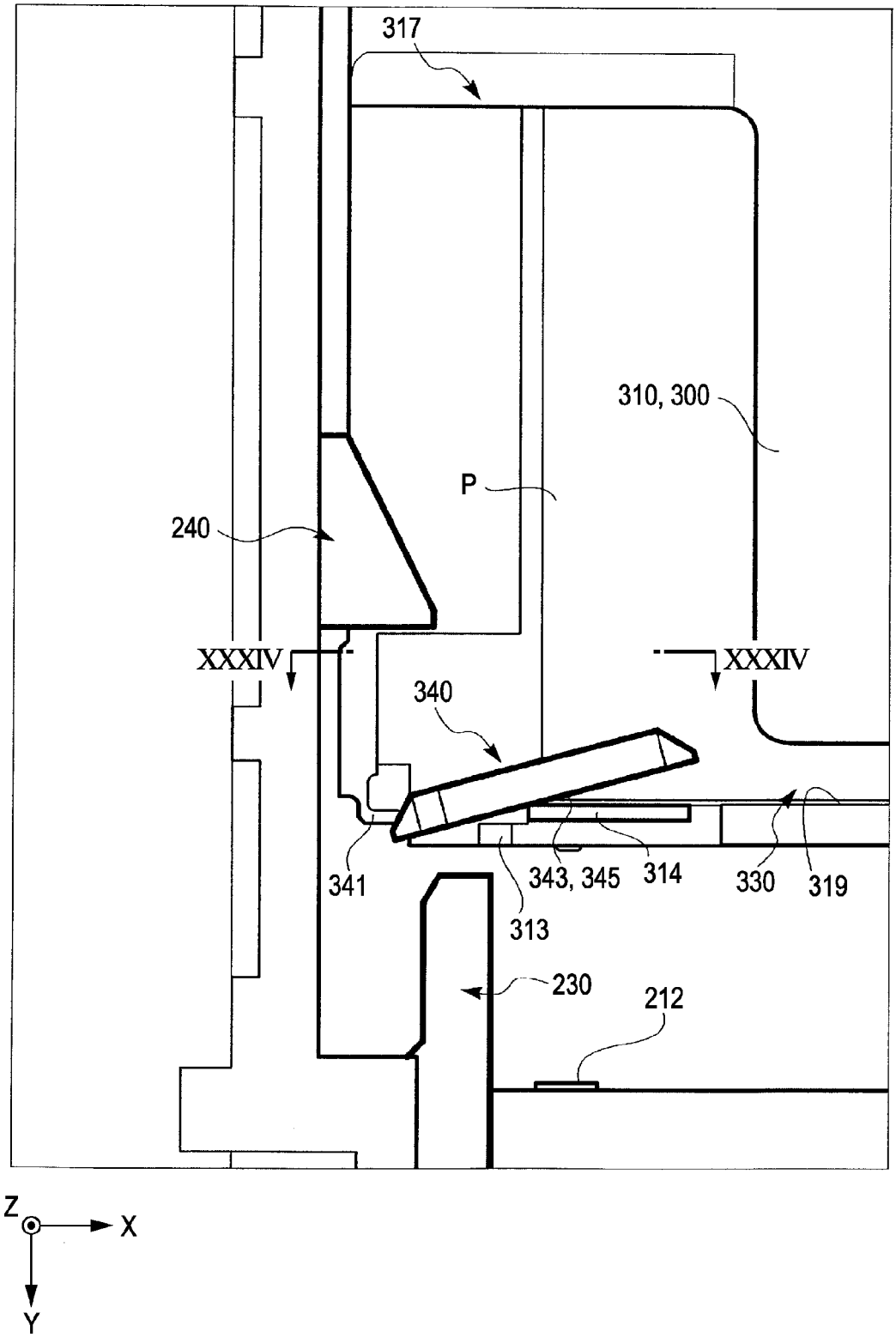
FIG. 32 is an expanded front view illustrating the shutter which is being closed when the cassette unit is detached.
Figure 33:
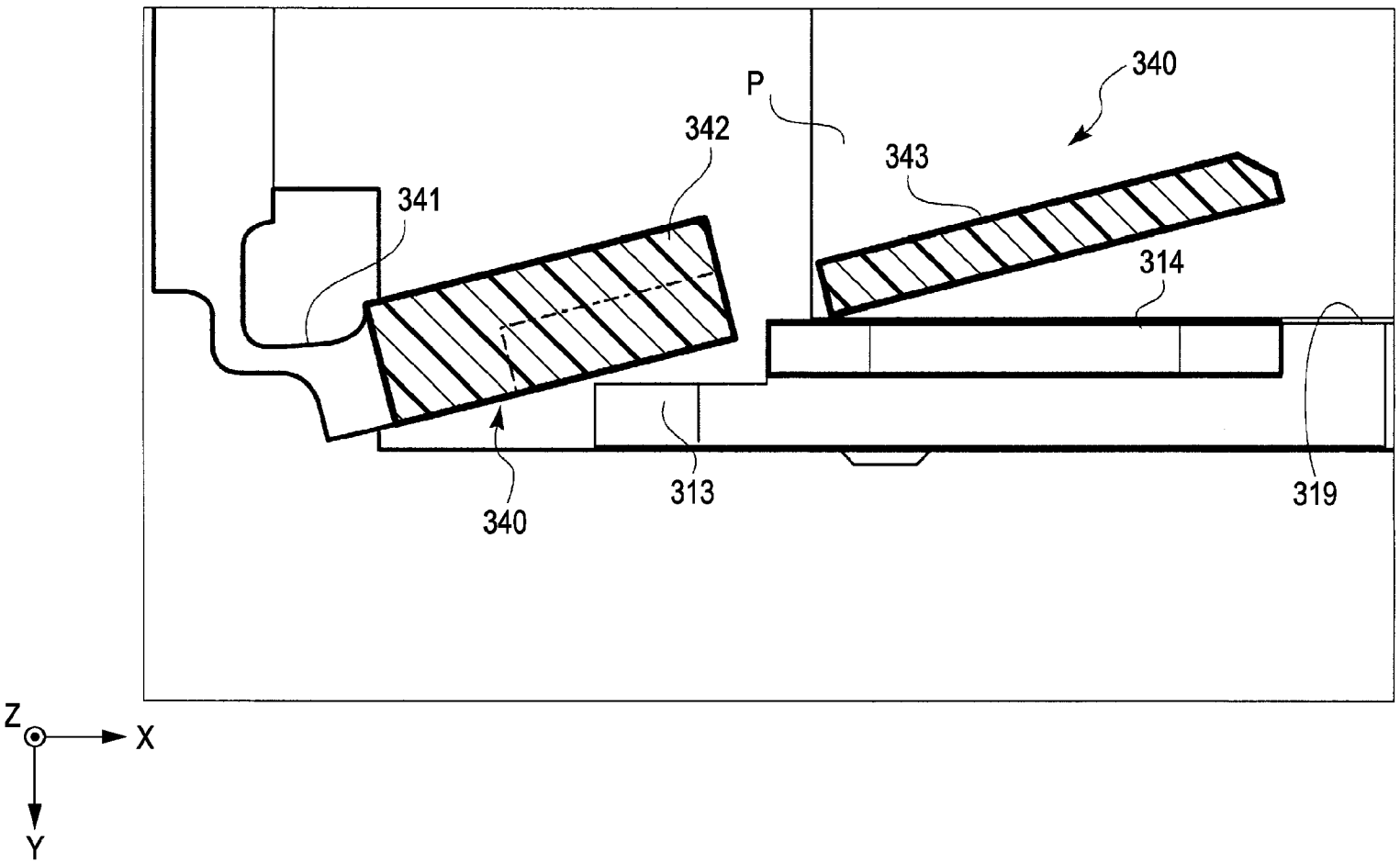
FIG. 33 is a more expanded front view illustrating the shutter which is being closed when the cassette unit is detached.
Figure 34:
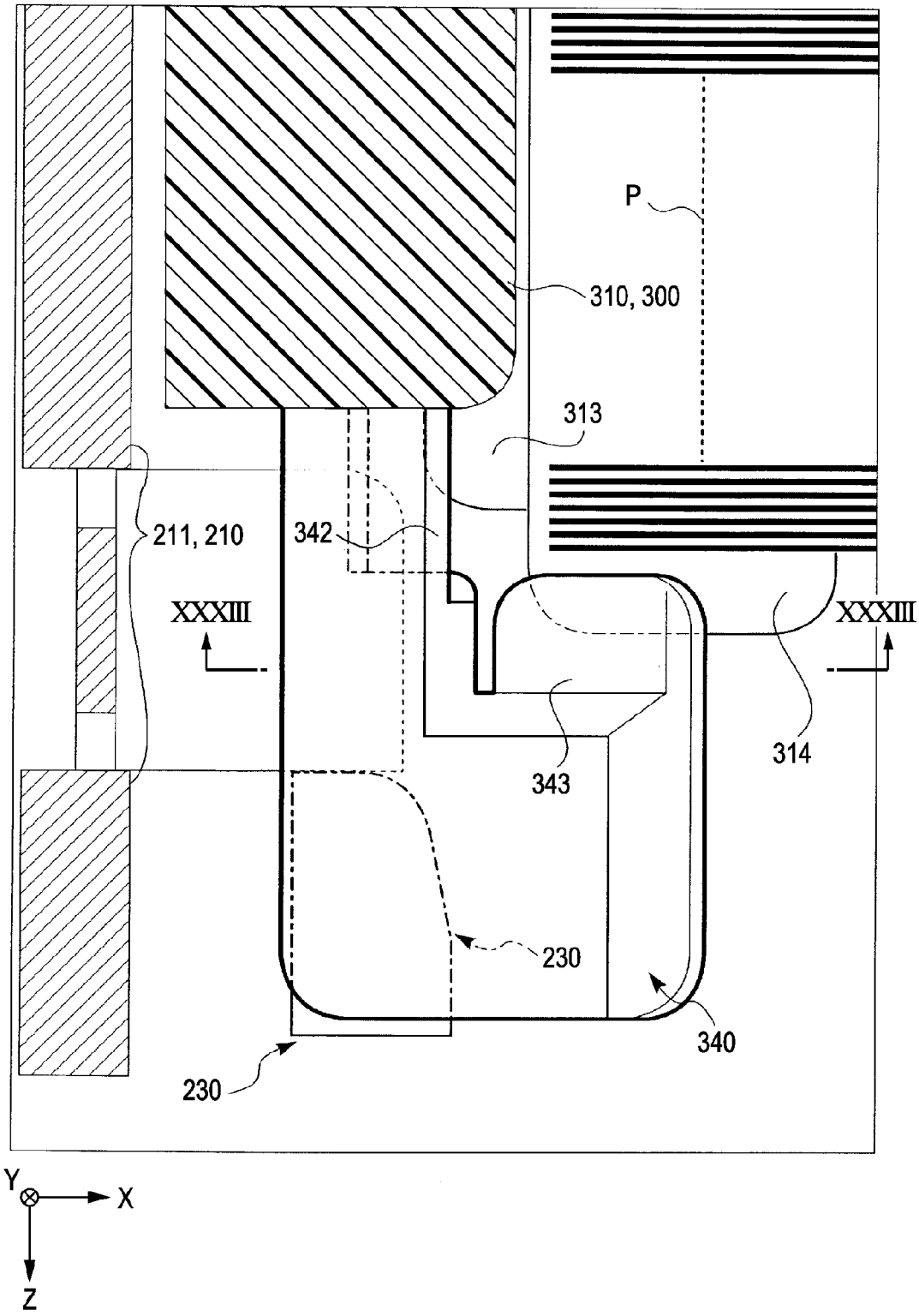
FIG. 34 is an expanded top view illustrating the shutter which is closed when the cassette unit is detached.

FIG. 32 is an expanded front view illustrating the closing the shutter when the cassette unit is detached and shows the cassette unit moved toward the downstream side of the detaching direction in the state shown in FIG. 31. FIG. 33 is a more expanded front sectional view illustrating the shutter in FIG. 32. FIG. 34 is a top view illustrating the shutter taken along XXXIV-XXXIV shown in FIG. 32.

FIG. 33 is a sectional view illustrating the shutter and the like taken along XXXIII-XXXIII shown in FIG. 34.

In FIGS. 32 to 34, the user moves the cassette unit 300 toward the downstream side of the detaching direction in the state shown in FIG. 31, the shutter 340 is rotatably moved clockwise again in FIG. 32 using the second joint portion 341 as the pivot point. In addition, the fourth shallow portion 343 of the shutter 340 slightly comes in contact with the fourth case claw 314. Accordingly, the clockwise rotatable rotation of the shutter 340 in FIG. 32 becomes stopped. Afterward, the outer surface 345 of the shutter 340 becomes separated from the shutter opening protrusion 230 of the printing apparatus body.

In this state, the shutter 340 is not completely closed. That is, the shutter 340 is being closed.

Figure 35:
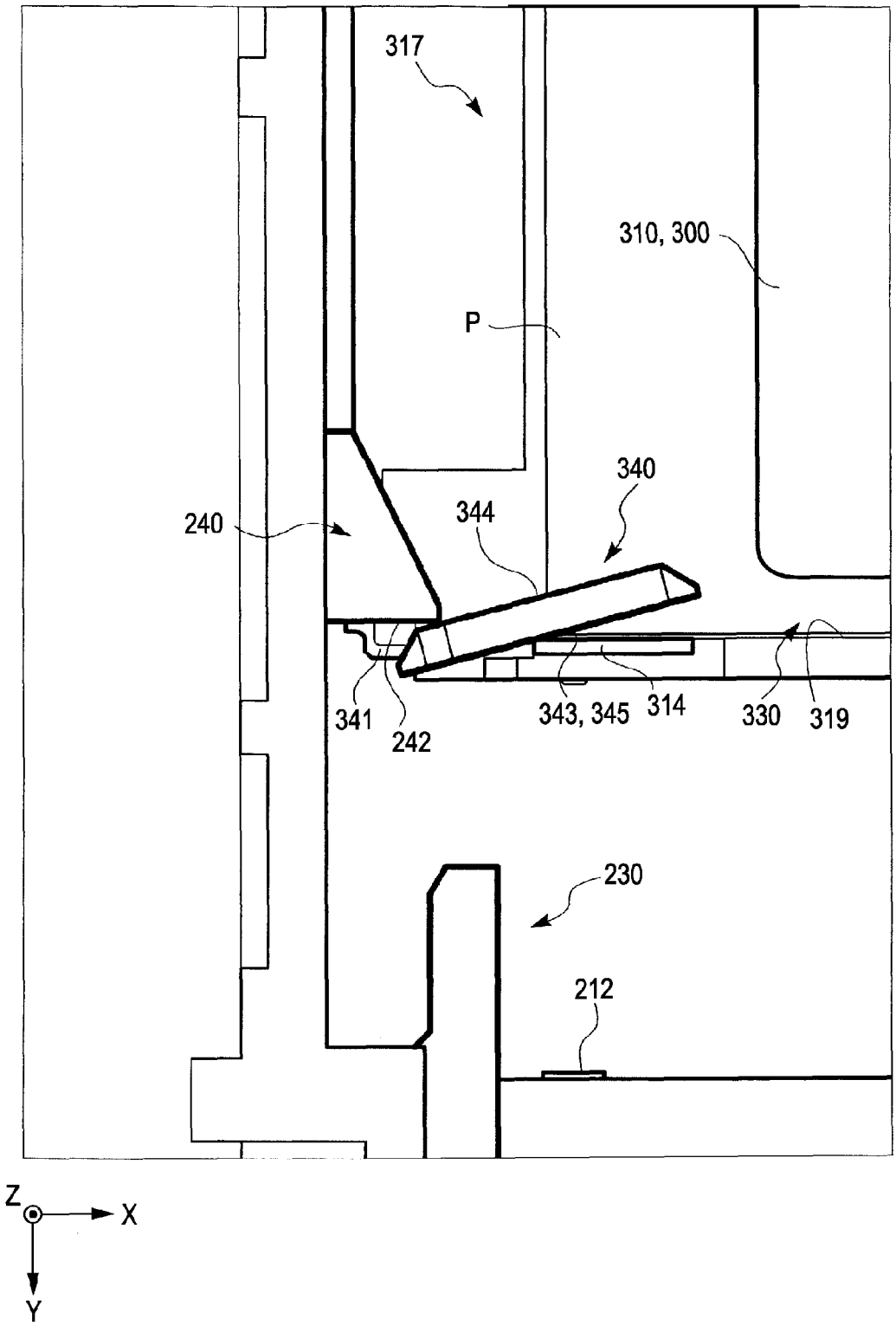
FIG. 35 is an expanded front view illustrating the shutter which is being closed when the cassette unit is detached.

FIG. 35 is an expanded front view illustrating the closing shutter when the cassette unit is detached and shows the cassette unit moved in the downstream side of the detaching direction in the state shown in FIGS. 32 to 34.

In FIG. 35, when the user moves the cassette unit 300 toward the downstream side of the detaching direction in the state shown in FIGS. 32 to 34, an inner surface 344 of the shutter 340 approaches the hook portion 242 of the shutter closing hook 240 of the printing apparatus body.

The inner surface 344 of the shutter 340 comes in contact with the hook portion 242 to be pressed by the hook portion 242. At this time, the pressing force allows the fourth shallow portion 343 of the shutter 340 to be strongly pressed by the fourth case claw 314 of the cassette case. Then, the fourth shallow portion 343 and the fourth case claw 314 become curved, and thus the fourth shallow portion 343 is about to go beyond the fourth case claw 314.

Figure 36:
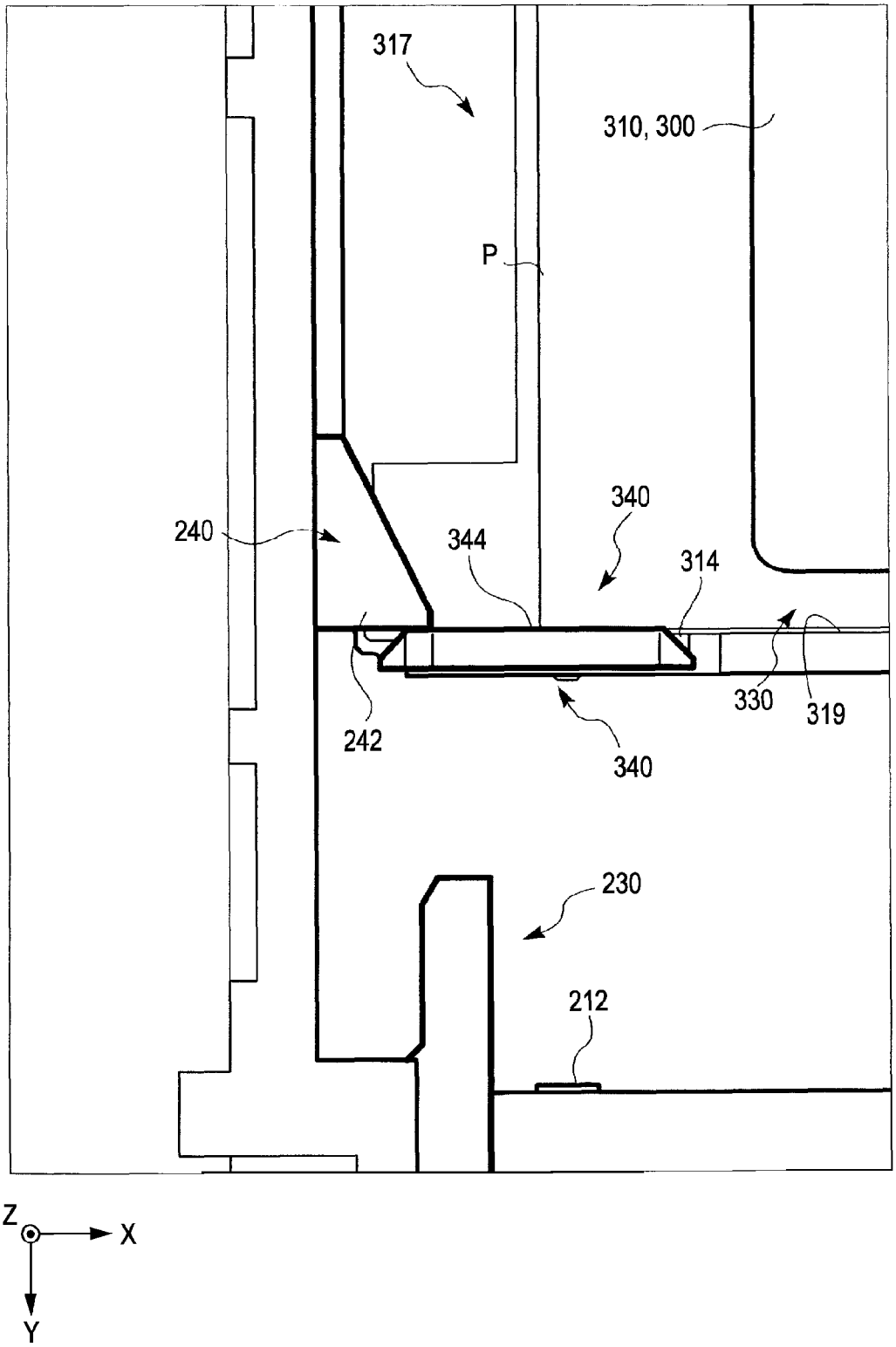
FIG. 36 is an expanded front view illustrating the shutter which is closed when the cassette unit is detached.

FIG. 36 is an expanded front view illustrating the closing shutter when the cassette unit is detached and shows the cassette unit moved in the downstream side of the detaching direction in the state shown in FIG. 35.

In FIG. 36, when the user moves the cassette unit 300 toward the downstream side of the detaching direction in the state shown in FIG. 35, the inner surface 344 of the shutter 340 is more strongly pressed by the hook portion 242. At this time, the fourth case claw 314 strongly presses the fourth shallow portion 343 by the pressing force. Accordingly, the fourth shallow portion 343 and the fourth case claw 314 become curved again, and thus the fourth shallow portion 343 goes beyond the underside of the fourth case claw 314. That is, the shutter 340 is completely closed.

Figure 37:
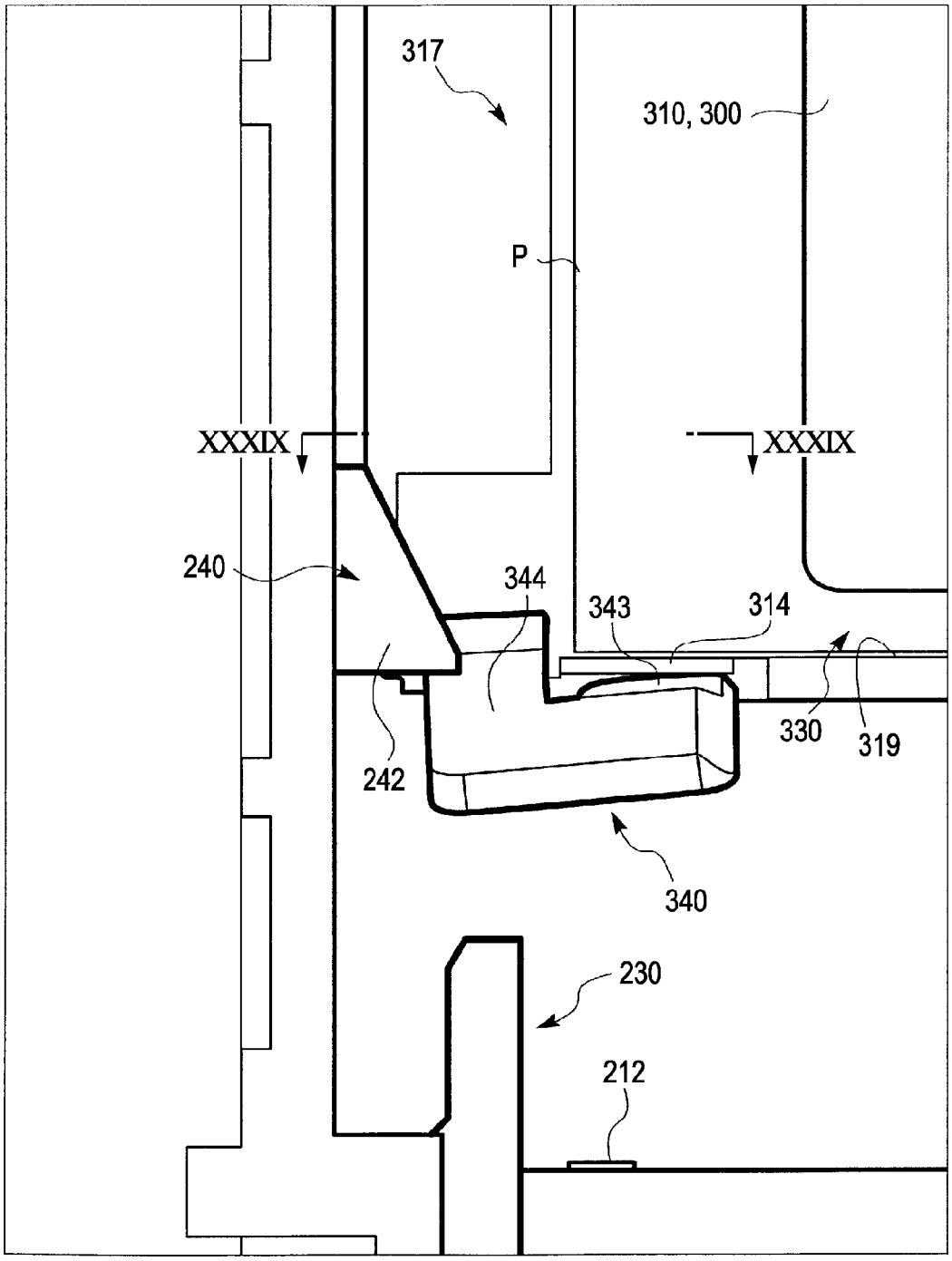
FIG. 37 is an expanded front view illustrating the shutter and the like when the shutter has been closed.
Figure 37:
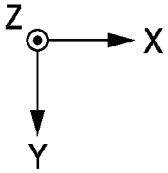
Figure 38:
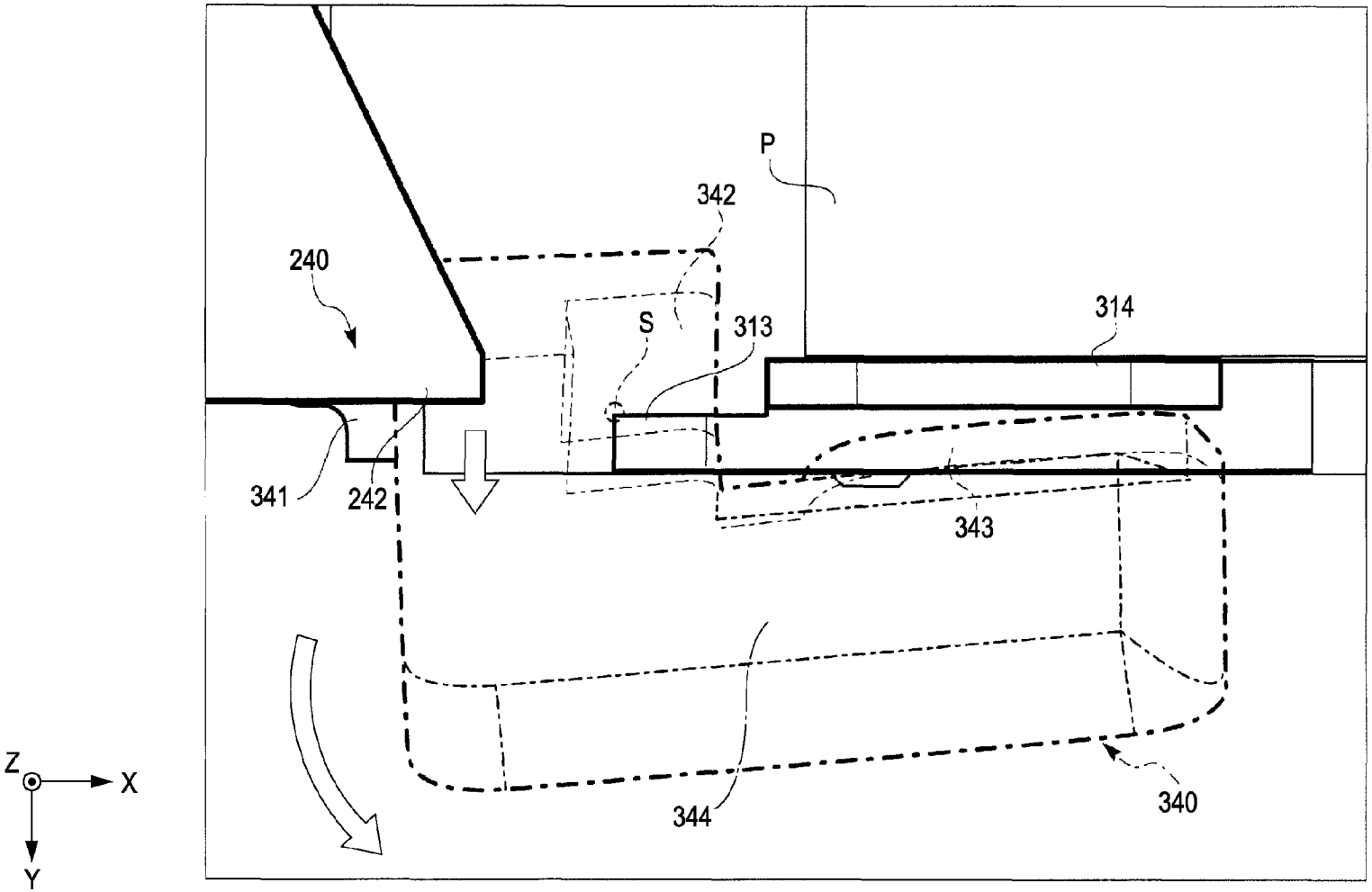
FIG. 38 is a more expanded front view illustrating the shutter and the like when the shutter has been closed.
Figure 39:
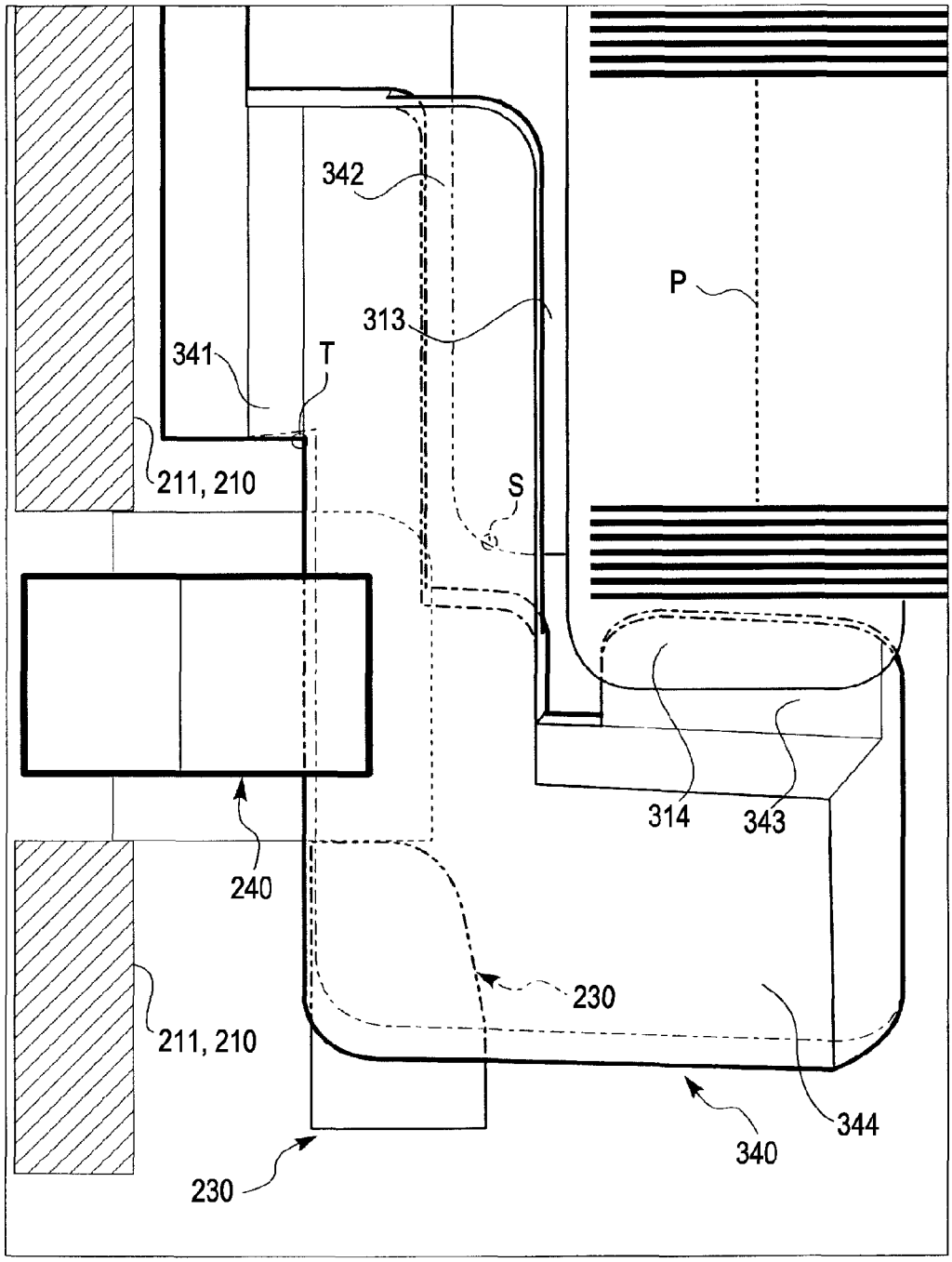
FIG. 39 is an expanded top view illustrating the shutter and the like when the shutter has been closed.
Figure 39:
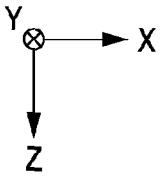

FIG. 37 is an expanded front view illustrating the closed shutter when the cassette unit is detached and shows the cassette unit moved in the downstream side of the detaching direction in the state shown in FIG. 36. FIG. 38 is a more expanded front view illustrating the shutter and the like in FIG. 37. FIG. 39 is a top view illustrating the shutter and the like taken along XXXIX-XXXIX shown in FIG. 37.

In FIG. 38, the shutter is indicated by a dashed line to clearly show the shutter.

In FIGS. 37 to 39, when the user moves the cassette unit 300 toward the downstream side of the detaching direction in the state shown in FIG. 36, the shutter 340 is pressed by the hook portion 242 and becomes curved. Specifically, in the state in which the shutter 340 is completely closed, the third shallow portion 342 comes in contact with the third case claw 313. In addition, the third case claw 313 prevents the shutter 340 from being rotatably moved outward from the position of the shutter closing state.

Accordingly, even though the shutter 340 is strongly pressed by the hook portion 242, the third case claw 313 also prevents the shutter 340 from being rotatably moved clockwise in FIG. 37 at the position of the shutter closing state.

The shutter 340 formed in an L shape extends in the Z axis direction from the second joint portion 341 and is bent in the X axis direction. The shutter 340 is configured to be rotatably moved using the Z axis as a pivot point in that the second joint portion 341 extends in the Z axis direction. In the shutter 340, the third shallow portion 342 engaging with the third case claw 313 is formed between the second joint portion 341 and the bent portion. In addition, the fourth shallow portion 343 engaging with the fourth case claw 314 is formed in the front end from the bent portion.

The portion in which the hook portion 242 presses the shutter 340 is formed in the vicinity of the bent portion. Specifically, the portion in which the hook portion 242 presses the shutter 340 is different from the position of the second joint portion 341 and the third shallow portion 342 in the Z axis direction. That is, in the shutter 340, the portion in which the hook portion 242 presses the shutter 340 is configured to become the front end from the position of the second joint portion 341 and the third shallow portion 342.

Accordingly, when the shutter 340 is strongly pressed by the hook portion 242, a rotation momentum is applied to the shutter 340 in an axis formed by two points between a contact point S of the third shallow portion 342 and the third case claw 313 and a point T of the front end of the shutter 340 jointing with the second joint portion 341. At this time, the plate-shaped shutter 340 extends in the X axis and Z axis directions. That is, the shutter 340 is relatively thin in the Y axis direction and becomes easily curved by a force focused on a specific portion of the inner surface 344 in the Y axis direction in the state the shutter 340 is controlled by the third case claw 313.

As a result, the shutter 340 becomes curved to be inclined. More specifically, in the inner surface 344 of the shutter 340, the portion in which the shutter 340 is pressed by the hook portion 242 becomes curved to be inclined from the contact point S and the point T in a downward direction which is the upstream side of the detaching direction.

It is desirable that the position in which the fourth shallow portion 343 and the fourth case claw 314 engage with each other is configured on the axis formed by the contact point S and the point T. In this case, even when the shutter 340 becomes curved by the hook portion 242, the position of the fourth shallow portion 343 is not particularly displaced. Accordingly, the above-described configuration can stabilize the engagement of the fourth shallow portion 343 and the fourth case claw 314.

Figure 40:
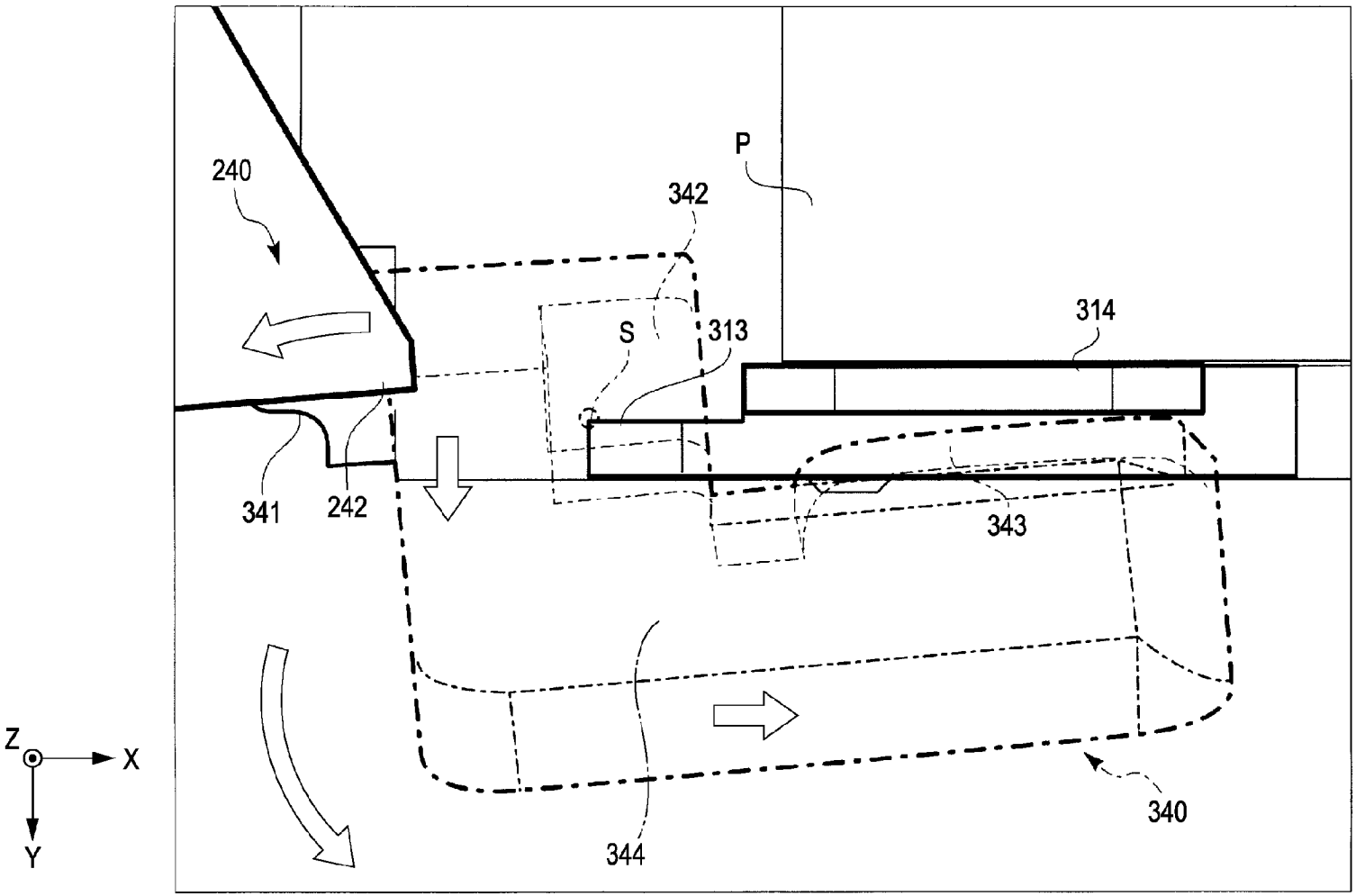
FIG. 40 is a more expanded front view illustrating the shutter and the like when the shutter has been closed.
Figure 41:
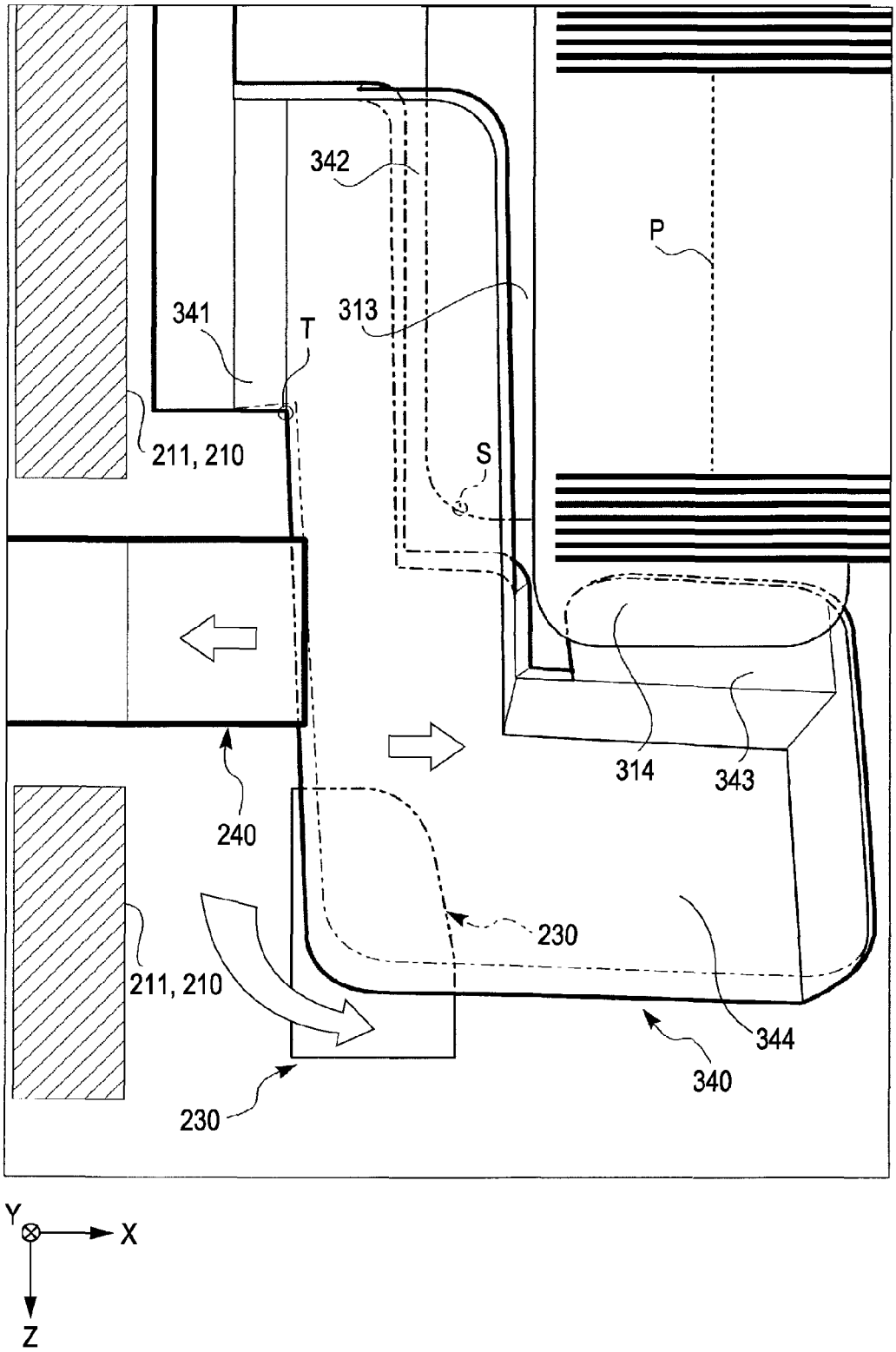
FIG. 41 is an expanded top view illustrating the shutter and the like when the shutter has been closed.

FIG. 40 is a more expanded front view illustrating the closed shutter when the cassette unit is detached and shows the cassette unit moved in the downstream side of the detaching direction in the state shown in FIGS. 37 to 39. FIG. 41 is a top view illustrating the shutter and the like in FIG. 40.

In FIG. 40, the shutter is indicated by a dashed line to clearly show the shutter.

In FIGS. 40 and 41, when the user moves the cassette unit 300 slightly toward the downstream side of the detaching direction in the state shown in FIGS. 37 and 39, the shutter 340 is further pressed by the hook portion 242.

At this time, a normal line of the inner surface 344 of the shutter 340 is inclined in the Y axis direction as the detaching direction. In addition, the portion in which the shutter 340 is pressed by the hook portion 242 descends from the contact point S and the point T in the downward direction which is the upstream side of the detaching direction. Accordingly, the hook portion 242 receives a force generated from the left side of FIGS. 40 and 41 by the inner surface 344 of the inclined shutter 340. Accordingly, the shutter closing hook 240 becomes curved toward the left side of FIGS. 40 and 41 so that the hook portion 242 is moved backward from the shutter 340.

On the other hand, the shutter 340 receives a reaction force of the shutter closing hook 240 to become curved toward the right side of FIGS. 40 and 41 since the shutter 340 is formed by a more flexible material than that of the shutter closing hook 240. Specifically, in the shutter 340, an extending portion in the Z axis direction between the second joint portion 341 and the portion in which the shutter 340 is pressed by the hook portion 242 becomes curved in the x axis direction.

Accordingly, the engagement of the hook portion 242 and the inner surface 344 of the shutter 340 is about to be released.

Figure 42:
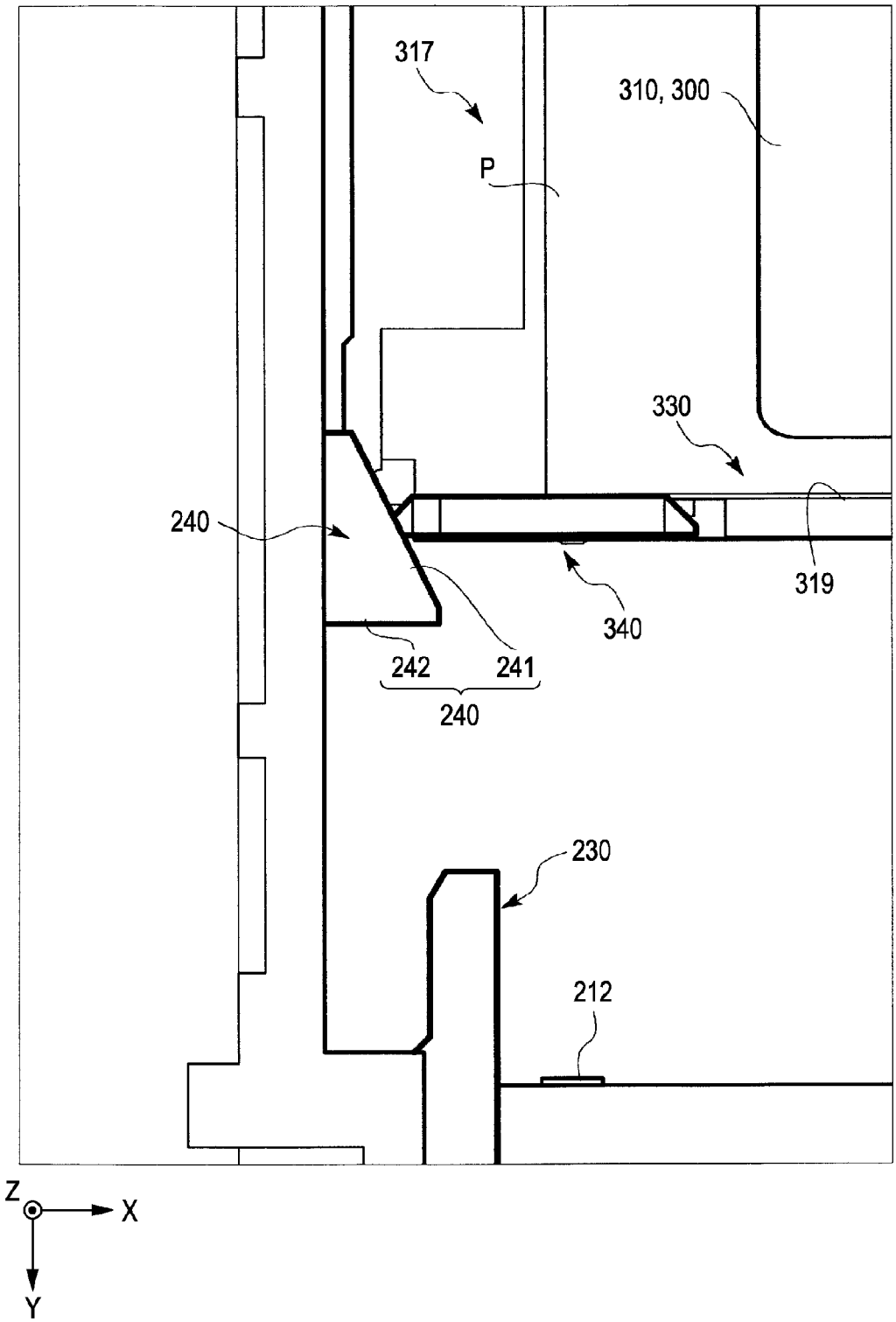
FIG. 42 is an expanded front view illustrating the shutter and the like when the shutter has been closed.

FIG. 42 is an expanded front view illustrating the closed shutter when the cassette unit is detached and shows the cassette unit moved toward the downstream side of the detaching direction in the state shown in FIGS. 40 and 41.

In FIG. 42, when the user moves the cassette unit 300 toward the downstream side of the detaching direction in the state shown in FIGS. 40 and 41, the shutter 340 is further pressed by the hook portion 242.

Moreover, the shutter closing hook 240 further becomes curved toward the left side of FIG. 42 so that the hook portion 242 is moved backward from the shutter 340. Furthermore, the shutter 340 receives the reaction force to further become curved toward the right side of FIG. 42.

As a result, the engagement of the inner surface 344 of the shutter 340 with the hook portion 242 becomes released. That is, the shutter 340 goes beyond the hook portion 242 toward the downstream side of the detaching direction. At this time, the shutter 340 is released from the pressing of the hook portion 242. Therefore, the shutter 340 is not curved and the normal line of the inner surface 344 of the shutter 340 is directed in the Y axis direction. That is, the shutter 340 becomes a completely closed state.

Moreover, it is possible to completely detach the cassette unit 300 from the printing apparatus body 101 by further moving the cassette unit 300 toward the downstream side of the detaching direction.

In this embodiment, the cassette unit 300 includes: the cassette case 310 which covers the paper sheet P and has the feeding opening 330 for passing the paper sheet P when the paper sheet P is fed by the feeding roller 190 of the printing apparatus body 101; the cassette hopper 320 which receives the paper sheet P and comes in contact with or separates from the feeding roller 190 in a state in which the cassette hopper 320 is mounted in the printing apparatus body 101; and the shutter 340 which is switched so as to allow the paper sheet P to pass through the feeding opening 330 or to prevent the paper sheet P from passing through the feeding opening 330. The cassette case 310, the cassette hopper 320, and the shutter 340 are formed integrally. The cassette hopper 320 is bent in a direction in which the cassette hopper 320 approaches the feeding roller 190 in the first joint portion 321 jointing with the cassette case to engage with the first case claws 311 and the second case claws 312 as a first engagement portion provided in the cassette case 310.

In the cassette unit 300 according to the embodiment, the cassette case 310 is provided with the hopper opening 315 through which the paper sheet P is inserted into the cassette case 310 so as to be close to the cassette hopper 320.

In this embodiment, the shutter 340 is bent toward the inside of the cassette case 310 in the second joint portion 341 jointing with the cassette case 310 to engage with the third case claw 313 as a second engagement portion provided in the cassette case 310.

In this embodiment, the shutter 340 becomes a close state where the paper sheet P is prevented from passing therethrough when the shutter 340 engages with the third case claw 313, and the shutter 340 becomes an open state where the paper sheet P is not prevented from passing therethrough when the shutter 340 is rotatably moved toward the inside of the cassette case 310 using the second joint portion 341 as the pivot point from the close state. The shutter 340 engages with the fourth case claw 314 as a third engagement portion provided in the cassette case 310 when the shutter 340 is closed, and the engagement with the fourth case claw 314 is released when the shutter 340 is opened. The fourth case claw 314 is separated from the third case claw 313 with reference to the second joint portion 341.

Moreover, the shutter unit 340 is formed in the L shape.

In this embodiment, the cassette hopper 320 includes the notch portion 324 formed at the position opposed to the feeding roller 190.

In this embodiment, the cassette unit includes the paper sheet P.

In this embodiment, the printing apparatus 100 includes the receiving unit 145 which receives the paper sheet P, the feeding unit 144 which feeds the received paper sheet P and the printing unit 143 which allows the printing head 106 to perform printing on the paper sheet P fed by the feeding unit 144. The receiving unit 145 includes the cassette unit 300.

Of course, a bending degree of the shutter closing hook 240 and a bending degree of the shutter 340 may be taken into consideration to make the front end of the hook portion 242 curved or inclined.

The invention is not limited to the above-described embodiment, but may be modified in various forms within the scope of the appended claims of the invention. Of course, the modifications pertain to the scope of the invention.

In the embodiment, the feeding unit 144 includes: the cassette unit 300 which has the shutter 340 switched so as to allow the paper sheet P as the printing medium to pass to the outside of the cassette unit 300 or to prevent the paper sheet P from passing to the outside thereof and is detachably mounted in a feeding mechanism body (the printing apparatus bodies 101, the feeding unit 144, and the base body 210); and the feeding roller 190 which feeds the paper sheet P received in the cassette unit 300; and the shutter opening protrusion 230 as a shutter opening mechanism which comes in contact with the shutter 340 to open the shutter 340 when the cassette unit 300 is mounted in the feeding mechanism body (the printing apparatus bodies 101, the feeding unit 144, and the base body 210).

In the embodiment, the feeding unit 144 includes the shutter closing hook 240 as a shutter closing mechanism which comes in contact with the shutter 340 to close the shutter 340 when the cassette unit 300 is detached from the feeding mechanism body (the printing apparatus bodies 101, the feeding unit 144, and the base body 210).

In the feeding unit 144, the shutter closing hook 240 formed in a hook shape includes the slope portion 241 on the upstream side of the mounting direction (Y) of the cassette unit 300. The slope portion 241 is inclined so as to gently ascend toward the downstream side of the mounting direction (Y).

In the feeding unit 144 according to the embodiment, the cassette case as the case of the cassette unit 300 is provided with the third case claw 313 as the first engagement portion for preventing the shutter 340 in the closed state from being rotatably moved toward the outside and the fourth case claw 314 as the second engagement portion for engaging the opening toward the inside. The shutter opening protrusion 230 releases the engagement of the fourth case claw 314 with the fourth shallow portion 343 of the shutter 340. The shutter closing hook 240 engages the fourth shallow portion 343 with the fourth case claw 314 of the shutter 340, and is moved in a direction (X) moving backward from the shutter 340 by the engagement of the third case claw 313 with the third shallow portion 342 of the shutter 340.

In the embodiment, the shutter 340 made of a flexible material is integrally formed in the cassette case 310.

In the embodiment, the shutter 340 is formed in the L shape.

In the embodiment, the printing apparatus 100 includes the feeding unit 144 for feeding the received paper sheet P and the printing unit 143 for allowing the printing head 106 to perform the printing on the paper sheet P fed from the feeding unit 144.

Of course, the bending degree of the shutter closing hook 240 and the bending degree of the shutter 340 may be taken into consideration to appropriately make the front end of the hook portion 242 round or inclined.

The invention is not limited to the above-described embodiment, but may be modified in various forms within the scope of the appended claims of the invention. Of course, the modifications pertain to the scope of the invention.

Another Embodiment 1

Figure 43:
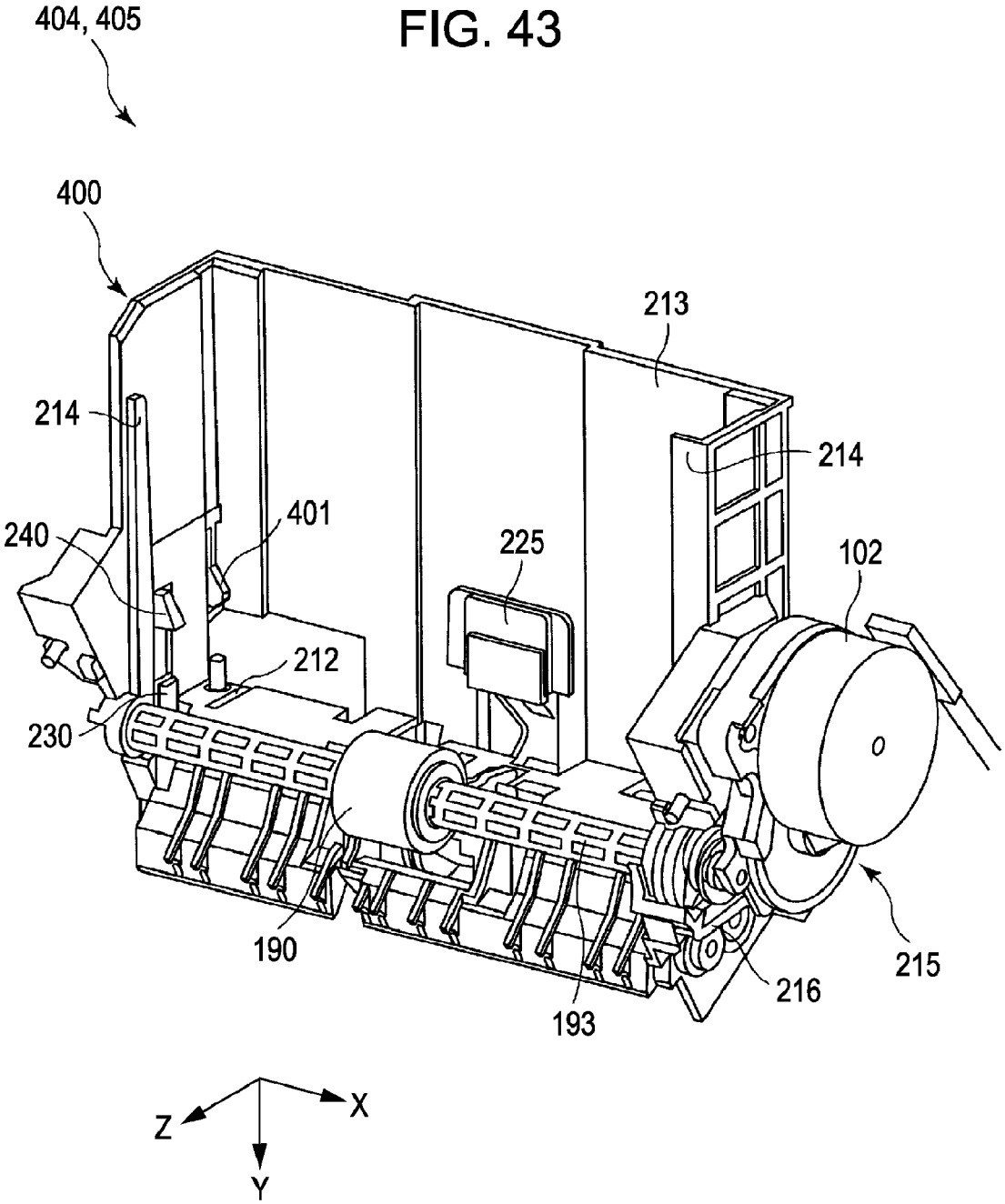
FIG. 43 is a perspective view illustrating a feeding unit according to another embodiment 1.
Figure 44:
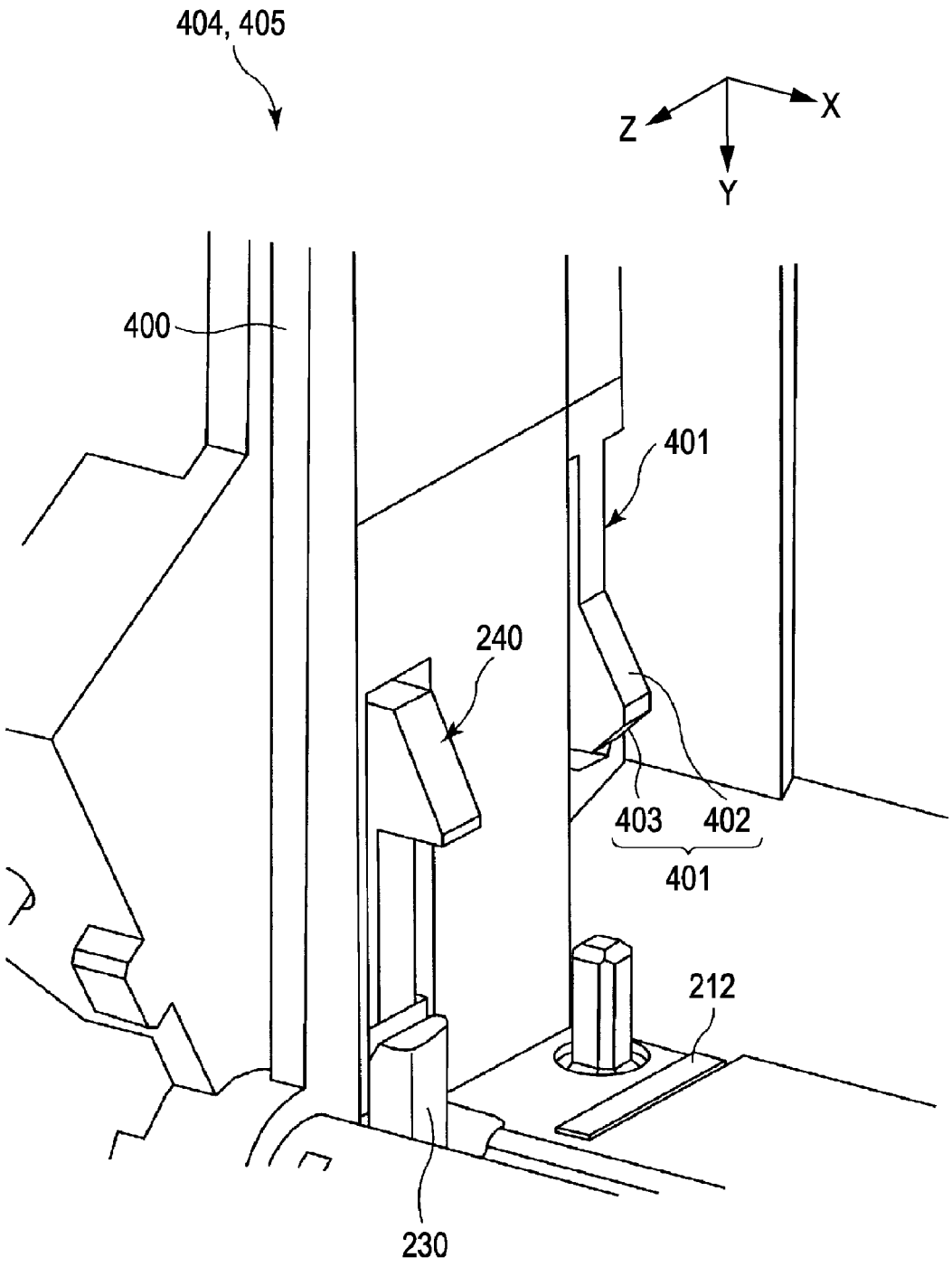
FIG. 44 is an expanded perspective view illustrating major elements on an 80-digit side of the feeding unit according to another embodiment 1.
Figure 45:
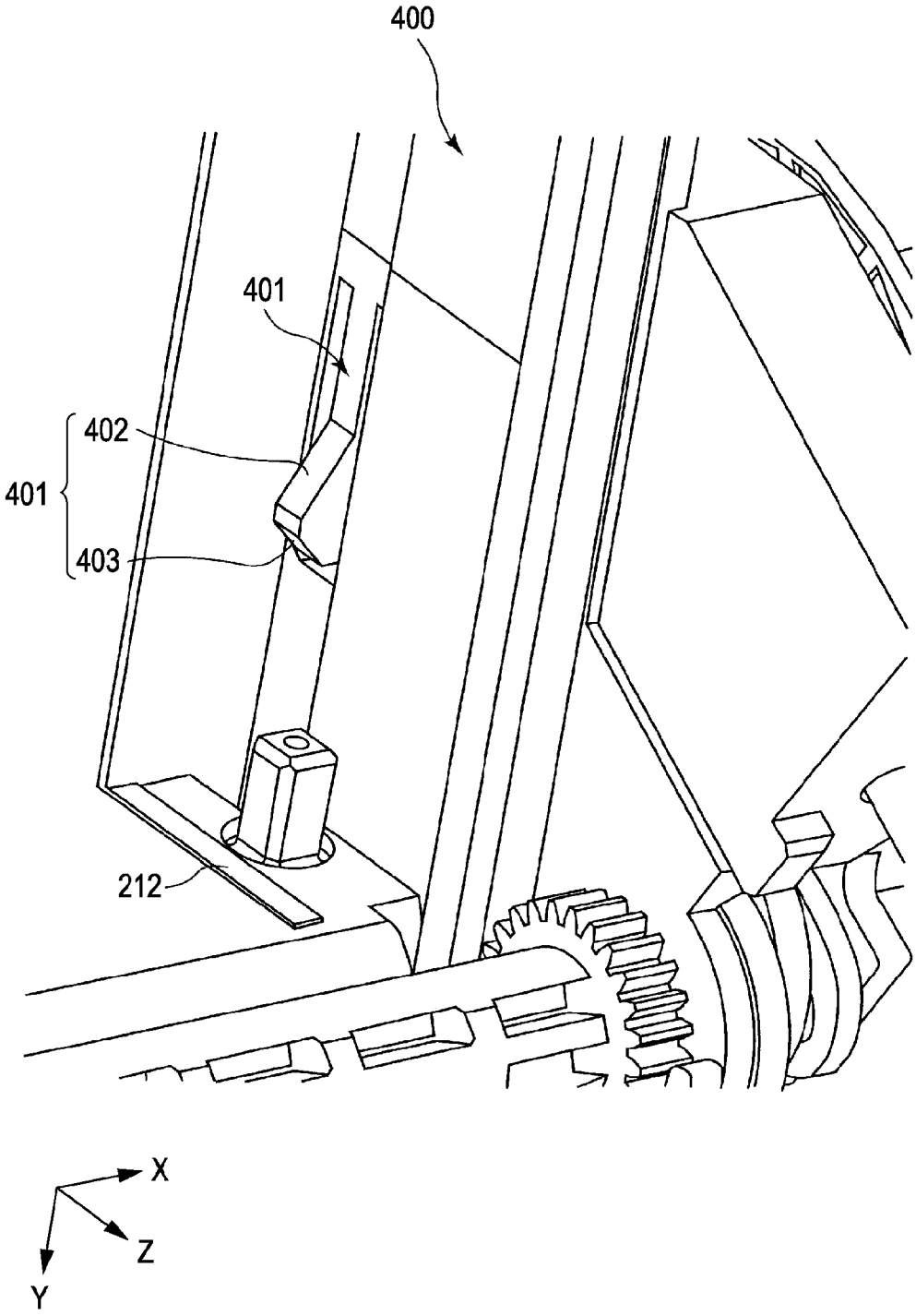
FIG. 45 is an expanded perspective view illustrating major elements on the 1-digit side of the feeding unit according to another embodiment 1.

FIG. 43 is a perspective view illustrating a feeding unit according to another embodiment 1. FIG. 44 is an expanded perspective view illustrating major elements on an 80-digit side in a transverse direction X of the feeding unit in FIG. 43. FIG. 45 is an expanded perspective view illustrating major elements on a 1-digit side in the transverse direction X of the feeding unit in FIG. 43.

As shown in FIGS. 43 to 45, a base unit 400 of a feeding unit 404 in a printing apparatus body 405 according to another embodiment 1 is provided with a pair of positioning hooks 401 in a transverse direction X of a paper sheet. In addition, the positioning hooks 401 are configured so as to be curved toward the outside in the transverse direction X of the paper sheet.

Figure 50:
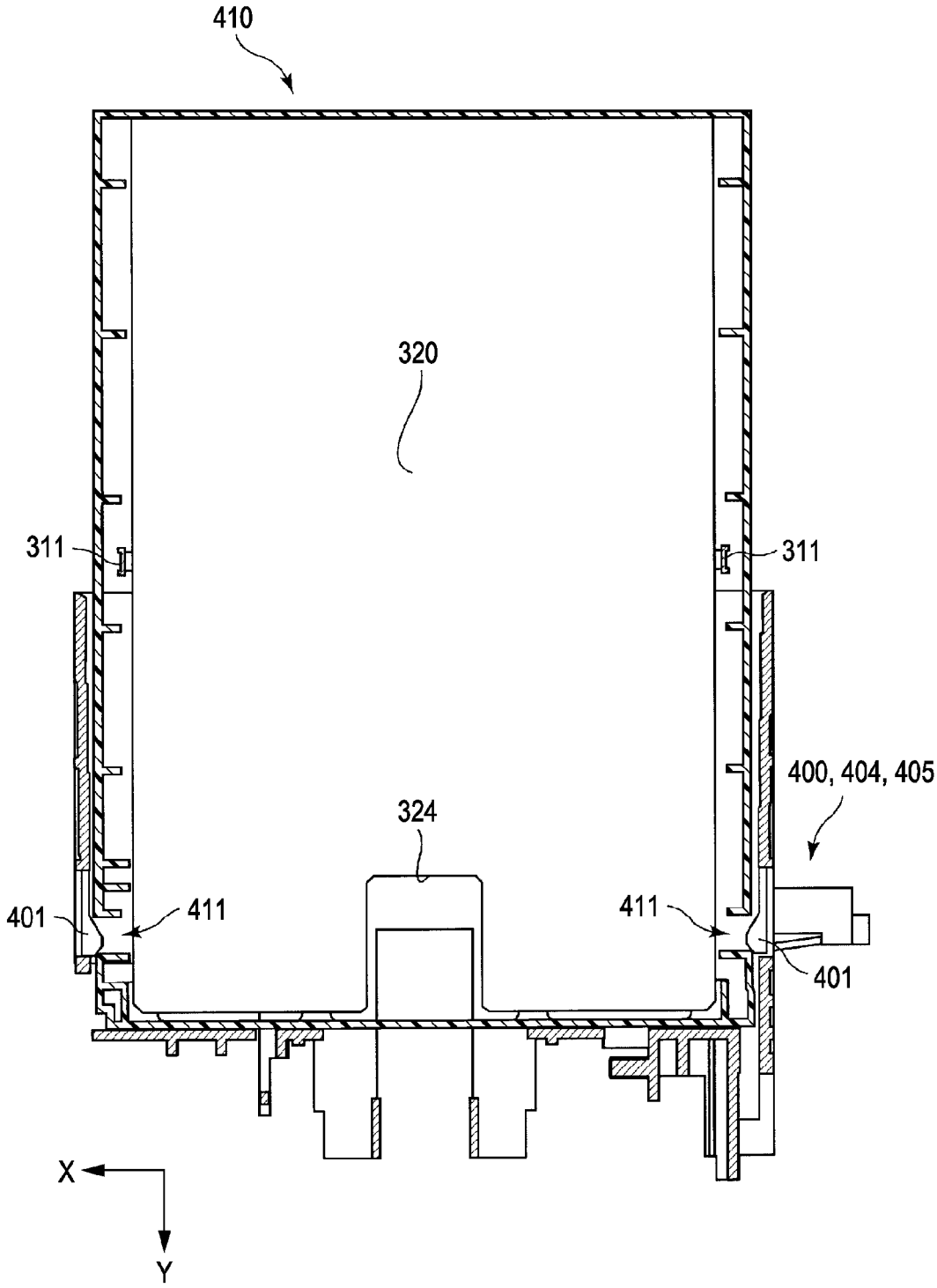
FIG. 50 is a front sectional view illustrating the cassette unit mounted in the feeding unit.

In this case, the outside in the transverse direction X refers to a direction in which the pair of the positioning hooks 401 get away from each other (see FIG. 50).

The pair of the positioning hooks 401 each include an upper slope portion 402 and lower slope portion 403 in a mounting direction Y of the cassette unit 410.

An operation of the positioning hooks 401 will be described below.

Other members are the same as those according to the above-described embodiment. Accordingly, the same reference numerals are used and the description will be omitted.

Figure 46:
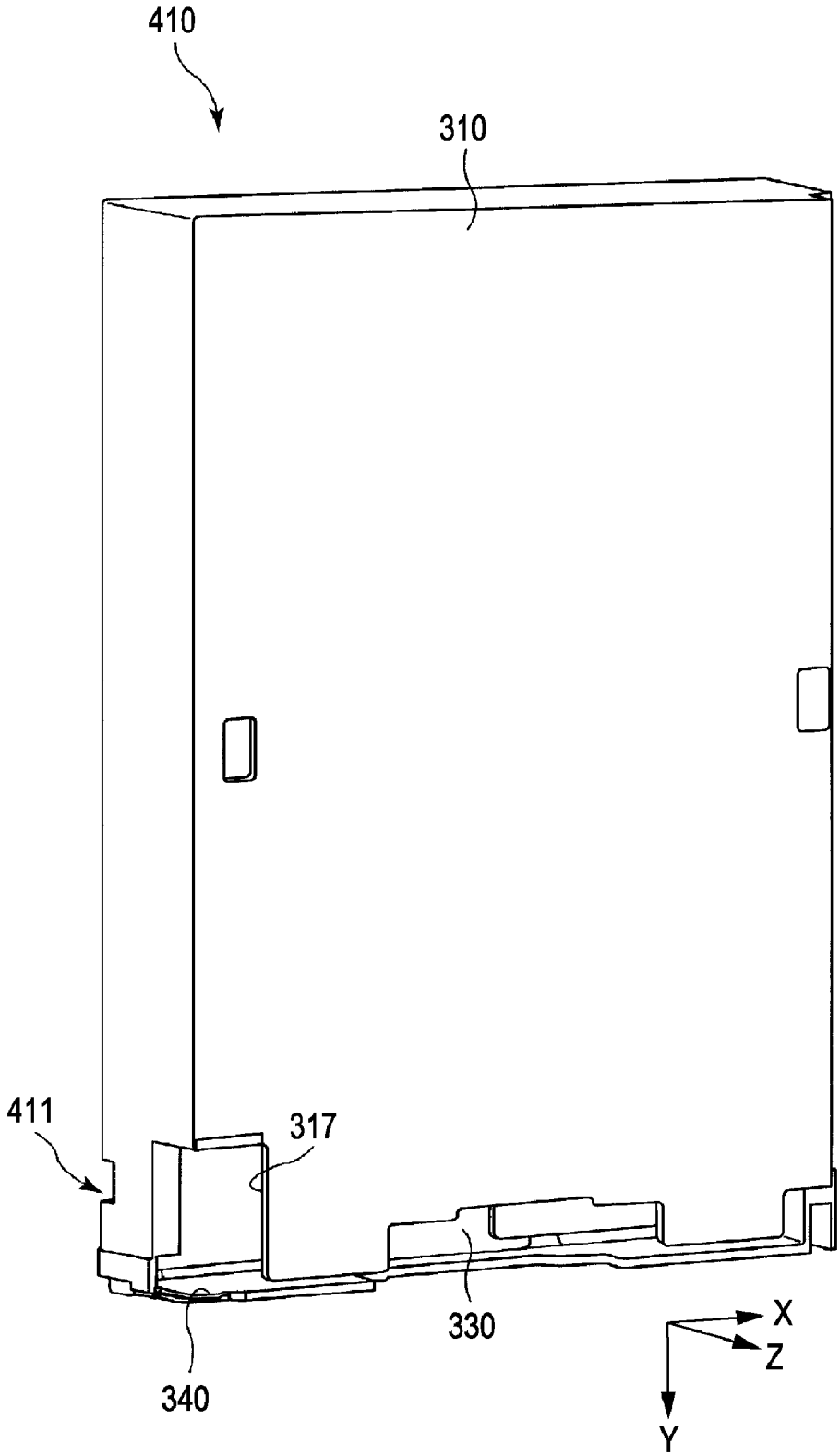
FIG. 46 is a front perspective view illustrating a cassette unit according to another embodiment 1.
Figure 47:
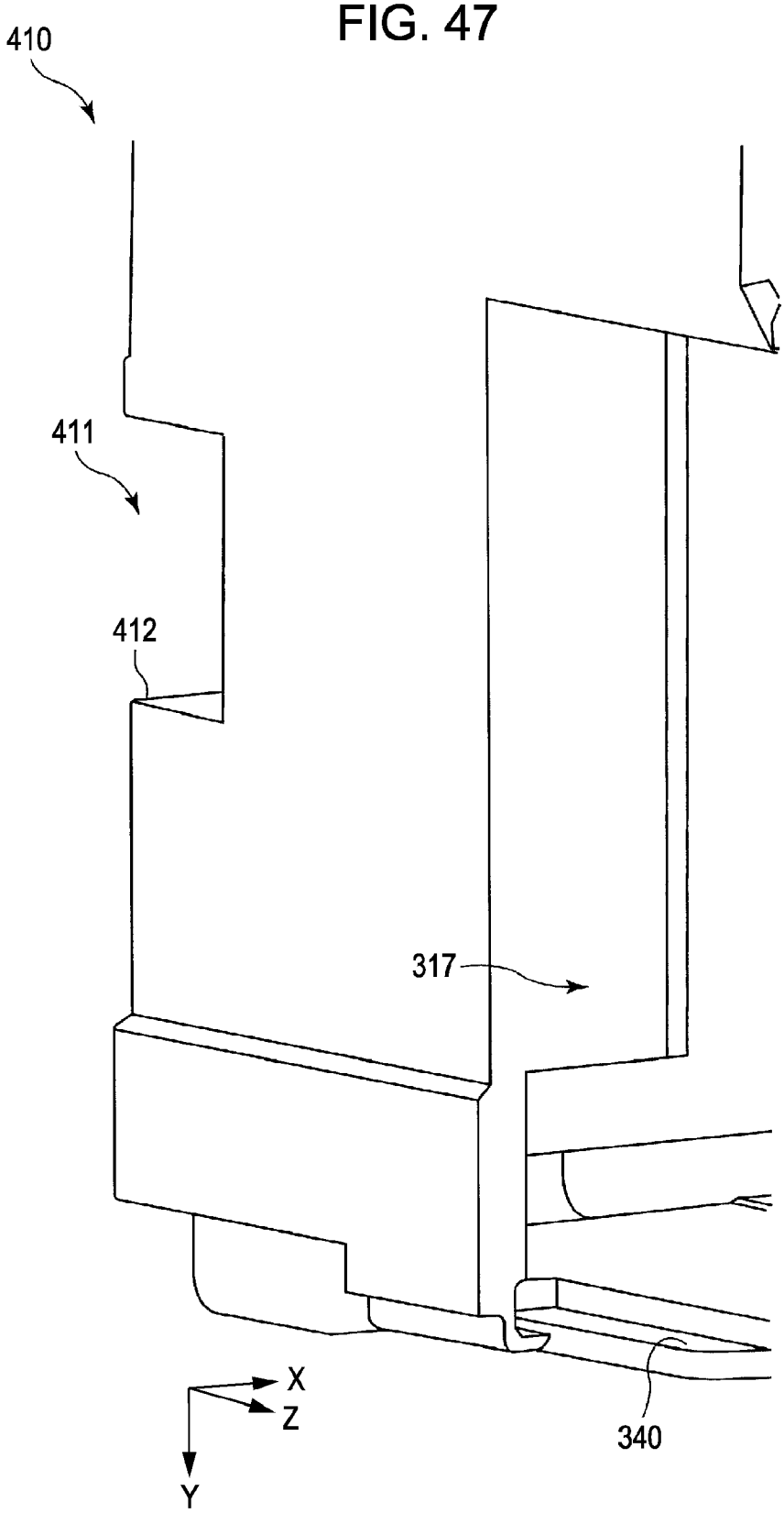
FIG. 47 is an expanded perspective view illustrating major elements on the 80-digit side of the cassette unit according to another embodiment 1.
Figure 48:
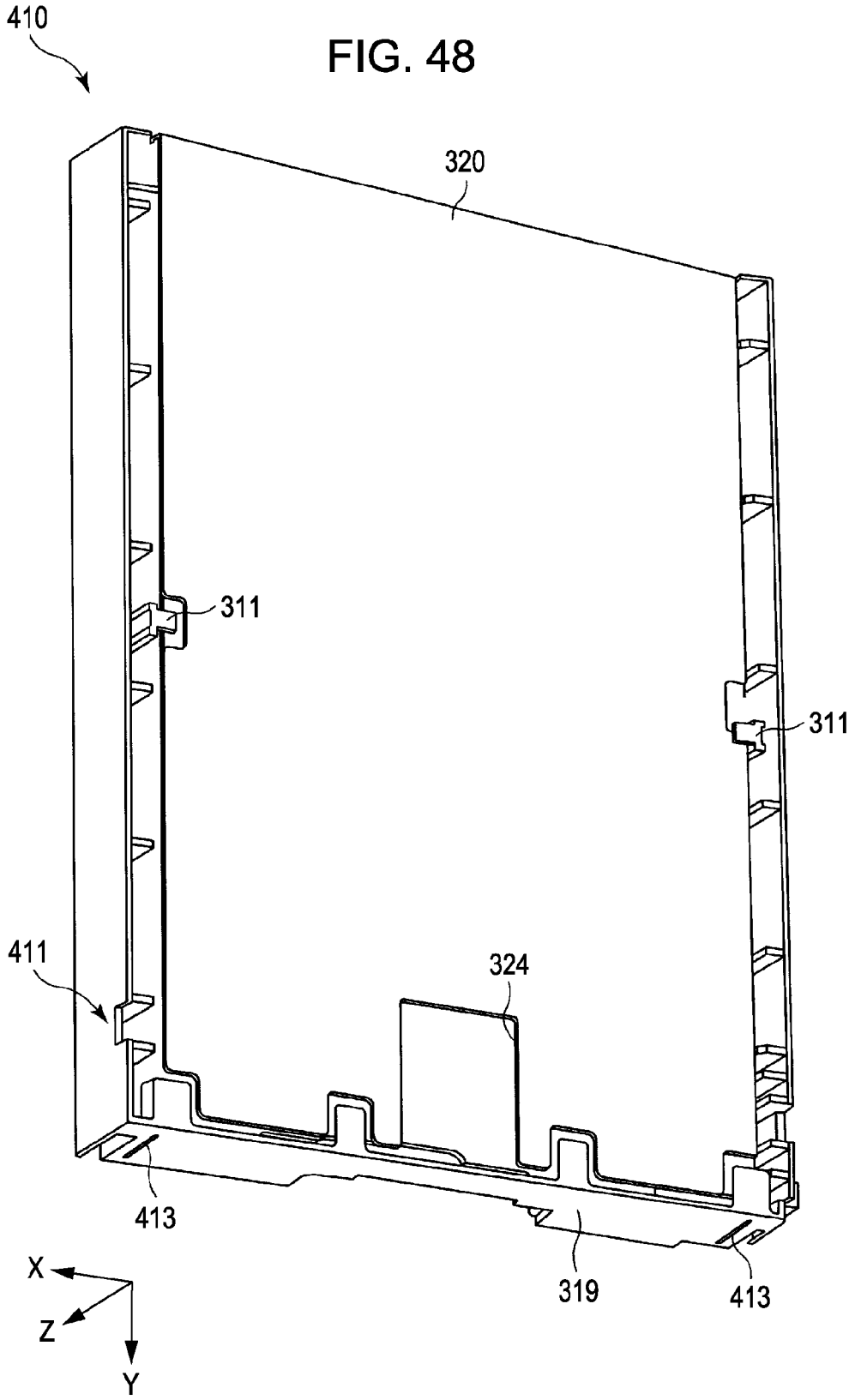
FIG. 48 is a rear perspective view illustrating the cassette unit according to another embodiment 1.
Figure 49:
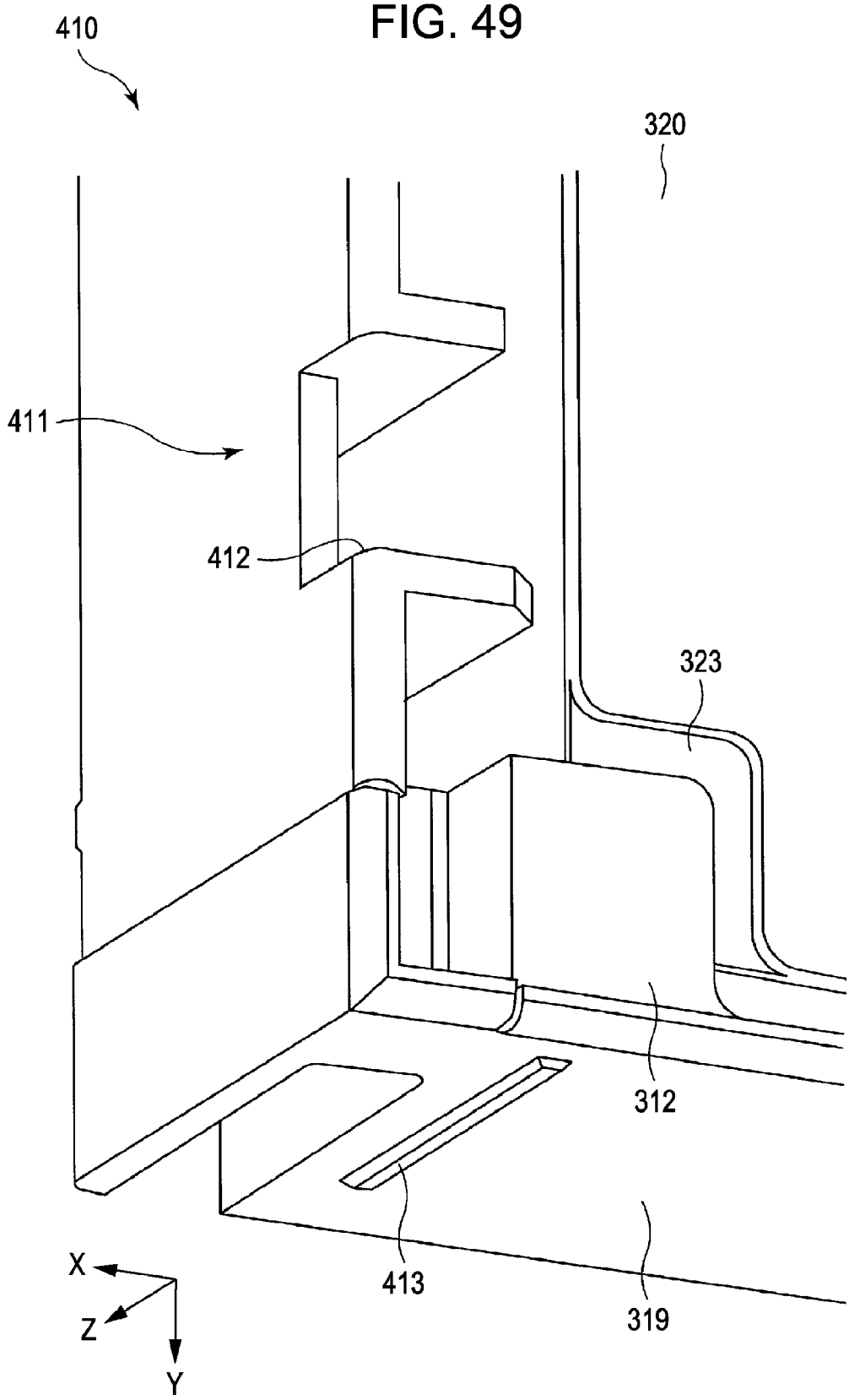
FIG. 49 is an expanded perspective view illustrating major elements on the 1-digit side of the cassette unit according to another embodiment 1.

FIG. 46 is a front perspective view illustrating the cassette unit according to another embodiment 1. FIG. 47 is an expanded perspective view illustrating major elements on the 80-digit side in the transverse direction X of the cassette unit in FIG. 46. FIG. 48 is a rear perspective view illustrating the cassette unit. FIG. 49 is an expanded perspective view illustrating major elements on the 1-digit side in the transverse direction X of the cassette unit in FIG. 46.

As shown in FIGS. 46 to 49, a pair of concave portions 411 are formed on both sides in the transverse direction X and on the lower side which is the downstream side of the mounting direction of the cassette unit 410 according to another embodiment 1. In the pair of concave portions 411, lower end portions 412 are formed in the lower side which is the downstream side of the mounting direction. As described below, the pair of concave portions 411 are configured to engage with the positioning hooks 401.

A pair of protruding claws 413 are formed on a front end controlling portion 319 on the downstream side of the mounting direction of the cassette unit 410. As described below, the pair of protruding claws 413 are configured so as to come in contact with a pair of contact portion 212 formed in the base body 400.

Other members are the same as those according to the above-described embodiment. Accordingly, the same reference numerals are used and the description will be omitted.

Figure 51:
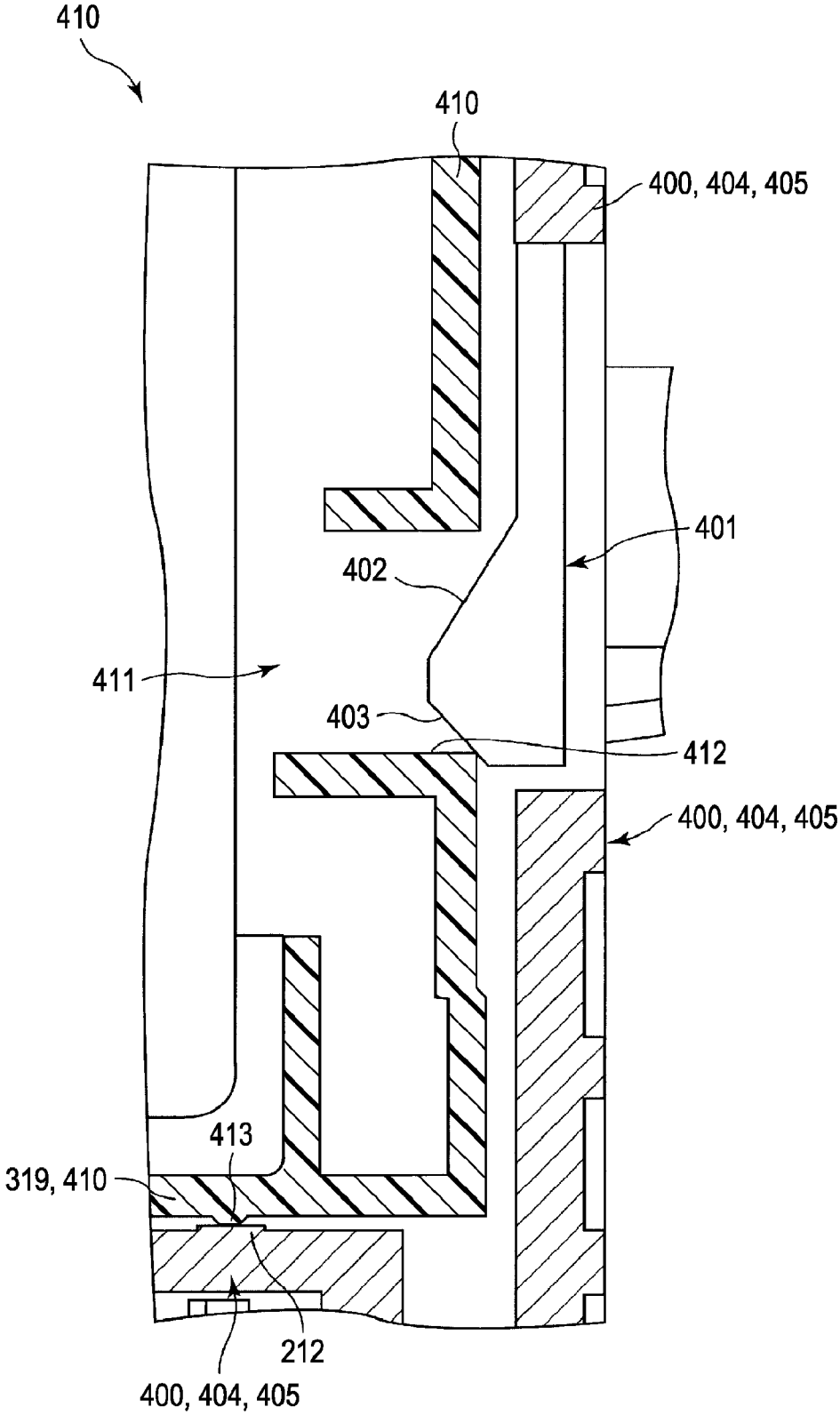
FIG. 51 is an expanded front sectional view illustrating the major elements on the 1-digit side in FIG. 50.

FIG. 50 is a front sectional view illustrating the cassette unit mounted in the feeding unit. FIG. 51 is an expanded front sectional view illustrating major elements on the 1-digit side in FIG. 50.

In FIGS. 50 and 51, first, the both ends in the transverse direction X of the front end controlling portion 319 formed on the lower side of the cassette unit 410 come in contact with the upper slope portions 402 of the positioning hooks 401 when the cassette unit 410 is mounted in the printing apparatus body 405. Subsequently, when a user pushes the cassette unit 410 in the mounting direction Y, the cassette unit 410 pushes up the upper slope portions 402 and pushes the positioning hooks 401 outward in the transverse direction X. That is, the positioning hooks 401 are deformed so as to be moved outward in the transverse direction X.

When the user pushes up the cassette unit 410 in the mounting direction Y, the positioning hooks 401 engage with the concave portions 411 and the pair of protruding claws 413 of the cassette unit 410 come in contact with the pair of contact portions 212 of the base body 400 of the feeding unit 404. At this time, the lower slope portions 403 of the positioning hooks 401 are configured so as to come in contact with the lower end portions 412 of the concave portions 411.

A force having a tendency to return to the inside in the transverse direction X is generated in the positioning hooks 401 when the positioning hooks 401 are deformed outward in the transverse direction X. Accordingly, the force applied toward the inside in the transverse direction X of the positioning hooks 401 is converted into a force for urging the lower end portions 412 of the concave portions 411 in the mounting direction Y by the lower slope portions 403.

In this case, the inside in the transverse direction X refers to a direction in which the pair of positioning hooks 401 approach each other (see FIG. 50).

As a result, the force can bring the pair of protruding claws 413 of the cassette unit 410 in contact with the pair of contact portions 212 of the base body 400. Moreover, the force can maintain the contact thereof. That is, the cassette unit 410 may not rattle. Accordingly, with such a configuration, it is possible to stabilize the position and posture of the cassette unit 410. Moreover, with such a configuration, it is possible to improve a capability in which the feeding unit 404 feeds the paper sheet. That is, it is possible to stabilize the feeding process of the feeding unit 404.

In the above-described embodiments, the printing apparatus (405 and 410) includes the deformable positioning hooks 401 which may be damaged more than the concave portions 411. Accordingly, it is possible to decrease a possibility that a user touches and damages the positioning hooks 401.

In the above-described embodiments, the cassette unit 410 is made of the flexible material. Accordingly, it is possible to effectively exert the engagement force of the positioning hooks 401 by providing the deformable positioning hooks 401 in the printing apparatus body. Moreover, it is possible to improve mounting feeling of the user when the user mounts the cassette unit 410.

On the other hand, when the cassette unit 410 is detached from the printing apparatus body 405, the user can detach the cassette unit 410 by pulling the cassette unit 410 in a reverse counter direction of the mounting direction Y. At this time, the lower end portions 412 of the concave portion 411 push up the lower slope portions 403 of the positioning hooks 401 and also push the positioning hooks 401 outward in the transverse direction X.

When the user pulls the cassette unit 410 in the reverse direction, the both sides in the transverse direction X of the cassette unit 410 go beyond the positioning hooks 401 to separate the cassette unit 410.

Other members are the same as those according to the above-described embodiment. Accordingly, the same reference numerals are used and the description will be omitted.

In another embodiment 1, the cassette unit 410 includes the concave portions 411 as an engagement member capable of engaging with the positioning hooks 401 as an elastic engagement portion provided in the printing apparatus body to which the cassette unit 410 as a cassette member is mounted.

In another embodiment 1, the positioning hooks 401 include the lower slope portions 403 as an inclined slope portion in the mounting direction Y of the cassette unit 410. In addition, in the state in which the cassette unit 410 is mounted in the printing apparatus body 405, the lower slope portions 403 come in contact with the lower end portions 412 of the concave portions 411.

The concave portions 411 engage with the positioning hooks 401 on the both sides of the cassette unit 410, but the invention is not limited thereto. Of course, the concave portions 411 may engage with the positioning hooks 401 on the front surface or the rear surface of the cassette unit 410, for example.

In the embodiment, the pair of positioning hooks are provided, but the invention is not limited thereto. The same advantage can be obtained as long as the number of the positioning hooks may be at least one.

The invention is not limited to the above-described embodiment, but may be modified in various forms within the scope of the appended claims of the invention. Of course, the modifications pertain to the scope of the invention.

What is claimed is:

1. A cassette unit comprising:

a cassette case which covers a printing medium and has a feeding opening for passing the printing medium to a printing apparatus body when the printing medium is fed by a feeding roller of the printing apparatus body;

a cassette hopper which receives the printing medium, wherein the cassette hopper is configured to come into contact with or separate from the feeding roller when the cassette hopper is mounted in the printing apparatus body, wherein the cassette hopper is joined with the cassette case at a first joint portion; and a shutter configured for switching so as to allow the printing medium to pass through the feeding opening or to prevent the printing medium from passing through the feeding opening, wherein the shutter joins the cassette case at a second joint portion and is configured for bending, at the second joint portion, toward an inside of the cassette case to engage with a second engagement portion provided in the cassette case, wherein the cassette case, the cassette hopper, and the shutter are integrally formed, wherein the cassette hopper is bent in a direction in which the cassette hopper approaches the feeding roller to engage with a first engagement portion provided in the cassette case.

2. The cassette unit according to claim 1, wherein the cassette case is provided with a hopper opening through which the printing medium is inserted into the cassette case so as to be close to the cassette hopper.

3. The cassette unit according to claim 1, wherein wherein the shutter prevents the printing medium from passing through the feeding opening when engaged with the second engagement portion.

4. The cassette unit according to claim 3, wherein the shutter is in a closed state when the shutter engages with the second engagement portion and the shutter is in an open state where the printing medium is not prevented from passing therethrough when the shutter is rotatably moved toward the inside of the cassette case using the second joint portion as a pivot point from the closed state, wherein the shutter engages with a third engagement portion provided in the cassette case when the shutter is in the closed state, and the engagement with the third engagement is released when the shutter is opened to the open state, and wherein the third engagement portion is separated from the second engagement portion.

5. The cassette unit according to claim 3, wherein the shutter is formed in an L shape.

6. The cassette unit according to claim 1, wherein the cassette hopper includes a notch portion formed at a position opposed to the feeding roller.

7. The cassette unit according to claim 1 further comprising a printing medium.

8. The cassette unit according to claim 1, further comprising an engagement portion which engages with an elastic engagement portion provided in the printing apparatus body.

9. The cassette unit according to claim 8, wherein the elastic engagement portion has a slope portion inclined in a direction in which the cassette unit is mounted, and wherein the slope portion comes in contact with the engagement portion when the cassette unit is mounted in the printing apparatus body.

10. A printing apparatus comprising:

a receiving unit which receives a printing medium;

a feeding unit which feeds the received printing medium; and a printing unit which allows a printing head to perform printing on the printing medium fed by the feeding unit, wherein the receiving unit includes the cassette unit according to claim 1.

11. The printing apparatus according to claim 10, wherein the feeding unit includes a feeding mechanism with a shutter opening portion which comes in contact with the shutter to open the shutter to the open state when the cassette unit is mounted in a feeding mechanism body.

12. The printing apparatus according to claim 11, wherein the feeding mechanism has a shutter closing portion which comes into contact with the shutter to close the shutter to the closed state when the cassette unit is detached from the feeding mechanism body.

* * * * *